US005976752A

United States Patent [19]

Matsunaga et al.

[11] Patent Number: 5,976,752

[45] Date of Patent: Nov. 2, 1999

[54] TONER AND IMAGE FORMING METHOD

[75] Inventors: Satoshi Matsunaga, Mishima; Koichi Tomiyama, Numazu; Yuichi Mizoh; Keita Nozawa, both of Shizuoka-ken; Minekazu Endo, Numazu; Tadashi Doujo, Numazu; Yoshihiro Ogawa, Numazu; Nene Shibayama, Mishima, all of Japan

[73] Assignee: Canon Kabushiki Kaisha, Tokyo, Japan

[21] Appl. No.: 09/135,167

[22] Filed: Aug. 18, 1998

[30] Foreign Application Priority Data

| | | | |
|---|---|---|---|
| Aug. 21, 1997 | [JP] | Japan | 9-224142 |
| Nov. 28, 1997 | [JP] | Japan | 9-328185 |
| Mar. 6, 1998 | [JP] | Japan | 10-054929 |
| Jun. 4, 1998 | [JP] | Japan | 10-155095 |

[51] Int. Cl.[6] ..... G03G 9/097; G03G 13/22

[52] U.S. Cl. ..... 430/110; 430/111; 430/126

[58] Field of Search ..... 430/110, 111, 430/126

[56] References Cited

U.S. PATENT DOCUMENTS

| | | | |
|---|---|---|---|
| 2,297,691 | 10/1942 | Carlson | 430/31 |
| 3,666,363 | 5/1972 | Tanaka et al. | 430/55 |
| 4,071,361 | 1/1978 | Marushima | 430/55 |
| 4,939,060 | 7/1990 | Tomiyama et al. | 430/106.6 |
| 5,135,833 | 8/1992 | Matsunaga et al. | 430/110 |
| 5,241,019 | 8/1993 | Otsuki et al. | 430/109 |
| 5,478,686 | 12/1995 | Kawakami et al. | 430/106.6 |
| 5,578,408 | 11/1996 | Kohtaki et al. | 430/106.6 |
| 5,660,963 | 8/1997 | Doujo et al. | 430/107 |
| 5,677,100 | 10/1997 | Asano et al. | 430/138 |
| 5,723,246 | 3/1998 | Aoki et al. | 430/109 |

FOREIGN PATENT DOCUMENTS

| | | |
|---|---|---|
| 54-114245 | 9/1979 | Japan . |
| 56-116043 | 9/1981 | Japan . |
| 58-102246 | 6/1983 | Japan . |
| 58-159546 | 9/1983 | Japan . |
| 1-156759 | 8/1987 | Japan . |
| 62-195680 | 8/1987 | Japan . |
| 62-195682 | 6/1989 | Japan . |
| 2-881 | 1/1990 | Japan . |
| 8-54753 | 2/1996 | Japan . |

*Primary Examiner*—Roland Martin

*Attorney, Agent, or Firm*—Fitzpatrick, Cella, Harper and Scinto

[57] ABSTRACT

An electrophotographic toner is composed of at least a binder resin, a colorant, and a wax. The binder resin (a) comprises a polyester resin, a vinyl resin and a hybrid resin component comprising a polyester unit and a vinyl polymer unit, (b) has a THF (tetrahydrofuran)-soluble content (W1) of 50–85 wt. % and a THF-insoluble content (W2) of 5–50 wt. %, an ethyl acetate-soluble content (W3) of 40–98 wt. % and an ethyl acetate-insoluble content (W4) of 2–60 wt. %, a chloroform-soluble content (W5) of 55–90 wt. % and a chloroform-insoluble content (W6) of 10–45 wt. %, respectively after 10 hours of Soxhlet extraction with respective solvents, giving a ratio W4/S6 of 1.1–4.0, and contains a THF-soluble content providing a GPC (gel permeation chromatography) chromatogram exhibiting a main peak in a molecular weight range of 4000–9000, including 35.0–65.0% (A1) of a component haing molecular weights in a range of 500 to below $1\times10^4$, 25.0–45.0% (A2) of a component having molecular weights in a range of $1\times10^4$ to below $1\times10^5$ and 10.0–30.0% (A3) of a component having molecular weights of at least $1\times10^5$ giving a ratio A1/A2 of 1.05–2.00. The binder resin shows good dispersibility of wax and colorant.

152 Claims, 17 Drawing Sheets

TEST PATTERN FOR NEGATIVE SLEEVE GHOST

TONER AND IMAGE FORMING METHOD

FIELD OF THE INVENTION AND RELATED ART

The present invention relates to a toner used in a recording method utilizing electrophotography, electrostatic recording, electrostatic printing or toner jet recording, and an image forming method using the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., via or without via an intermediate transfer member, as desired, fixed by heating, pressing, or heating and pressing, or with solvent vapor to obtain a copy or print carrying a fixed toner image.

As for the step of fixing the toner image onto a sheet material such as paper which is the final step in the above process, various methods and apparatus have been developed, of which the most popular one is a heating and pressing fixation system using hot rollers, or a fixed heat generating heater for fixation via a heat-resistant film.

In the heating and pressing system, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation.

In the fixing step, however, a hot roller surface and a toner image contact each other in a melted state and under a pressure, so that a part of the toner is transferred and attached to the fixing roller surface and then re-transferred to a subsequent fixation sheet to soil the fixation sheet. This is called an offset phenomenon and is remarkably affected by the fixing speed and temperature. Generally, the fixing roller surface temperature is set to be low in case of a slow fixing speed and set to be high in case of a fast fixing speed. This is because a constant heat quantity is supplied to the toner image for fixation thereof regardless of a difference in fixing speed.

The toner on a fixation sheet is deposited in several layers, so that there is liable to occur a large temperature difference between a toner layer contacting the heating roller and a lowermost toner layer particularly in a hot-fixation system using a high heating roller temperature. As a result, a topmost toner layer is liable to cause a so-called high-temperature offset phenomenon in case of a high heating roller temperature, while a so-called low-temperature offset is liable to occur because of insufficient melting of the lowermost toner layer in case of a low heating roller temperature.

In order to solve the above problem, it has been generally practiced to increase the fixing pressure in case of a fast fixing speed in order to promote the anchoring of the toner onto the fixation sheet. According to this method, the heating roller temperature can be somewhat lowered and it is possible to obviate a high-temperature offset phenomenon of an uppermost toner layer. However, as a very high shearing force is applied to the toner layer, there are liable to be caused several difficulties, such as a winding offset that the fixation sheet winds about the fixing roller, the occurrence of a trace in the fixed image of a separating member for separating the fixation sheet from the fixing roller, and inferior fixed images, such as resolution failure of line images and toner scattering, due to a high pressure.

In a high-speed fixing system, a toner having a lower melt viscosity is generally used than in the case of low speed fixation, so as to lower the heating roller temperature and fixing pressure, thereby effecting the fixation while obviating the high-temperature offset and winding offset. However, in the case of using such a toner having a low melt viscosity in low speed fixation, an offset phenomenon is liable to be caused because of the low viscosity.

Hitherto, as toner binder resins, polyester resins, and vinyl copolymers, such as styrene copolymers, have been principally used.

A polyester resin provides an excellent low-temperature fixability but is accompanied with a difficulty that it is liable to cause the high-temperature offset. For alleviating the difficulty, it has been tried to improve the viscoelasticity of a polyester resin by increasing the molecular weight. In this case, however, the low-temperature fixability is liable to be impaired, and the pulverizability during toner production can also be impaired, thus providing a binder resin not suitable for production of smaller particle size toners.

A vinyl copolymer, such as a styrene copolymer, has excellent pulverizability suitable for toner production, and provides excellent anti-high-temperature performance because the molecular weight thereof can be increased easily. However, if the molecular weight or glass transition temperature thereof is lowered in order to provide an improved low-temperature fixability, the anti-blocking property and developing performance are liable to be impaired.

In order to effectively utilize the advantages and compensate for the difficulties of the above two types of resins, several proposals have been made regarding the use of mixtures of these resins.

For example, Japanese Laid-Open Patent Application (JP-A) 54-114245 discloses a toner containing a mixture of a polyester resin and a vinyl copolymer. However, since a polyester resin and a vinyl copolymer have remarkably different chemical structures, they have poor mutual solubility and it is difficult to provide a toner satisfying low-temperature fixability, anti-high-temperature offset performance and anti-blocking property in combination.

Further, it is difficult to uniformly disperse various additives, particularly a wax, added for toner production, thus being liable to result in problems not only in fixing performance but also in developing performance of the resultant toner. This difficulty is liable to be noticeable especially in production of smaller-particle size toners which are preferred in recent years.

JP-A 56-116043 and JP-A 58-159546 disclose a toner containing a polymer obtained by polymerizing a vinyl monomer in the presence of a polyester resin.

JP-A 58-102246 and JP-A 1-156759 disclose a toner containing a polymer obtained by polymerizing vinyl monomers in the presence of an unsaturated polyester.

JP-B 8-16796 discloses a toner containing a block copolymer obtained by esterifying a polyester resin having a specific acid value and a styrene resin having a specific acid value and molecular weight.

JP-A 8-54753 discloses a toner containing a binder resin comprising a polycondensation resin and a vinyl resin and having a specific chloroform-insoluble content and a peak in a specific molecular weight range.

In the above-mentioned binder resin, the polycondensation resin and the vinyl resin can retain a stable phase separation state. However, the toner containing the binder resin is provided with somewhat improved anti-high-temperature offset performance but the low-temperature fixability thereof is still insufficient. Especially, in case where the toner contains a wax, it is difficult to control the wax dispersion state. The resultant toner still has room for improvement with respect to not only low-temperature fixability but also developing performance.

JP-A 62-195681 and JP-A 62-195682 disclose an electrophotographic developer composition comprising a vinyl resin-containing polyester resin containing a specific proportion of vinyl resin relative to polyester resin.

In the developer composition, however, the binder resin is a mixture wherein the vinyl resin is dispersed and mixed within the polyester resin, so that it is difficult to satisfy low-temperature fixability and anti-high-temperature offset property in combination.

Improvement in resolution and sharpness of images is desired for both copying machines and printers. For this purpose, the use of a smaller-particle size toner is effective.

A lowering in low-temperature fixability of toner is noticeable at a halftone image portion. According to our study, this is because the toner coverage amount forming a halftone image is smaller than that forming a solid image, and this tendency is remarkable in a medium to high speed image forming machine using a hot roller fixing device and a medium to low speed image forming machine using a press-heating fixing device using a fixed heater via a heat-resistant film.

Further, there are increasing demands for a smaller size, a higher speed and a better continuous image forming performance of an image forming apparatus, such as a printer, a copying machine, or a facsimile machine, based on electrophotography. In the course of development for complying with such demands, there has been observed a phenomenon called "pressure roller soiling" that once-offset toner is attached and accumulated on a pressure roller disposed opposite to a heating roller in the hot roller fixing device or a pressure roller disposed opposite to a heat resistant film in the press-heating scheme. If the phenomenon progresses and the toner accumulation amount is increased, paper is wound about the pressure roller to cause jamming. On the other hand, in order to provide a smaller size apparatus, there is a desire to remove a cleaning member for removing offset toner, thereby simplifying the fixing device and improving the continuous image forming performance. For complying with the desire while suppressing the occurrence of the paper jamming, it is required to improve the pressure roller soiling.

On the other hand, there is an increasing demand for a higher quality graphic image, including a uniform image density at a solid image portion.

Regarding the density uniformity of a solid image, there is observed a phenomenon called "negative sleeve ghost" as shown in FIG. 19 in one-component developer system that a printed halftone-solid image is accompanied with a reversal image of an immediately previously printed image occurring in a cycle of rotation of a toner-carrying member, thus lowering the graphic image quality. Thus, there has been desired to improve the negative sleeve ghost for providing a graphic image of higher quality.

SUMMARY OF THE INVENTION

A generic object of the present invention is to provide a toner for developing electrostatic images having solved the above-mentioned problems.

A more specific object of the present invention is to provide a toner wherein a wax is uniformly dispersed in a binder resin.

Another object of the present invention is to provide a toner capable of exhibiting good developing performance and providing a halftone image exhibiting good fixability even when formulated as a smaller particle size toner containing a large amount of a colorant, particularly a magnetic material.

An object of the present invention is to provide a toner capable of exhibiting a broad fixable temperature range including a good low-temperature fixability and anti-high-temperature offset property even when used in a high speed apparatus using a hot roller fixing device or a medium to low-speed apparatus using a fixed heater via a heat-resistant film.

Another object of the present invention is to provide a toner capable of providing a high-quality graphic image free from "negative sleeve ghost".

Another object of the present invention is to provide a toner free from pressure roller soiling that a toner causes attachment/accumulation onto a pressure roller.

Another object of the present invention is to provide a toner wherein a wax is dispersed in a well-controlled state so as not to adversely affect the fixability and the developing performance regardless of the species and addition amount of the wax.

A further object of the present invention is to provide an image forming method using a toner as described above.

According to the present invention, there is provided a toner, comprising: at least a binder resin, a colorant, and a wax;

wherein the binder resin is characterized by (a) comprising a polyester resin, a vinyl resin and a hybrid resin component comprising a polyester unit and a vinyl polymer unit, (b) having a THF (tetrahydrofuran)-soluble content (W1) of 50–85 wt. % and a THF-insoluble content (W2) of 5–50 wt. %, after 10 hours of Soxhlet extraction with THF, (c) having an ethyl acetate-soluble content (W3) of 40–98 wt. % and an ethyl acetate-insoluble content (W4) of 2–60 wt. %, after 10 hours of Soxhlet extraction with ethyl acetate, (d) having a chloroform-soluble content (W5) of 55–90 wt. % and a chloroform-insoluble content (W6) of 10–45 wt. %, after 10 hours of Soxhlet extraction with chloroform, (e) showing a ratio W4/S6 of 1.1–4.0, and (f) containing a THF-soluble content providing a GPC (gel permeation chromatography) chromatogram exhibiting a main peak in a molecular weight range of 4000–9000, including 35.0–65.0% (A1) of a component haing molecular weights in a range of 500 to below $1\times10^4$, 25.0–45.0% (A2) of a component having molecular weights in a range of $1\times10^4$ to below $1\times10^5$ and 10.0–30.0% (A3) of a component having molecular weights of at least $1\times10^5$ giving a ratio A1/A2 of 1.05–2.00.

According to another aspect of the present invention, there is also provided an image forming method, comprising:

a developing step of developing an electrostatic latent image held on an image-bearing member with the above-mentioned toner to form a toner image on the image-bearing member, a transfer step of transferring the toner image on the image-bearing member onto a recording material via or without via an intermediate transfer member, and a fixing step of fixing the toner image onto the recording material by a heat-fixing means.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
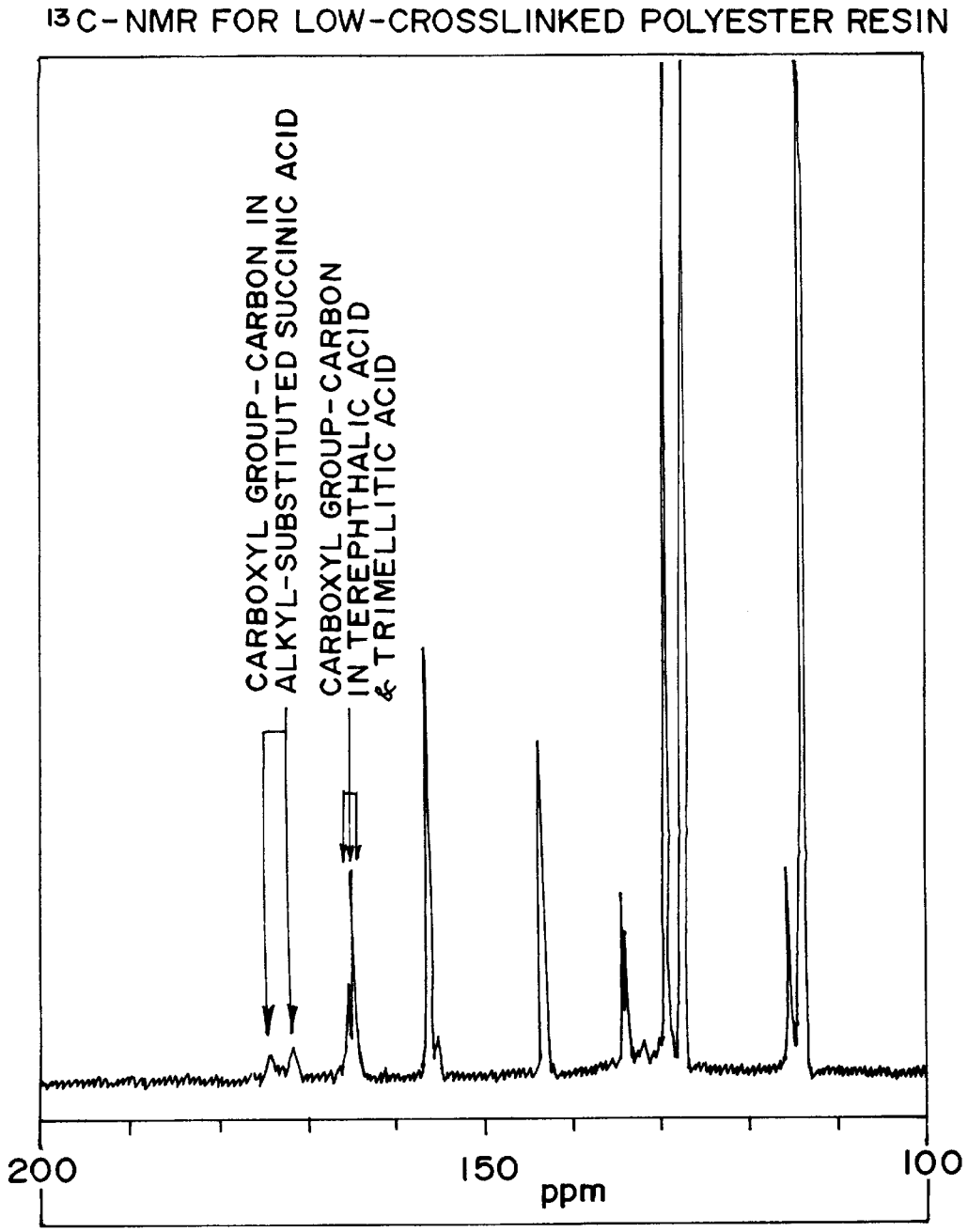
FIGS. 1 and 2 show $^{13}$C-NMR spectra of a low-crosslinked polyester resin and styrene-2-ethylhexyl acrylate copolymer, respectively.

According to our study, in order for a small-particle size toner having an increased content of colorant, particularly a magnetic material, to exhibit a good low-temperature fixability even for a halftone image and regardless of the type of a fixing device and a less liability of offset inclusive of a high-temperature offset generation temperature, it has been found important to use a toner binder resin including specific amounts of components having molecular weights and selective solubilities for a plurality of specific solvents.

Heretofore, the amount of a resin component insoluble in any one solvent selected from tetrahydrofuran, chloroform and ethyl acetate in a toner binder resin has been controlled. This may be sufficient to have a correlation with a high-temperature-offset generation temperature but is insufficient to evaluate the dispersion state of a wax in a toner which can affect remarkably not only the fixing performance but also the developing performance of the toner.

According to our study, THF (tetrahydrofuran) is a good solvent for a vinyl polymer unit of the binder resin contained in the toner according to the invention but not necessarily a good solvent for a polyester unit. The determination of a THF-insoluble content is the determination of a very high-molecular weight or highly crosslinked component in the polyester resin and a component which is relatively rich in polyester unit in the hybrid resin component. The determination of a THF-insoluble content allows an evaluation of low-temperature fixability of a toner. In order to accomplish a further better low-temperature fixability, it is important for a THF-soluble content has specific molecular weight and molecular weight distribution.

Ethyl acetate is a good solvent for the polyester unit but not necessarily a good solvent for the vinyl polymer unit, respectively, of the binder resin in the toner according to the present invention. The determination of an ethyl acetate-insoluble content is the determination of a very high-molecular weight or highly crosslinked component in the vinyl resin, a very high-molecular weight or highly crosslinked component in the polyester resin, and a component which is relatively rich in vinyl polymer unit in the hybrid resin component. The ethyl acetate-insoluble content includes a chloroform-soluble component and a chloroform-insoluble component. The determination allows the evaluation of a wax dispersion state which materially affect not only the fixability but also stable developing performances (such as environmental dependence of image density, fog, etc.).

Chloroform is a good solvent for both the vinyl polymer unit and the polyester unit of the binder resin contained in the toner according to the present invention. The determination of a chloroform-insoluble content is the determination of a very high-molecular weight or highly crosslinked component in the vinyl resin and a component having a very high-molecular weight or a highly crosslinked component in the hybrid resin component. The content of such very high molecular weight component or crosslinked components is closely related with a high-temperature-offset generation temperature and is also related with melt-sticking of toner onto the photosensitive member and cleaning failure, i.e., failure in removal of residual toner from the photosensitive member by a cleaning member, such as a blade, resulting in image defects.

Accordingly, a ratio (W4/W6) of the ethyl acetate-insoluble content (W4) to the chloroform-insoluble content (W6) in the binder resin not only shows a balance between wax dispersion and anti-high-temperature offset performance but also provides an indication of stable developing performance without generating image defects of the toner.

In the present invention, the toner binder resin may have a THF-insoluble content (W2) of 15–50 wt. %, preferably 20–45 wt. %, further preferably 25–40 wt. %. If the THF-insoluble content is below 15 wt. %, the resultant toner is liable to have a lower high-temperature-offset temperature leading to a problem in anti-hot offset performance and also result in inferior storability of the toner in some cases. If the THF-insoluble content exceeds 50 wt. %, the toner is liable to have an inferior low-temperature fixability.

In the present invention, the toner binder resin may have an ethyl acetate insoluble content (W4) of 2–60 wt. %, preferably 5–50 wt. %, further preferably 10–40 wt. %. If the ethyl acetate-insoluble content is below 2 wt. %, the anti-hot-offset performance of the toner is liable to be inferior, the control of wax dispersion state becomes difficult, and the image density can be lowered in continuous image forming operation. If the ethyl acetate-insoluble content exceeds 60 wt. %, the toner is liable to have inferior low-temperature fixability and result in fog density in continuous image formation.

The ratio (W4/W6) between the ethyl acetate-insoluble content (W4) and the chloroform-insoluble content (W6) may be 1.1–4.0, preferably 1.2–3.5, further preferably 1.3–3.0. If the ratio (W4/W6) is below 1.1 or above 4.0, the image density is liable to be lowered during continuous image.

In the present invention, it is further preferred that (i) the THF-insoluble content (W2) includes a chloroform-insoluble content (W6A wt. % based on the binder resin) and (ii) the ethyl acetate-insoluble content includes a chloroform-insoluble content (W6B wt. % based on the binder resin), satisfying the following conditions:

$$3 \text{ wt. } \% \leqq W6A \leqq 25 \text{ wt. } \%,$$

$$7 \text{ wt. } \% \leqq W6B \leqq 30 \text{ wt. } \%,$$

$$10 \text{ wt. } \% \leqq W6A + W6B \leqq 45 \text{ wt. } \%,$$

$$W6A : W6B = 1:1\text{–}3,$$

further preferably satisfying the following conditions:

$$5 \text{ wt. } \% \leqq W6A \leqq 20 \text{ wt. } \%,$$

$$10 \text{ wt. } \% \leqq W6B \leqq 25 \text{ wt. } \%,$$

$$15 \text{ wt. } \% \leqq W6A + W6B \leqq 40 \text{ wt. } \%,$$

$$W6A : W6B = 1:1.5\text{–}2.5.$$

If the chloroform-insoluble content (W6A) in the THF-insoluble content is below 3 wt. %, the anti-high-temperature offset performance is liable to be inferior and the image density can be lowered during continuous image formation.

If the chloroform-insoluble content (W6A) in the THF-insoluble content exceeds 25 wt. %, the low-temperature-fixability of the toner can be impaired.

If the chloroform-insoluble content (W6B) in the ethyl acetate-insoluble content is below 7 wt. %, the anti-high temperature-offset performance and anti-blocking performance can be inferior.

If the chloroform-insoluble content (W6B) in the ethyl acetate insoluble content (W4) exceeds 30 wt. %, the low-temperature fixability can be impaired.

The total (W6A+W6B) of the chloroform-insoluble content (W6A) in the THF-insoluble content (W2) and the chloroform-insoluble content (W6B) in the ethyl acetate-insoluble content (W4) corresponds to the chloroform-insoluble content (W6) of the binder resin.

If the ratio W6B/W6A is below 1, the anti-high-temperature performance and the anti-blocking performance of the toner can be impaired. If the ratio W6B/W6A exceeds 3, the low-temperature fixability can be impaired and the image density can be lowered during continuous image formation.

The THF-soluble content in the binder resin may provide a GPC-chromatogram showing a main peak in a molecular weight range of 4000–9000, preferably 5000–8500, further preferably 4500–8000. If the main peak is at a molecular weight below 4000, the anti-hot-offset performance can be impaired. If the main peak is at a molecular weight exceeding 9000, the low-temperature fixability can be impaired.

The THF-soluble content may include a component having molecular weights in a range of 5000–$10^4$ in a proportion (A1) of 35.0–65.0%, preferably 37.0–60.0%, further preferably 40.0–55.0%. If the proportion (A1) is below 35.0%, the low-temperature fixability of the toner can be impaired, and in excess of 65.0%, the storage stability of the toner can be impaired.

The component having molecular weights in the range of $10^4$ to below $10^5$ may be contained in a proportion (A2) of 25.0–45.0%, preferably 27.0–42.0%, further preferably 30.0–40.0%. If the proportion (A2) is below 25.0%, the anti-hot offset performance can be impaired, and in excess of 45.0%, the low-temperature fixability can be impaired.

The component having molecular weights in the range of at least $10^5$ may be contained in a proportion (A3) of 10.0–30.0%, preferably 12.0–25.0%, further preferably 15.0–22.0%. If the proportion (A3) is below 10.0%, the anti-hot offset performance can be impaired, and in excess of 30.0%, the low-temperature fixability can be impaired.

The ratio A1/A2 may be 1.05–2.00, preferably 1.10–1.90, further preferably 1.15–1.80. If the ratio is below 1.05, the low-temperature fixability can be impaired, and in excess of 2.00, the anti-hot offset performance can be impaired.

The binder resin for constituting the toner according to the present invention comprise a mixture of a polyester resin, a vinyl resin and a hybrid resin component. The hybrid resin component is a resin wherein the polyester resin and the vinyl resin are chemically bonded to each other as a polyester unit and a vinyl polymer unit. More specifically, during or after production of the polyester resin from its monomers and the vinyl resin from its monomers, including a carboxyl group-containing monomers, such as (meth)acrylate esters, a portion of the polyester resin and a portion of the vinyl resin are chemically bonded to each other through transesterification. The polyester unit and the vinyl polymer unit may be bonded to each other via a —CO.O— bond or a —CO.O.CO— bond. The hybrid resin component may preferably take a form of a graft polymer comprising the vinyl polymer unit as a trunk polymer and the polyester unit as branch polymer(s) or a block copolymer comprising a block of the polyester unit and a block of the vinyl polymer unit, preferably a graft polymer form.

In a preferred form of the binder resin, the hybrid resin component may be contained in such a proportion as to provide a carboxy exchange rate of 10–60 mol. %, preferably 15–55 mol. %, further preferably 20–50 mol. %. Herein, the carboxylate exchange rate means a percentage of carboxylate ester groups, preferably (meth)acrylate groups, of which the alcohol groups have been exchanged with alcohol-functional polyester units in the total carboxylate ester groups contained in the vinyl resin and the vinyl polymer unit of the hybrid resin component in the binder resin. If the carboxylate exchange rate is below 10 mol. %, the vinyl resin an the polyester resin are liable to have a poor mutual solubility therebetween, thus providing a poor wax dispersibility, and in excess of 70 mol. %, the toner can have a poor low-temperature fixability since the amount of a component having a relatively large molecular weight is increased.

For constituting the binder resin according to the present invention, the starting monomers for the polyester resins and the vinyl resin may preferably be used in proportions of 10–100 wt. parts, more preferably 10–80 wt. parts, further preferably 20–70 wt. parts of the monomers (i.e., vinyl monomers) for the vinyl resin per 100 wt. parts of the monomers for the polyester resin. As described above, portions of the monomers are taken into the hybrid resin component to constitute the vinyl polymer unit and the polyester unit.

The ethyl acetate-insoluble content (W4) may contain 40–98 wt. % of polyester resin component (Gp), preferably 50–95 wt. %, further preferably 60–90 wt. %. If the content of the polyester resin component (Gp) is below 40 wt. %, the fixability of the toner can be lowered, and in excess of 98 wt. %, the mutual solubility with a hydrocarbon wax can be impaired.

The ethyl acetate-soluble content (W3) may contain 20–90 wt. % of polyester resin component (Sp), preferably 25–85 wt. %, further preferably 30–80 wt. %. If the content of the polyester resin component (Sp) in the ethyl acetate-soluble content is below 20 wt. %, a hydrocarbon wax can be uniformly dispersed over the entire binder resin contained in the toner, so that the fixability may not be improved. In excess of 90 wt. %, a hydrocarbon wax is liable to be localized because of inferior mutual solubility, thus being liable to result in hot offset.

The Sp/Gp ratio may be 0.5–1, preferably 0.6–0.95, further preferably 0.65–0.9. If the ratio Sp/Gp is below 0.5 or above 1.0, the ethyl acetate-soluble content and the ethyl acetate-insoluble content are liable to be insufficiently mixed with each other, to result in inferior developing performance of the toner.

The ethyl acetate-soluble content (W3) may preferably have a weight-average molecular weight (Mw) of at least $2\times10^5$ and a ratio Mw/Mn (number-average molecular weight) of at least 30, more preferably $Mw=3\times10^5–2\times10^6$ and Mw/Mn=50–300, further preferably $Mw=4\times10^5–1.5\times10^6$. If Mw is below $2\times10^5$ or Mw/Mn is below 30, the toner is liable to have inferior developing performance.

The entire toner binder resin used in the present invention may have an acid value (AV1) of 7–40 mgKOH/g, preferably 10–37 mgKOH/g, more preferably 15–35 mgKOH/g, further preferably 17–30 mgKOH/g.

Further, the ethyl acetate-soluble content (W3) may have an acid value (AV2) of 10–45 mgKOH/g, preferably 15–45 mgKOH/g, more preferably 17–40 mgKOH/g, further preferably 20–35 mgKOH/g.

The ratio (AV1/AV2) between the acid values of the entire binder resin and the ethyl acetate-soluble content (W3) may preferably be 0.7–2.0, more preferably 0.9–1.7, further preferably 1.0–1.5.

If the acid value (AV1) of the entire binder resin is below 7 mgKOH/g or above 40 mgKOH/g, the image density can be lowered during a continuous image formation.

If the acid value (AV2) of the ethyl acetate-soluble content (W3) is below 10 mgKOH/g, the anti-high-temperature offset performance of the toner can be impaired, and in excess of 45 mgKOH/g, the low-temperature fixability can be impaired.

If the ratio AV1/AV2 is below 0.7, the image density can be lowered during a continuous image formation, and in excess of 2.0, the anti-high-temperature offset performance can be impaired.

In the toner according to the present invention, the polyester resin and the polyester unit in the hybrid resin component may preferably comprise at least one species of divalent carboxylic acids of Formulae (1)–(4) below, monovalent carboxylic acids of Formula (5) and monovalent alcohols of Formula (6) below:

Formulae (1)

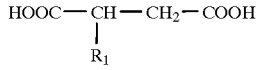

(2)

(3)

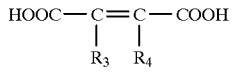

(4)

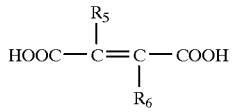

(5)

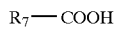

(6)

In the above formulae, $R_1$ denotes a linear, branched or cyclic alkyl or alkenyl group of at least 14 carbon atoms; $R_3$, $R_4$, $R_5$ and $R_6$ independently denote a hydrogen atom or a linear, branched or cyclic alkyl or alkenyl group of at least 3 carbon atoms with the proviso that both cannot be hydrogen atoms; $R_7$ and $R_8$ denote a linear, branched or cyclic alkyl or alkenyl group of at least 12 carbon atoms; and n is an integer of 12–40.

Specific examples of dicarboxylic acids represented by the above formula (1) may include Compounds (1-1) to (1-6) below:

(1-1)

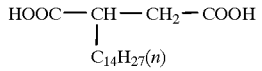

(1-2)

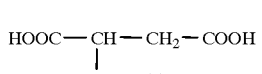

(1-3)

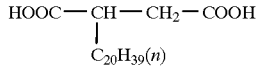

(1-4)

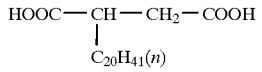

(1-5)

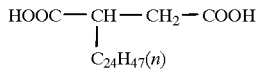

(1-6)

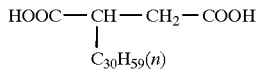

Specific examples of dicarboxylic acids represented by the formula (2) may include Compounds (2-1) to (2-4) below:

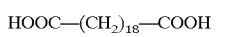

(2-1)

(2-2)

$$HOOC—(CH_2)_{24}—COOH \quad (2\text{-}3)$$

$$HOOC—(CH_2)_{34}—COOH \quad (2\text{-}4)$$

Specific examples of dicarboxylic acids represented by the formula (3) may include Compounds (3-1) to (3-3) below:

(3-1)

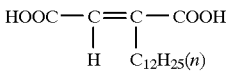

(3-2)

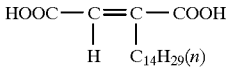

(3-3)

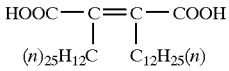

Specific examples of dicarboxylic acids represented by the formula (4) may include Compounds (4-1) and (4-2) below:

(4-1)

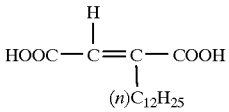

(4-2)

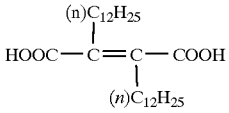

Specific examples of monocarboxylic acids represented by the formula (5) may include Compounds (5-1) to (5-5) below:

$$(n)C_{13}H_{27}—COOH \quad (5\text{-}1)$$

$$(n)C_{15}H_{31}—COOH \quad (5\text{-}2)$$

$$(n)C_{15}H_{31}—COOH \quad (5\text{-}3)$$

$$(n)C_{19}H_{39}—COOH \quad (5\text{-}4)$$

$$(n)C_{23}H_{47}—COOH \quad (5\text{-}5)$$

Specific examples of monohydric alcohols represented by the formula (6) may include Compounds (6-1) to (6-5) below:

$$(n)C_{12}H_{25}—OH \quad (6\text{-}1)$$

$$(i)C_{12}H_{25}—OH \quad (6\text{-}2)$$

$$(n)C_{14}H_{29}—OH \quad (6\text{-}3)$$

$$(n)C_{20}H_{41}—OH \quad (6\text{-}4)$$

$$(n)C_{30}H_{61}—OH \quad (6\text{-}5)$$

Examples of other monomers for constituting the polyester resin (and the polyester resin unit in the hybrid rein component) may include the following:

Diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (7-1):

(7-1)

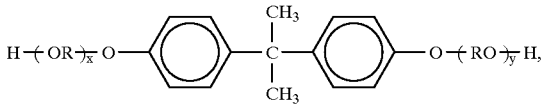

wherein R denotes an ethylene or propylene group, x and y are independently 0 or a positive integer with the L proviso that the average of x+y is in the range of 0–10; diols represented by the following formula (7-2):

(7-2)

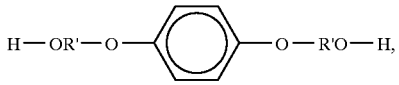

wherein R' denotes $—CH_2CH_2—$,

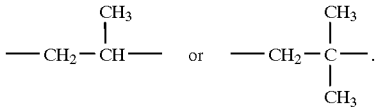

Examples of other acid components may include benzenedicarboxylic acids, such as phthalic acid, isophthalic acid and terephthalic acid, and their anhydrides; alkyldicarboxylic acids, such as succinic acid, adipic acid, sebacic acid and azelaic acid, and their anhydrides; $C_6$–$C_{18}$ alkyl or alkenyl-substituted succinic acids, and their anhydrides; and unsaturated dicarboxylic acids, such as fumaric acid, maleic acid, citraconic acid and itaconic acid, and their anhydrides.

An especially preferred class of alcohol components constituting the polyester resin is a bisphenol derivative represented by the above formula (7-1), and preferred examples of acid components may include dicarboxylic acids inclusive of phthalic acid, terephthalic acid, isophthalic acid and their anhydrides; succinic acid, n-dodecenylsuccinic acid, and their anhydrides, fumaric acid, maleic acid, and maleic anhydride. Preferred examples of crosslinking components may include trimellitic anhydride, benzophenonetetracarboxylic acid, pentaerythritol, and oxyalkylene ether of novolak-type phenolic resin.

The polyester resin may preferably have a glass transition temperature of 40–90 ° C., particularly 45–85° C., a number-average molecular weight (Mn) of 1,000–50,000, more preferably 1,500–20,000, particularly 2,500–10,000, and a weight-average molecular weight (Mw) of $3\times10^3$–$3\times10^6$, more preferably $1\times10^4$–$2.5\times10^6$, further preferably $4.0\times10^4$–$2.0\times10^6$.

Examples of a vinyl monomer to be used for providing the vinyl resin and the vinyl polymer unit of the hybrid resin component may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; esters of the below-mentioned α,β-unsaturated acids and diesters of the below-mentioned dibasic acids.

Examples of carboxy group-containing monomer may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as mono-methyl maleate, mono-ethyl maleate, mono-butyl maleate, mono-methyl citraconate, mono-ethyl citraconate, mono-butyl citraconate, mono-methyl itaconate, mono-methyl alkenylsuccinate, monomethyl fumarate, and mono-methyl mesaconate; unsaturated dibasic acid esters, such as dimethyl maleate and dimethyl fumarate; α,β-unsaturated acids, such as acrylic acid, methacrylic acid, crotonic acid, and cinnamic acid; α,β-unsaturated acid anhydrides, such as crotonic anhydride, and cinnamic anhydride; anhydrides between such an α,β-unsaturated acid and a lower aliphatic acid; alkenylmalonic acid, alkenylglutaric acid, alkenyladipic acid, and anhydrides and monoesters of these acids.

It is also possible to use a hydroxyl group-containing monomer: inclusive of acrylic or methacrylic acid esters, such as 2-hydroxyethyl acrylate, and 2-hydroxyethyl methacrylate; 4-(1-hydroxy-1-methylbutyl)styrene, and 4-(1-hydroxy-1-methylhexyl)styrene.

Among these, a combination of monomers providing a styrene copolymer or a styrene-(meth)acrylate copolymer may be particularly preferred.

In the toner binder resin according to the present invention, the polyester resin or polyester resin unit in the hybrid resin component may have a crosslinked structure formed by using a polybasic carboxylic acid having three or more carboxyl group or its anhydride, or a polyhydric alcohol having three or more hydroxyl groups. Examples of such a polybasic carboxylic acid or anhydride thereof may include: 1,2,4-benzenetricarboxylic acid, 1,2,4-cyclohexane-tricarboxylic acid, 1,2,4-naphthalenetricarboxylic acid, pyromellitic acid and anhydrides and lower alkyl esters of these acids. Examples of polyhydric alcohols may include: 1,2,3-propane triol, trimethylolpropane, hexanetriol, and pentaerythritol. It is preferred to use 1,2,4-benzenetricarboxylic acid or its anhydride.

In the binder resin according to the present invention, the vinyl resin or vinyl polymer unit can include a crosslinking structure obtained by using a crosslinking monomer, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

Such a crosslinking agent may be used in an amount of 0.01–10 wt. parts, preferably 0.03–5 wt. parts, of the other monomers for constituting the vinyl resin or vinyl polymer unit.

Among the crosslinking monomers, aromatic divinyl compounds, particularly divinylbenzene, and diacrylate compounds bonded by a chain including an aromatic group and an ether bond, are particularly preferred in order to provide the resultant polymer with good fixability and anti-offset performances.

In the present invention, it is preferred that the vinyl resin component and/or the polyvinyl resin component contain a monomer component reactive with these resin component. Examples of such a monomer component constituting the polyester resin and reactive with the vinyl resin may include: unsaturated dicarboxylic acids, such as phthalic acid, maleic acid, citraconic acid and itaconic acid, and anhydrides thereof. Examples of such a monomer component constituting the vinyl resin and reactive with the polyester resin may include: carboxyl group-containing or hydroxyl group-containing monomers, and (meth)acrylate esters.

In order to obtain a binder resins mixture containing a vinyl resin, a polyester resin and a hybrid resin component (i.e., a reaction product between the vinyl resin and polyester resin), it is preferred to effect a polymerization reaction for providing one or both of the vinyl resin and the polyester resin in the presence of a polymer formed from a monomer mixture including a monomer component reactive with the vinyl resin and the polyester resin as described above.

Examples of polymerization initiators for providing the vinyl resin or vinyl polymer unit according to the present invention may include: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylvaleronitrile), dimethyl-2,2'-azobisisobutyrate, 1,1'-azobis(1-cyclohexanecarbonitrile), 2-(carbamoylazo)isobutyronitrile, 2,2'-azobis(2,4,4-trimethylpentane), 2-phenylazo-2,4-dimethyl-4-methoxyvaleronitrile, 2,2'-azobis(2-methylpropane); ketone peroxides, such as methyl ethyl ketone peroxide, acetylacetone peroxide, and cyclohexanone, peroxide; 2,2-bis(t-butylperoxy)butane, t-butylhydroperoxide, cumene hydroperoxide, 1,1,3,3-tetramethylbutyl hydroperoxide, di-tert-butyl peroxide, t-butyl cumyl peroxide, α,α'-bis(t-butylperoxyisopropyl) benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxydiisophthalate, t-butyl peroxydiisophthalate, t-butyl peroxyallylcarbonate, t-amyl peroxy-2-ethylhexanoate, di-t-butyl peroxyhexahydroterephthalate, and di-t-butyl peroxyazelate.

The binder resin for constituting the toner according to the present invention may for example be produced according to the following methods (1)–(6):

(1) The vinyl resin, the polyester resin and the hybrid resin component are separately formed and then blended. The blending may be performed by dissolving or swelling the resins in an organic solvent, such as xylene, followed by distilling-off of the organic solvent. Preferably, a wax may be added in the blending step. The hybrid resin component may be produced as a copolymer by dissolving or swelling a vinyl resin and a polyester resin prepared separately in advance in a small amount of an organic solvent, followed by addition of an esterification catalyst and an alcohol and heating to effect transesterification.

(2) A vinyl resin is first produced, and in the presence thereof, a polyester resin and hybrid resin component are produced. The hybrid resin component may be produced through a reaction of the vinyl resin (and a vinyl monomer optionally added) with polyester monomers (such as an alcohol and a carboxylic acid) and/or a polyester. Also in this case, an organic solvent may be used as desired. During the production, a wax may preferably be added.

(3) A polyester resin is first produced, and in the presence thereof, a vinyl resin and a hybrid resin component are produced. The hybrid resin component may be produced through the reaction of the polyester resin (and polyester monomers optionally added) with vinyl monomers and/or a vinyl resin in the presence of an esterification catalyst.

(4) A vinyl resin and a polyester resin are first produced, and in the presence of these resins, vinyl monomers and/or polyester monomers (alcohol and carboxylic acid) are added thereto for polymerization and transesterification. Also this instance, an organic solvent may be used as desired. A wax may preferably be added. A wax may preferably be added in this step.

(5) A hybrid resin component is first prepared, and then vinyl monomers and/or polyester monomers are added to effect addition polymerization and/or polycondensation. In this instance, the hybrid resin component may be one prepared in the methods of (1)–(4), or may be one produced through a known process. An organic solvent may be added as desired. A wax may preferably be added in this step.

(6) Vinyl monomers and polyester monomers (alcohol and carboxylic acid) are mixed to effect addition polymerization and polycondensation successively to provide a vinyl resin, a polyester resin and a hybrid resin component. An organic solvent may be added as desired. A wax may preferably be added in this step.

In the above methods (1)–(5), the vinyl resin and/or the polyester resin may respectively comprise a plurality of polymers having different molecular weights and crosslinking degrees.

In the above-described methods (1)–(6), the method (3) may be preferred because of easy molecular weight control of the vinyl resin, controllability o formation of the hybrid resin component and control of the wax dispersion state, if the wax is added at that time.

The toner according to the present invention contains a wax and, as a result, may preferably provide a DSC heat absorption curve obtained by use of a differential scanning calorimeter (DSC) exhibiting a heat absorption main peak in a temperature region of 70–160° C., more preferably 70–140° C., more preferably 75–140° C., most preferably 80–135° C., so as to have good low-temperature fixability and anti-offset performance.

It is further preferred that the wax-containing toner according to the present invention has, on its DSC heat-absorption curve, a heat-absorption main peak and a heat-absorption sub-peak or shoulder in a temperature region of 80–155° C., more preferably 90–130° C, in view of the low-temperature fixability, anti-offset property and anti-blocking performance.

In order to provide a clear heat-absorption peak in a temperature range of 70–160° C. on the DSC curve of the toner, it is necessary to use a wax selected from a specific range. When the melting point of a wax is defined as a temperature giving a maximum heat-absorption peak on a DSC curve of the wax as measured in a manner described hereinafter, the wax used in the present invention may preferably have a melting point of 70–160° C., more preferably 75–160° C., further preferably 75–140° C., most preferably 80–130° C.

Examples of such waxes may include: aliphatic hydrocarbon waxes, such as low-molecular weight polyethylene, low-molecular weight polypropylene, microcrystalline wax, and paraffin wax, oxidation products of aliphatic hydrocarbon waxes, such as oxidized polyethylene wax, and block copolymers of these; waxes containing aliphatic esters as principal constituents, such as carnauba wax, sasol wax, montanic acid ester wax, and partially or totally deacidified aliphatic esters, such as deacidified carnauba wax. Further examples of waxes may include: saturated linear aliphatic acids, such as palmitic acid, stearic acid, and montanic acid; unsaturated aliphatic acids, such as brassidic acid, eleostearic acid and parinaric acid; saturated alcohols, such as stearyl alcohol, behenyl alcohol, ceryl alcohol, and melissyl alcohol; polyhydric alcohols, such as sorbitol; aliphatic acid amides, such as linoleylamide, oleylamide, and laurylamide; saturated aliphatic acid bisamides, methylene-bisstearylamide, ethylene-biscaprylamide, and ethylene-biscaprylamide; unsaturated aliphatic acid amides, such as ethylene-bisolerylamide, hexamethylene-bisoleylamide, N,N'-dioleyladipolyamide, and N,N'-dioleylsebacoylamide, aromatic bisamides, such as m-xylene-bisstearoylamide, and N,N'-distearylisophthalylamide; aliphatic acid metal salts (generally called metallic soap), such as calcium stearate, calcium laurate, zinc stearate, and magnesium stearate; grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

Low-melting point waxes preferably used in the present invention may comprise hydrocarbons having a long-chain alkyl group with little branching, examples of which may include: a low-molecular weight alkylene polymer obtained through polymerization of an alkylene by radical polymerization under a high pressure or in the presence of a Ziegler catalyst under a low pressure; an alkylene polymer obtained by thermal decomposition of an alkylene polymer of a high molecular weight; and a hydrocarbon wax obtained by subjecting a mixture gas containing carbon monoxide and hydrogen to the Arge process to form a hydrocarbon mixture and distilling the hydrocarbon mixture to recover a residue. Fractionation of wax may preferably be performed by the press sweating method, the solvent method, vacuum distillation or fractionating crystallization. As the source of the hydrocarbon wax, it is preferred to use hydrocarbons as obtained through synthesis from a mixture of carbon monoxide and hydrogen in the presence of a metal oxide catalyst (generally a composite of two or more species), e.g., by the Synthol process, the Hydrocol process (using a fluidized catalyst bed), and the Arge process (using a fixed catalyst bed) providing a product rich in waxy hydrocarbon.

High-melting point waxes preferably used in the present invention may comprise hydrocarbons with little branching, examples of which may include: a low-molecular weight alkylene polymer by radical polymerization under a high pressure or in the presence of a Ziegler catalyst under a low pressure; an alkylene polymer obtained by thermal decomposition of an alkylene polymer of a high molecular weight; a hydrocarbon wax obtained as a residue after subjecting a mixture gas containing carbon monoxide and hydrogen to the Arge process to form a hydrogen mixture and distilling the hydrocarbon mixture; and synthetic hydrocarbon waxes obtained as hydrogenation product of the residue. Other preferred waxes may include substituted-alkyl waxes having substituents, such as hydroxyl groups are carboxyl groups.

It has been also formed that a long-chain alkyl compound as represented by the following formula (A), (B) or (C) can be particularly effectively dispersed within the binder resin containing the hybrid resin component:

$$CH_3-(CH_2)_x-CH_2OH, \quad (A)$$

wherein x denotes an average number of the range of 35–150;

$$CH_3-(CH_2)_x-O-(CH(R)-CH_2-O)_y-H, \quad (B)$$

wherein x denotes an average number in the range of 35–150, y denotes an average number in the range of 1–5, and R denotes a hydrogen atom or an alkyl group having 1–10 carbon atoms; and $$CH_3-(CH_2)_x-CH_2COOH, \quad (C)$$

wherein x denotes an average number in the range of 35–150.

The long-chain alkyl compound represented by the above formula (A), (B) or (C) has a hydrophobic alkyl group and a hydrophollic hydroxyl or carboxyl group, so that it shows a good mutual solubility with both a polyester resin and non-polar waxes, such as hydrocarbon wax and polyolefin wax.

Accordingly, similarly as the carboxylic acid or alcohol represented by the above-mentioned formulae (1)–(5), such a long-chain alkyl compound can be dispersed in a well-controlled state when used together with the hybrid resin component. This is especially effective in the case of preparation of a toner through a kneading step wherein such a wax is added.

According to our study, in the case of using the binder resin containing the hybrid resin component and the long-chain alkyl compound of the formula (A), (B) or (C) in combination, the amounts of the THF-insoluble content, the ethyl acetate-insoluble content and the chloroform-insoluble content can be correlated with the low-temperature fixability, developing performance and anti-high-temperature offset performance of the resultant toner. Further, from the wax contents in the insoluble matters in the respective solvents of THF, ethyl acetate and chloroform, it is possible to evaluate the wax dispersion state.

More specifically, the wax dispersion state can be evaluated from a comparison between the amount of wax dispersed in the hybrid resin component comprising a vinyl polymer unit and a polyester unit and the total amount (H) of wax contained in the toner particles.

According to our study, it is assumed that a portion of wax contained in the THF-insoluble content (W2) principally corresponds to a wax concentration (H1) dispersed in a hybrid resin component having a relatively large polyester unit content, a portion of wax contained in the ethyl acetate-insoluble content (W4) principally corresponds to a wax concentration (H2) dispersed in a hybrid resin component having a relatively large vinyl polymer unit content principally corresponds to a wax concentration (H3) dispersed in a hybrid resin component crosslinked or having a very large molecular weight.

Accordingly, the dispersion state of wax contained in toner particles can be evaluated by ratios (H:H1:H2:H3) of wax concentration contained in the toner particles, and the insoluble contents in the respective solvents of THF, ethyl acetate and chloroform.

In the present invention, the ratios H:H1:H2:H3 may be in the range of 1:0.6:0.6:0.6–1:2:2:2, preferably 1:0.7:0.7:0.7–1:1.7:1.7:1.7, further preferably 1:0.8:0.8:0.8–1:1.5:1.5:1.5.

If the ratio of H1, H2 or H3 to H is below 0.6, the wax has a stronger mutual solubility with either the vinyl polymer unit or polyester unit or is dispersed in a small particle size, so that it is liable to be localized in the toner particles. On the other hand, if the ratio of H1, H2 or H3 to H exceeds 2, the wax shows a poor mutual solubility with both the vinyl polymer unit and polyester unit and is dispersed in a large particle size. In either case, any of the low-temperature fixability, the anti-high-temperature offset performance and the anti-blocking performance is liable to be problematic.

Generally, the low-temperature fixability of a toner may be correlated with a soluble low-molecular weight resin component soluble in a solvent, and the high-temperature offset may correlated with an insoluble high-molecular weight resin component. By mutual supplements, the fixability and the anti-hot-offset performance are satisfied in combination.

In other words, the low-temperature fixability of a toner can be hindered by the presence of an insoluble resin component. The ethyl acetate-insoluble polyester resin component in the toner binder resin according to the present invention shows a good mutual solubility with the long-chain alkyl compound of the formula (A), (B) or (C) and selectively interacts with each other to stabilize the dispersion state. Moreover, at the time of heat fixation of the toner, the ethyl acetate-insoluble component can be effectively softened by the long-chain compound (A), (B) or (C), thus little hindering the fixability but accomplishing good anti-hot-offset performance.

The above-mentioned long-chain alkyl compound (A) may be obtained, e.g., by polymerizing ethylene in the presence of a Ziegler catalyst, followed by oxidation to form an alkoxide between the catalyst metal and polyethylene and hydrolysis of the alkoxide to obtain a long-chain alkyl alcohol of the formula (A). By reacting the long-chain alkyl alcohol further with an epoxy group-containing compound, a long-chain alkoxy alcohol of the formula (B) may be obtained. The thus-obtained long-chain alkyl alcohols both have few branches and a sharp molecular weight distribution, which are suitable for the present invention.

The long-chain carboxylic compounds of the formula (C) may be obtained by oxidizing the long-chain alcohols of the formula (A).

For the compounds of the formulae (A), (B) and (C), the average value x is preferably in the range of 35–150. If the value x is below 35, the resultant toner is liable to cause melt-sticking onto a latent image-bearing member and have an inferior storage stability. If x is above 150, the interaction between the polar group of the long-chain alkyl compound of the formula (A), (B) or (C) and the ethyl acetate-insoluble content (G) in the binder resin is reduced, so that the negative sleeve ghost improvement effect is reduced. The average value y is preferably at most 5. If y is above 5, the compound is caused to have a low melting point, thus being liable to cause toner melt-sticking onto the photosensitive member. For similar reasons, R is preferably H or a hydrocarbon of $C_1$–$C_{10}$.

The long-chain alkyl compound used in the present invention may preferably have a number-average molecular weight (Mn) of 150–2500, a weight-average molecular weight (Mw) of 250–5000, and an Mw/Mn ratio of 3 or below.

If Mn is below 150 or Mw is below 250, the melt-sticking on the photosensitive member is liable to occur and the storage stability of the toner is lowered. If Mn is above 2500 or Mw is above 5000, the interaction between the polar group of the long-chain alkyl compound of the formula (A), (B) or (C) and the ethyl acetate-insoluble content (G) in the binder resin is reduced, so that the negative sleeve ghost improvement effect is reduced.

The long-chain alkyl compounds (A) and (B) may preferably have an OH value of 2–150 mgKOH/g, more preferably 10–120 mgKOH/g. If the OH value is below 2 mgKOH/g, the compound of the formula (A) or (B) has few polar groups and can thus show only little interaction with the ethyl acetate-insoluble compound (G) in the binder resin to show only little negative sleeve ghost improvement effect. If the OH value exceeds 150 mgKOH/g, the deviation of OH group change density becomes excessive and larger than the OH group charge density deviation in the binder resin, so that the resultant images are liable to have a low density and a low image quality from the initial stage or may have a high density at the initial stage but is liable to have a gradually lower density on continuation of the image formation. Further, in the case where the OH value exceeds 150 mgKOH/g, the long chain alkyl alcohol is caused to contain a large proportion of low-molecular weight fraction, so that the resultant toner is liable to cause melt-sticking onto the photosensitive member and have a lower storage stability.

The long-chain alkyl compound (C) may preferably have an acid value of 2–150 mgKOH/g, more preferably 5–120 mgKOH/g. If the acid value is below 2 mgKOH/g, the interaction between the polar group of the long-chain alkyl compound of the formula (C) and the ethyl acetate-insoluble content (G) in the binder resin is reduced, so that the negative sleeve ghost improvement effect is reduced. If the acid value exceeds 150 mgKOH/g, an increased amount of low-molecular weight fraction is contained, so that the resultant toner is liable to cause melt-sticking onto the photosensitive member and have a lower storage stability.

The toner containing the long-chain alkyl compound of the formula (A), (B) or (C) may preferably have a heat-absorption main peak in a temperature region of 70–140° C. on its DSC curve as measured by using a differential scanning calorimeter in view of the low-temperature fixability an the anti-offset property.

It is further preferred that the heat-absorption main peak on the DSC cue appears in a temperature region of 80–135° C. It is further preferred that a heat-absorption sub-peak or shoulder appear in a temperature region of 90–130 ° C. on the DSC curve in view of the low temperature fixability, anti-offset performance and anti-blocking performance.

If the long-chain alkyl compound is used singly, the amount thereof may preferably be 0.1–30 wt. parts, more preferably be 0.5–20 wt. parts, per 100 wt. pats of the binder resin.

In case where the long-chain alkyl compound is used in combination with another wax, the total addition amount thereof may preferably be 0.1–30 wt. parts, more preferably 0.5–20 wt. parts, per 100 wt. parts of the binder resin.

The toner according to the present invention may preferably contain a hydrocarbon wax or a petroleum wax in addition to the binder resin and the long-chain alkyl compound. The presence of such an additional wax improves the pressure roller soiling occurring in the fixing device. As a result of our detailed study regarding the pressure roller soiling, this phenomenon does not simply depend on the amount of offset toner but the stickiness and releasability with the pressure roller make critical factors.

As a result of our further study while noting the stickiness and releasability, it has been found that the pressure roller soiling can be improved by the combined use of such a hydrocarbon wax or a petroleum wax with the specific binder resin and the specific long-chain alkyl compound.

Substantially non-polar hydrocarbon wax or petroleum wax is principally dispersed in the ethyl acetate-insoluble content (G) in the binder resin according to the present invention.

Because of interaction with the long-chain alkyl compound of the formula (A), (B) or (C) having some polarity, such a substantially non-polar wax is dispersed in the ethyl acetate-insoluble content (G) in a dispersion state not achieved heretofore, so that the releasability with respect to the pressure roller is increased to improve the pressure roller soiling.

Specific examples of such a hydrocarbon wax may include: low-molecular weight alkylene polymers obtained by polymerizing alkylenes, such as ethylene and propylene by radical polymerization under a high pressure or in the presence of a Ziegler catalyst under a low pressure; alkylene polymers obtained by thermal de-composition of high-molecular weight alkylene polymers; and synthetic hydrocarbon waxes obtained by subjecting a mixture gas containing carbon monoxide and hydrogen to the Arge process to form a hydrocarbon mixture and distilling the hydrocarbon mixture to recover a residue, or hydrogenating the residue. It is further preferred to use such a wax after fractionation, e.g., by the press sweating method, the solvent method, vacuum distillation or fractionating crystallization.

The petroleum wax may comprise waxes fractionated from petroleum, such as paraffin wax, microcrystalline wax and petrolactam.

The hydrocarbon wax or petroleum wax used in the present invention has substantially no functional group, i.e., at most 0.1 group per molecule, if any.

The hydrocabon wax or petroleum wax used in the present invention may preferably be one providing a heat-absorption main peak in a temperature region of 70–140° C. on a DSC curve when a toner containing the wax is subjected to differential scanning calorimetry, in view of the low-temperature fixability, anti-offset performance and pressure roller soiling of the resultant toner.

It is further preferred that the toner containing such a hydrocarbon wax or petroleum wax shows a heat-absorption main peak in a temperature region of 80–135° C., further preferably a heat-absorption main peak and a heat-absorption sub-peak or shoulder in a temperature region of 90–130° C., respectively on its DSC curve as measured by using a differential scanning calorimeter, in view of the low-temperature fixability, anti-offset performance, pressure roller soiling and anti-blocking performance.

The hydrocarbon wax or petroleum wax may preferably have a ratio (Mw/Mn) of 1.0–3.0 between its weight-average molecular weight (Mw) and number-average molecular weight (Mn) based on a molecular weight distribution obtained by GPC, so as to provide a large pressure roller soiling-prevention effect.

The hydrocarbon wax or petroleum wax may be contained in an amount (Y) of 0.1–30 wt. parts, preferably 0.5–20 wt. parts. Further, the amount (Y) may preferably satisfy the following condition with the amount (X) of the long-chain alkyl compound of the formula (A), (B) or (C): X/Y= 0.02–50. If X/Y is below 0.2 or above 50, the pressure roller soiling-prevention effect is reduced.

The toner according to the present invention can contain a charge control agent for further stabilizing its chargeability. The charge controlling agent may preferably be contained in a proportion of 0.1–10 wt. parts, more preferably 0.2–5 wt. parts, per 100 wt. parts of the binder resin.

Examples of the charge control agent may include: organic metal complexes, chelate compounds and organic metal salts. Specific examples thereof may include: mono-azo metal complexes, and metal complexes and metal salts of aromatic hydroxycarboxylic acids, and aromatic dicarboxylic acids. Further examples may include: aromatic hydroxycarboxylic acids, aromatic mono- and poly-carboxylic acids and thin anhydrides and esters; and bisphenol derivatives.

It is particularly preferred that the toner according to the present invention contains a charge control agent represented by the following formula (1):

(1)

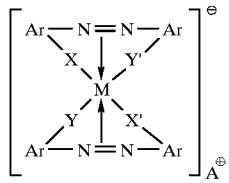

wherein M denotes a coordination center metal selected from the group consisting of Mn, Fe, Ti and Al; Ar denotes an aryl group capable of having a substituent, examples of which may include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $A^+$ denotes hydrogen, sodium, potassium, ammonium or aliphatic ammonium.

Among the charge control agents represented by the general formula (1), it is particularly preferred used an azo iron complex represented by the following formula (2):

(2)

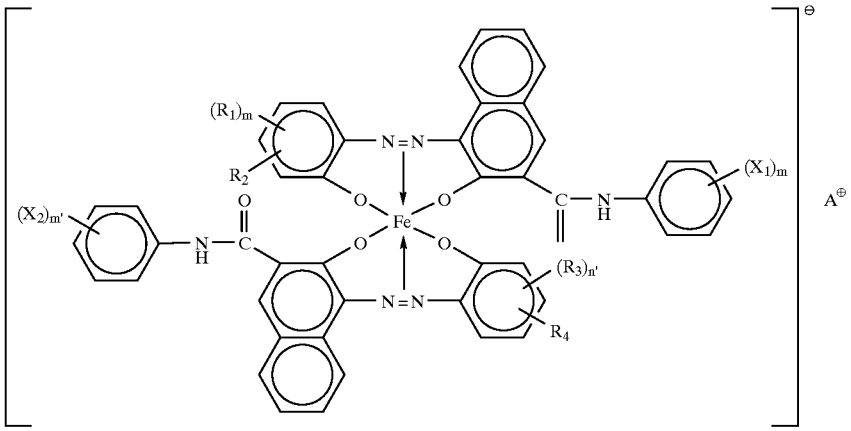

wherein $X_1$ and $X_2$ independently denote hydrogen atom, lower alkyl group, lower alkoxy group, nitro group or halogen atom; m and m' denote an integer of 1–3; $R_1$ and $R_3$ independently denote hydrogen atom, $C_{1-18}$ alkyl or alkenyl, sulfonamide, mesyl, sulfonic acid group, carboxy ester group, hydroxy, $C_{1-18}$ alkoxy, acetylamino, benzoylamino or halogen atom; n and n' denote an integer of 1–3; $R_2$ and $R_4$ denote hydrogen atom or nitro group; and $A^{\oplus}$ denotes hydrogen ion, sodium ion, potassium ion, ammonium ion or a mixture of these ions.

It is preferred to use an azo iron complex having a solubility in methanol of 0.1–8 g/100 ml, more preferably 0.3–4 g/100 ml, further preferably 0.4–2 g/100 ml.

By using such a charge controlling agent, it is possible to better suppress the negative sleeve ghost. This is presumably because such a charge control agent of the formula (1), preferably of the formula (2), can be well dispersed in the binder resin containing the hybrid resin component used in the present invention. As a result, individual toner particles may be provided with a uniform charge, thus providing a better negative sleeve ghost suppression effect.

In combination with the binder resin used in the present invention, it is particularly preferred that the azo iron complex of the formula (2) contains ammonium ions in a proportion of 75–98 mol. % of $A^{\oplus}$ so as to provide stable toner ions. If the ammonium ions are contained in such a proportion, the azo ion complex may exhibit a particularly good dispersibility in both the ethyl acetate-soluble and ethyl acetate-insoluble contents of the binder resin. If the cations in the azo iron complex coonsisting exclusively of ammonium ions, the negative sleeve ghost is liable to be worse. On the other hand, also in case where the cations consist only of protons or alkali metal ions, the negative sleeve ghost is liable to be worse.

According to our study, if ammonium ions are copresent with alkali metal ions and/or protons, the azo iron complex may exhibit better dispersibility in the binder resin used in the present invention. This is particularly noticeable when the ammonium ions occupy 75–98 wt. % of the cations.

The azo iron complex may preferably show a solubility in methanol of 0.1–8 g/100 ml, more preferably 0.3–4 g/100 ml, further preferably 0.4–2 g/100 ml.

If the solubility is below 0.1 g/100 ml, the dispersibility in the toner is liable to be lower. On the other hand, if the solubility exceeds 8 g/100 ml, the toner is liable to have a worse chargeability, thus resulting in worse negative sleeve ghost.

The charge control agent may preferably be used in 0.2–5 wt. parts per 100 wt. parts of the binder resin.

Specific examples of the azo iron complexes preferably used in the present invention may include those of the following formulae (1)–(9), wherein $A^{\oplus}$ denotes $NH_4^+$, $H^+$, $Na^+$, $K^+$ or mixtures of these, particularly a mixture of these principally comprising $NH_4^+$ as mentioned above.

Azo ion complex (1)

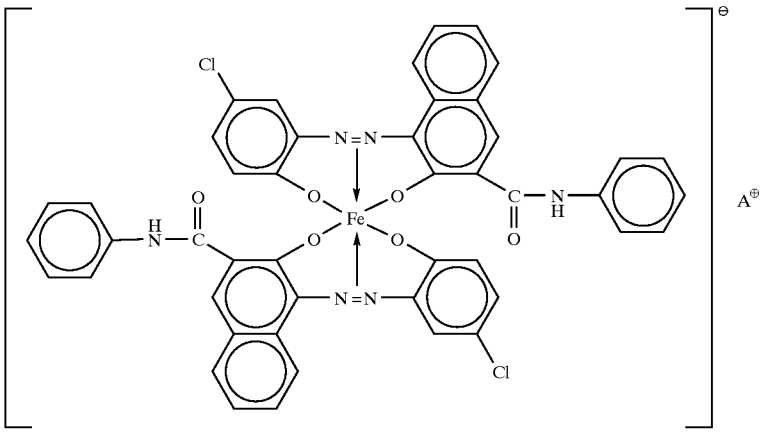

Azo ion complex (2)

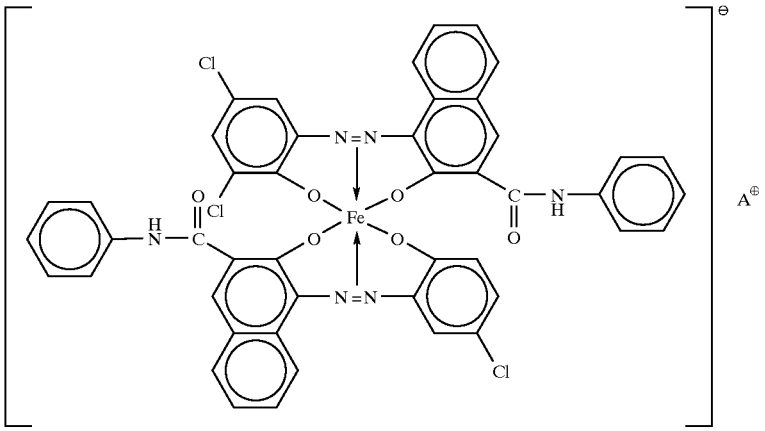

-continued
Azo ion complex (3)
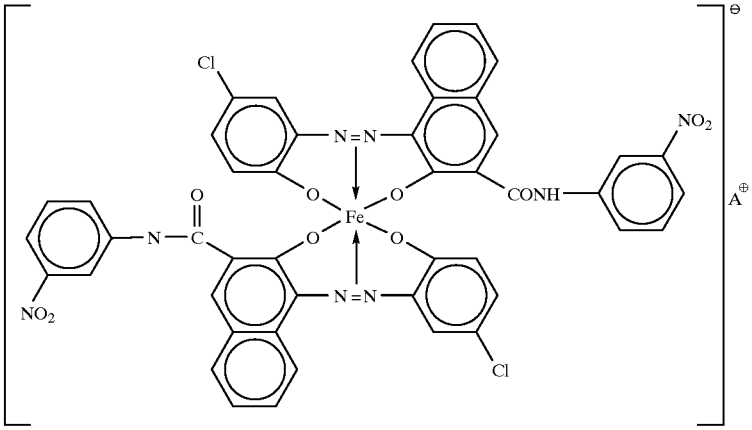
Azo ion complex (4)
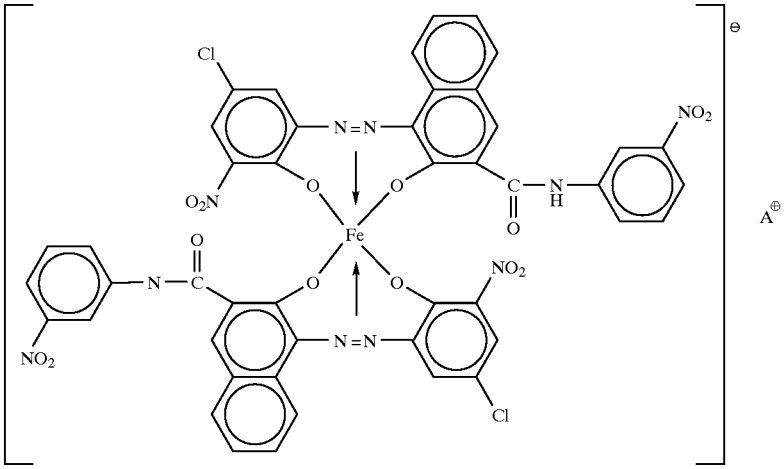
Azo ion complex (5)
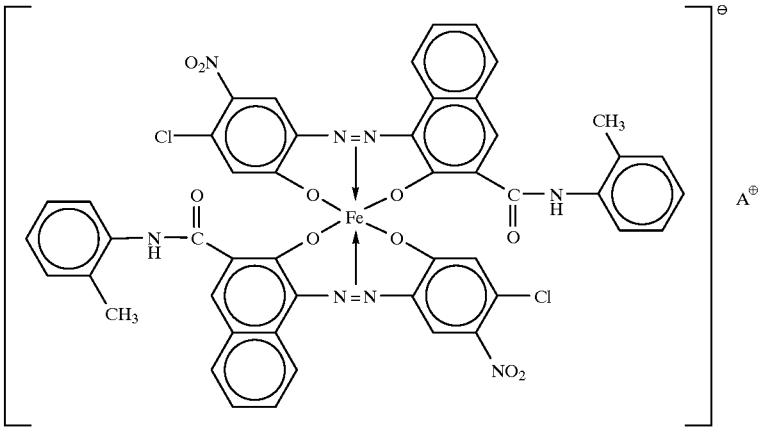

-continued
Azo ion complex (6)
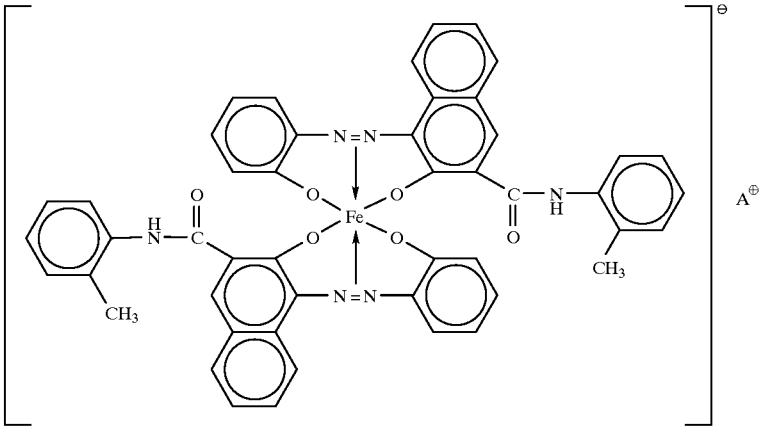
Azo ion complex (7)
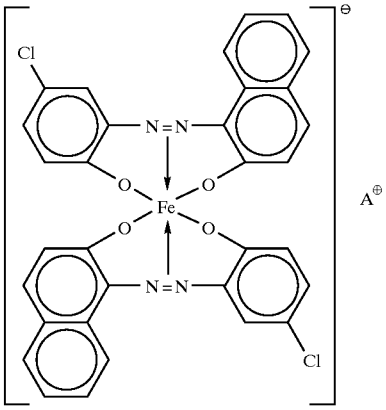
Azo ion complex (8)
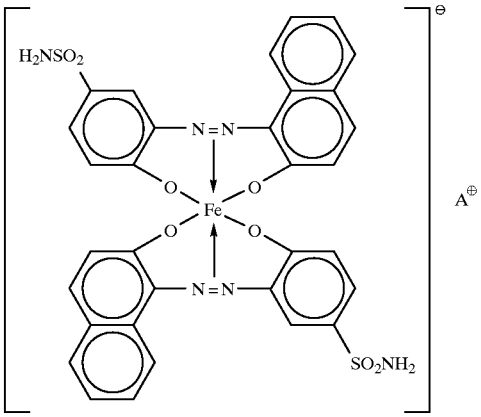

-continued

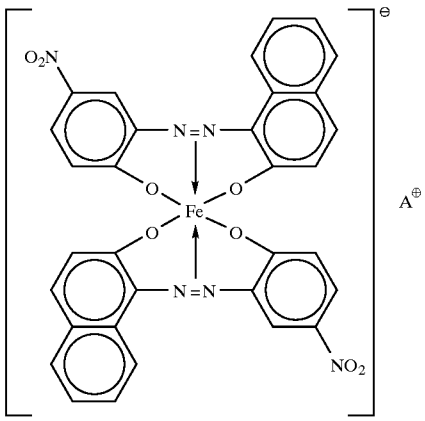

Azo ion complex (9)

When the toner according to the present invention is constituted as a magnetic toner, the magnetic toner may contain a magnetic material, examples of which may include: iron oxides, such as magnetite, hematite, and ferrite; iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), powdery iron (Fe), powdery cobalt (Co), and powdery nickel (Ni). The above magnetic materials may be used singly or in mixture of two or more species. Particularly suitable magnetic material for the present invention is fine powder of triiron tetroxide or $\gamma$-diiron trioxide.

The magnetic material may have an average particle size (Dav.) of 0.1–2 $\mu$m, preferably 0.1–0.5 $\mu$m. The magnetic material may preferably show magnetic properties when measured by application of 10 kilo-Oersted, inclusive of: a coercive force (Hc) of 20–150 Oersted, a saturation magnetization ($\sigma s$) of 50–200 emu/g, particularly 50–100 emu/g, and a residual magnetization ($\sigma r$) of 2–20 emu/g.

The magnetic material may be contained in the toner in a proportion of 10–200 wt. parts, preferably 20–150 wt. parts, per 100 wt. parts of the binder resin.

The magnetic material used in the present invention may preferably comprise a magnetic iron oxide powder having a sphericity ($\phi$) of at least 0.8. If such a magnetic iron oxide powder having a sphericity ($\phi$) of at least 0.8 is present in the toner, the magnetic iron oxide can be exposed to the toner particle surface at an appropriate degree, whereby the toner chargeability may be stabilized to provide a better negative sleeve ghost suppression effect.

The magnetic iron oxide particles used in the present invention may preferably contain silicon (element) in a proportion of 0.2–4 wt. % of the iron (element) in such a distribution as to provide a silicon content B contained up to an iron distribution of 20 wt. % with respect to the total silicon content A in the magnetic iron oxide giving a percentage $(B/A)\times100=44–84\%$ and a silicon content C at the surface of the magnetic iron oxide particles giving a percentage $(C/A)\times100=10–55\%$. By using such a silicon-containing magnetic iron oxide satisfying the above conditions, an improved negative ghost suppressing effect can be attained.

Such silicon-containing magnetic iron oxide particles may be produced in the following manner. Into a ferrous salt aqueous solution, a prescribed amount of silicon compound is added, and then an alkali, such as sodium hydroxide, is added in an amount at least equivalent to the iron content to form a ferrous hydroxide-containing aqueous solution. While maintaining the pH of the aqueous at 7 or higher, preferably 8–9, air is blown into the aqueous solution to oxidize the ferrous hydroxide while warming the aqueous solution at a temperature of 70° C. or higher, thereby forming seed crystals providing cores of magnetic iron oxide particles.

Then, into the slurry liquid containing the seed crystals, an aqueous solution containing ferrous sulfate in an amount almost equivalent to the amount of the alkali added previously. While maintaining the pH of the liquid at 6–10 and blowing air into liquid, the reaction of the ferrous hydroxide is proceeded to grow magnetic iron oxide particles with the seed crystals as cores. With the progress of the oxidation, the liquid pH is gradually lowered to an acidic side, it is preferred that the liquid pH is not lowered to below 6. It is preferred to adjust the liquid pH at the final stage of the oxidation, thereby localizing a prescribed amount of silicon at the surface layer and on the surface of the magnetic iron oxide particles.

Examples of the siliceous compound to be added may include silicic acid salts, such as sodium silicate that is commercially available, and silicic acid, such as silicic acid sol formed, e.g., by hydrolysis of such silicic acid salts. Incidentally, it is also possible to add other additives, such as aluminum sulfate and alumina, within an extent of not adversely affecting the present invention.

As ferrous salts, it is possible to use iron sulfide by-produced generally in the titanium production during the sulfuric acid process, iron sulfate by-produced during surface washing of steel sheets, or further, iron chloride.

In the production of magnetic iron oxide through the aqueous solution process, the concentration of the ferrous salt aqueous may be 0.5–2 mol/l in terms of iron concentration in order to prevent the viscosity increase during the reaction and in connection with the solubility of iron sulfate. A lower iron sulfate concentration tends to provide finer product particles. Further, a large air quantity and a lower reaction temperature during the reaction tend to provide finer product particles.

It is preferred to use a toner containing such silicon-containing magnetic iron oxide particles as produced above.

The silicon (element) content C referred to above may be measured in the following manner. For example, ca. 3 liter of deionized water is placed in a 5 liter-beaker and warmed at 50–60° C. on a water bath. Ca. 25 g of magnetic iron oxide particles in the form of a slurry in ca. 400 ml of deionized water is washed with ca. 300 ml of deionized water, and then added together with the deionized water to the 5 liter-beaker.

Then, the content is held at ca. 60° C. and stirred at a constant speed of ca. 200 rpm, and then reagent-grade sodium hydroxide is added to form a ca. 1-normal sodium hydroxide solution, thereby initiating the dissolution of silicon compound, such as siliceous acid, on the surface of the magnetic iron oxide particles. After 30 min. from the start of dissolution, 20 ml of liquid is sampled and filtered through a 0.1 $\mu$m-membrane filter to recover a filtrate, which is subjected to ICP (inductively coupled plasma) emission spectrometry for quantitative analysis of silicon.

The silicon content C corresponds to the silicon concentration (mg/l) per unit weight of magnetic iron oxide in the sodium hydroxide aqueous solution.

The silicon content (based on iron), iron dissolution percentage and silicon contents A and B may be determined in the following manner. For example, ca. 3 liter of deionized water is placed in a 5 liter-beaker and warmed at 45–50° C. on a water bath. Ca. 25 g of magnetic iron oxide particles in the form of a slurry in ca. 400 ml of deionized water is washed with ca. 300 ml of deionized water, and then added together with the deionized water to the 5 liter-beaker.

Then, the content in the beaker is held at ca. 60° C. and stirred at a constant speed of ca. 200 rpm, and then reagent-grade hydrochloric acid is added to initiate the dissolution. In this instance, the magnetic iron oxide concentration is ca. 5 1 g/l, and the hydrochloric acid aqueous solution is ca. 3 normal. At several times from the initiation of dissolution until the complete dissolution identified by clarity, ca. 20 ml each of samples are taken and filtered to recover filtrates, which are subjected to quantitative analysis of iron element and silicon element by ICP emission spectrometry.

From the following equation, an iron dissolution percentage of each sample is calculated:

$$\text{Iron dissolution rate (\%)} = [\text{iron concentration in sample (mg/l)} / \text{iron concentration at complete dissolution (mg/l)}] \times 100$$

Silicon content (%) for each sample is calculated by the following equation:

$$\text{Silicon content (\%)} = [\text{silicon concentration (mg/l)} / \text{iron concentration (mg/l)}] \times 100$$

Total silicon content A in the magnetic iron oxide particles corresponds to a silicon concentration (mg/l) per unit weight of magnetic iron oxide particles after complete dissolution.

The silicon content B in the magnetic iron oxide particles corresponds to a silicon concentration (mg/l) per unit weight of magnetic iron oxide particles up to 20% dissolution of the magnetic iron oxide particles. The state of 20% dissolution of magnetic iron oxide particles is a state where only a surface portion of the magnetic iron oxide particles has been dissolved, and the silicon content B represents the amount of silicon present in the vicinity of the magnetic iron oxide particles.

The silicon contents A, B and C may be measured by (1) a method of driving a magnetic iron oxide sample into two portions, one of which is used for measurement of silicon content (%) and contents A and B, and the other of which is used for measurement of a content C, or (2) a method wherein a magnetic iron oxide is used for measurement of the sample is used for measurement of a content B' (an amount obtained by subtracting the content C from a content B) and a content A' (an amount obtained by subtracting the content C from a content A) to finally calculate the contents A and B.

The spericity ($\phi$) of magnetic iron oxide particles may be measured in the following manner. Magnetic iron oxide particles are photographed through an electron microscope and at least 100 particles are selected at random on photographs to measure a minimum length (axis diameter) and a maximum length (axis diameter) for each particles. From averages of the minimum and maximum lengths for the at least 100 particles, the sphericity is calculated from the following equation:

$$\text{Sphericity}(\phi) = \text{minimum length}(\mu\text{m}) / \text{maximum length}(\mu\text{m}).$$

In addition a magnetic material, the toner according to the present invention may optionally contain a non-magnetic colorant, examples of which may include: carbon black, titanium white, and other pigments and/or dyes. For example, the toner according to the present invention, when used as a color toner, may contain a dye, examples of which may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6. Examples of the pigment may include: Chrome Yellow, Cadmium Yellow, Mineral Fast Yellow, Navel Yellow, Naphthol Yellow S, Hansa Yellow G, Permanent Yellow NCG, Tartrazine Lake, Orange Chrome Yellow, Molybdenum Orange, Permanent Orange GTR, Pyrazolone Orange, Benzidine Orange G, Cadmium Red, Permanent Red 4R, Watching Red Ca salt, eosine lake; Brilliant Carmine 3B; Manganese Violet, Fast Violet B, Methyl Violet Lake, Ultramarine, Cobalt BLue, Alkali Blue Lake, Victoria Blue Lake, Phthalocyanine Blue, Fast Sky Blue, Indanthrene Blue BC, Chrome Green, chromium oxide, Pigment Green B, Malachite Green Lake, and Final Yellow Green G.

Examples of colorants for constituting two-component developers for full color image formation may include the following.

Examples of the magenta pigment may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Violet 1, 2, 10, 13, 15, 23, 29, 35.

The pigments may be used alone but can also be used in combination with a dye so as to increase the clarity for providing a color toner for full color image formation. Examples of the magenta dyes may include: oil-soluble dyes, such as C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; C.I. Disperse Violet 1; and basic dyes, such as C.I. Basic Red 1, 2, 9, 12, 13, 14, 15, 17, 18, 22, 23, 24, 27, 29, 32, 34, 35, 36, 37, 38, 39, 40; C.I. Basic Violet 1, 3, 7, 10, 14, 15, 21, 25, 26, 27, 28.

Other pigments include cyan pigments, such as C.I. Pigment Blue 2, 3, 15, 16, 17; C.I. Vat Blue 6, C.I. Acid Blue 45, and copper phthalocyanine pigments represented by the following formula and having a phthalocyanine skeleton to which 1–5 phthalimidomethyl groups are added:

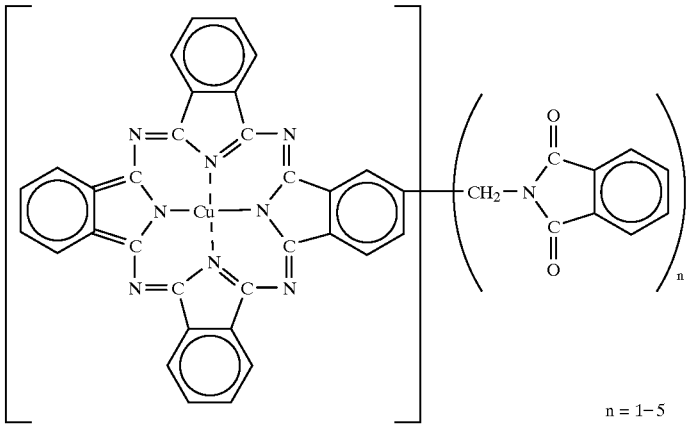

n = 1–5

Examples of yellow pigment may include: C.I. Pigment Yellow 1, 2, 3, 4, 5, 6, 7, 10, 11, 12, 13, 14, 15, 16, 17, 23, 65, 73, 83; C.I. Vat Yellow 1, 13, 20.

Such a non-magnetic colorant may be added in an amount of 0.1–60 wt. parts, preferably 0.5–50 wt. parts, per 100 wt. parts of the binder resin.

A flowability-improving agent may be blended with the toner to improve the flowability of the toner. Examples thereof may include: powder of fluorine-containing resin, such as polyvinylidene fluoride fine powder and polytetrafluoroethylene fine powder; fine powdery silica such as wet-process silica and dry-process silica, and treated silica obtained by surface-treating (hydrophobizing) such fine powdery silica with silane coupling agent, titanium coupling agent, silicone oil, etc.; titanium oxide fine powder, hydrophobized titanium oxide fine powder; aluminum oxide fine powder, and hydrophobized aluminum oxide fine powder.

A preferred class of the flowability-improving agent includes dry process silica or fumed silica obtained by vapor-phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

It is preferred to use fine silica powder having an average primary particle size of 0.001–2 μm, particularly 0.002–0.2 μm.

Commercially available fine silica powder formed by vapor phase oxidation of a silicon halide to be used in the present invention include those sold under the trade names as shown below.

| | |
|---|---|
| AEROSIL (Nippon Aerosil Co.) | 130 |
| | 200 |
| | 300 |
| | 380 |
| | OX 50 |
| | TT 600 |
| | MOX 80 |
| | COK 84 |
| Cab-O-Sil (Cabot Co.) | M-5 |
| | MS-7 |
| | MS-75 |
| | HS-5 |
| | EH-5 |
| Wacker HDK (WACKER-CHEMIE GMBH) | N 20 |
| | V 15 |
| | N 20E |
| | T 30 |
| | T 40 |
| D-C Fine Silica (Dow Corning Co.) | |
| Fransol (Fransil Co.) | |

It is further preferred to use treated silica fine powder obtained by subjecting the silica fine powder formed by vapor-phase oxidation of a silicon halide to a hydrophobicity-imparting treatment. It is particularly preferred to use treated silica fine powder having a hydrophobicity of 30–80 as measured by the methanol titration test.

Silica fine powder may be imparted with a hydrophobicity by chemically treating the powder with an organosilicone compound, such as a coupling agent, and/or silicone oil reactive with or physically adsorbed by the silica fine powder.

Example of such a silane coupling agent may include: hexamethyldisilazane, trimethylsilane, trimethylchlorosilane, trimethylethoxysilane, dimethyldichlorosi lane, methyltrichlorosilane, allyldimethylchlorosilane, allylphenyldichlorosilane, benzyldimethylchlorosi lane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units.

It is also possible to use one or more species of nitrogen-containing silane coupling agents, examples of which may include: aminopropyltrimethoxysilane, aminopropyltriethoxysilane, dimethylaminopropyltrimethoxysilane, dithylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopyldimethoxysilane, dibytylaminopropylmonomethoxysilane, dimethylaminophenyltriethoxysilane, trimethoxysilyl-γ-propylphenylamino, and trimethoxysilyl-γ-propylbenzylamine.

As a particularly preferred example of silane coupling agent, hexamethyldisilazane (HMDS) may be enumerated.

Silicone oil preferably used in the present invention may have a viscosity at 25° C. of 0.5–10000 cSt (centi-Stokes), preferably 1–1000 cSt, further preferably 10–200 cSt. Particularly, preferred examples thereof may include: dimethylsilicone oil, methylphenylsilicone oil, α-methylstyrene-modified silicone oil, chlorophenylsilicone oil, and fluorine-containing silicone oil. Treatment with such a silicone oil may be performed by, e.g., direct blending with silicone oil of silica fine powder already treated with a silane coupling agent in a blender, such as a Henschel mixer; spraying silicone oil onto base silica fine powder; or blending of silica fine powder with silicone oil dissolved or dispersed in an appropriate solvent, followed by removal of the solvent.

Such silicone oil-treated silica may preferably be further subjected to heating at a temperature of at least 200° C., more preferably at least 250° C., in an inert gas atmosphere to stabilize the surface coating.

In the present invention, it is particularly preferred to use a treated silica obtained by treating silica first with a coupling agent and then with silicone oil, or treating silica simultaneously with a silane coupling agent and silicone oil.

The flowability-improving agent may preferably have a specific surface area as measured by nitrogen adsorption according to the BEt method of at least 30 $m^2/g$, more preferably at least 50 $m^2/g$, so as to provide a good result. The flowability-improving agent may be added in 0.01–8 wt. parts, preferably 0.1–4 wt. parts, per 100 wt. parts of the toner.

The toner according to the present invention may be prepared by blending the binder resin, colorant and/or magnetic material, charge control agent and other additives by a blender, such as a Henschel mixer or a ball mill; melt-kneading the blend by a hot kneading means, such as a kneader or an extruder so as to cause mutual dissolution of the resin, etc., followed by cooling for solidification of the melt-kneaded product, pulverization of the solidified product, and classification of the pulverized product.

The toner according to the present invention may preferably have a weight-average particle size of 3–9 μm, more preferably 3–8 μm in view of the resolution and image density and can be well fixed under heating and pressure at such a small particle size.

It is further preferred that the toner according to the present invention has a volume-average particle size (Dv) of 2.5–6 μm since Dv of 2.5 μm or larger provides a sufficient image density with little liability of image density lowering and Dv of 6.0 μm or smaller provides a halftone image with an improved gradation reproducibility.

The toner and the flowability-improving agent may be sufficiently blended by means of a blender, such as a Henschel mixer to obtain a toner, wherein fine particles of the flowability-improving agent are carried on the toner particles.

Various solvent-insoluble contents and other properties of a toner described herein are based on values measured according to the following methods.

(1) THF (Tetrahydrofuran)-, Ethyl Acetate- and Chloroform-Insoluble Contents of a Toner Ca. 2 g of a sample toner is accurately weighed at TW1 (g), placed in a cylindrical filter paper (e.g., "No. 86R", available from Toyo Roshi K.K.) and set on a Soxhlet's extractor, followed by extraction with 200 ml of solvent THF on an oil bath adjusted at ca. 120° C. for 10 hours of refluxing. A THF-soluble content (W1) is determined by condensing and drying the THF-extract to solid, followed by 24 hours of vacuum drying at 60° C. A THF-insoluble content (W2) is determined based on a THF-insoluble matter weight (TW2) other than the binder resin, i.e., the colorant (or/and the magnetic material), etc., according to the following equation:

$$\text{THF-insoluble content}(W2)=[((TW1-(TW2+W1))/(TW1-TW2)]\times 100.$$

By replacing the solvent with ethyl acetate or chloroform, the soluble content and insoluble content for the respective solvents can be determined.

Figure 18:
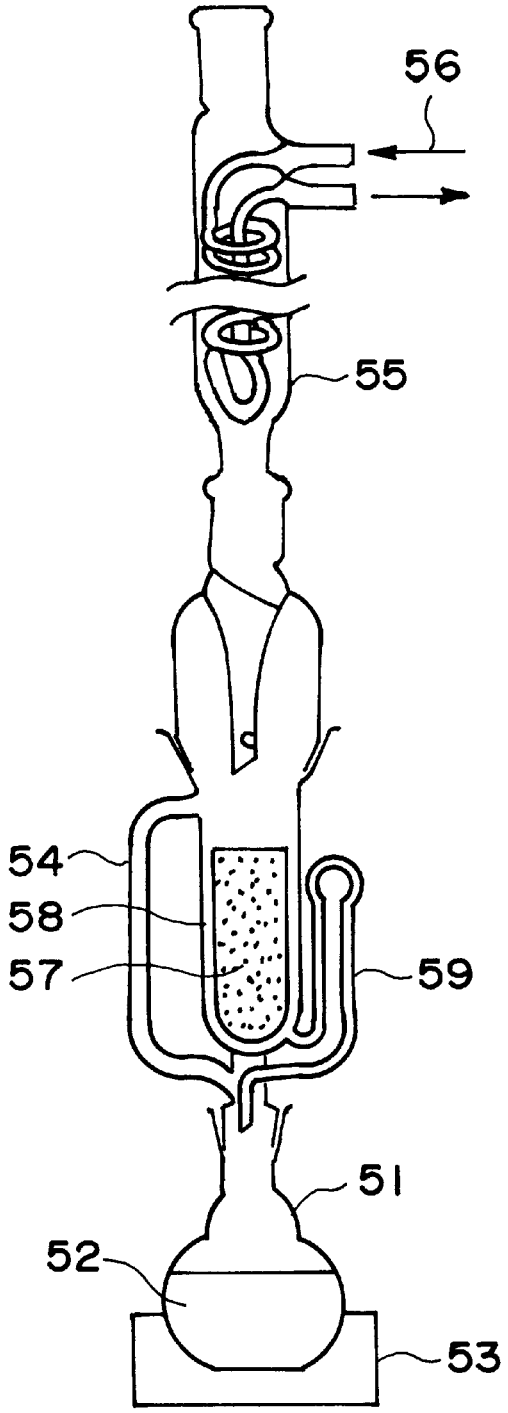
FIG. 18 illustrates an example of Soxhlet's extractor.

An example of Soxhlet's is illustrated in FIG. 18. The extractor is operated in the following manner.

Referring to FIG. 18, in operation, THF 52 contained in a vessel 51 is vaporized under heating by a heater 53, and the vaporized THF is caused to pass through a pipe 54 and guided to a cooler 55 which is always cooled with cooling win the cooler 55 is led in the cooler 55 is liquefied and stored in a reservoir part containing a cylindrical filter paper 57. Then, when the level of THF exceeds that in a middle pipe 59, the THF is discharged from the reservoir part to the vessel 51 through the pipe 59. During the operation, the toner or resin in the cylindrical filter paper 57 is subjected to extraction with the thus circulating THF.

(2) Determination of Polyester Resin in Ethyl Acetate-Insoluble and -Soluble Contents According to $^1$H-NMR and $^{13}$C-NMR (nuclear magnetic resonance)

The respective monomer unit contents in a resinous sample are determined at mol ratios according to $^1$H-NMR and $^{13}$C-NMR and are used for calculation together with the molecular weights of the respective monomers to determine the contents of polyester resin components in weight percent while ignoring the amount of water removed during esterification.

Measurement of $^1$H-NMR Spectrum

Apparatus: FT NMR apparatus "JNM-EX400" available from Nippon Denshi K.K.

Frequency: 400 MHz

Pulse condition: 5.0 μsec

Data points: 32768

Frequency range: 10500 Hz

Integration times: 10000 times

Temperature: 60° C.

Sample: For preparation, a resinous sample in an amount of 50 mg is placed in a 5 mm-dia. sample tube and $CDCl_3$ is added as a solvent for dissolution at 60° C. in a thermostat vessel Measurement of $^{13}$C-NMR Spectrum Apparatus: FT NMR apparatus "JNM-EX400"0 available from Nippon Denshi K.K.

Frequency: 400 MHz

Pulse condition: 5.0 μsec

Data points: 32768

Delay time: 25 sec.

Frequency range: 10500 Hz

Integration times: 16 times

Temperature: 40° C.

Sample: For preparation, a resinous sample in an amount of 200 mg is placed in a 5 mm-dia. sample tube and $CDCl_3$ (containing 0.05% of TMS) is added as a solvent for dissolution at 40° C. in a thermostat vessel A specific example of determination of polyester resin content in ethyl acetate-insoluble content and -soluble content of a sample according to $^{1}$H-NMR and $^{13}$C-NMR will be described below with reference to FIGS. 1–6.

Figure 4:
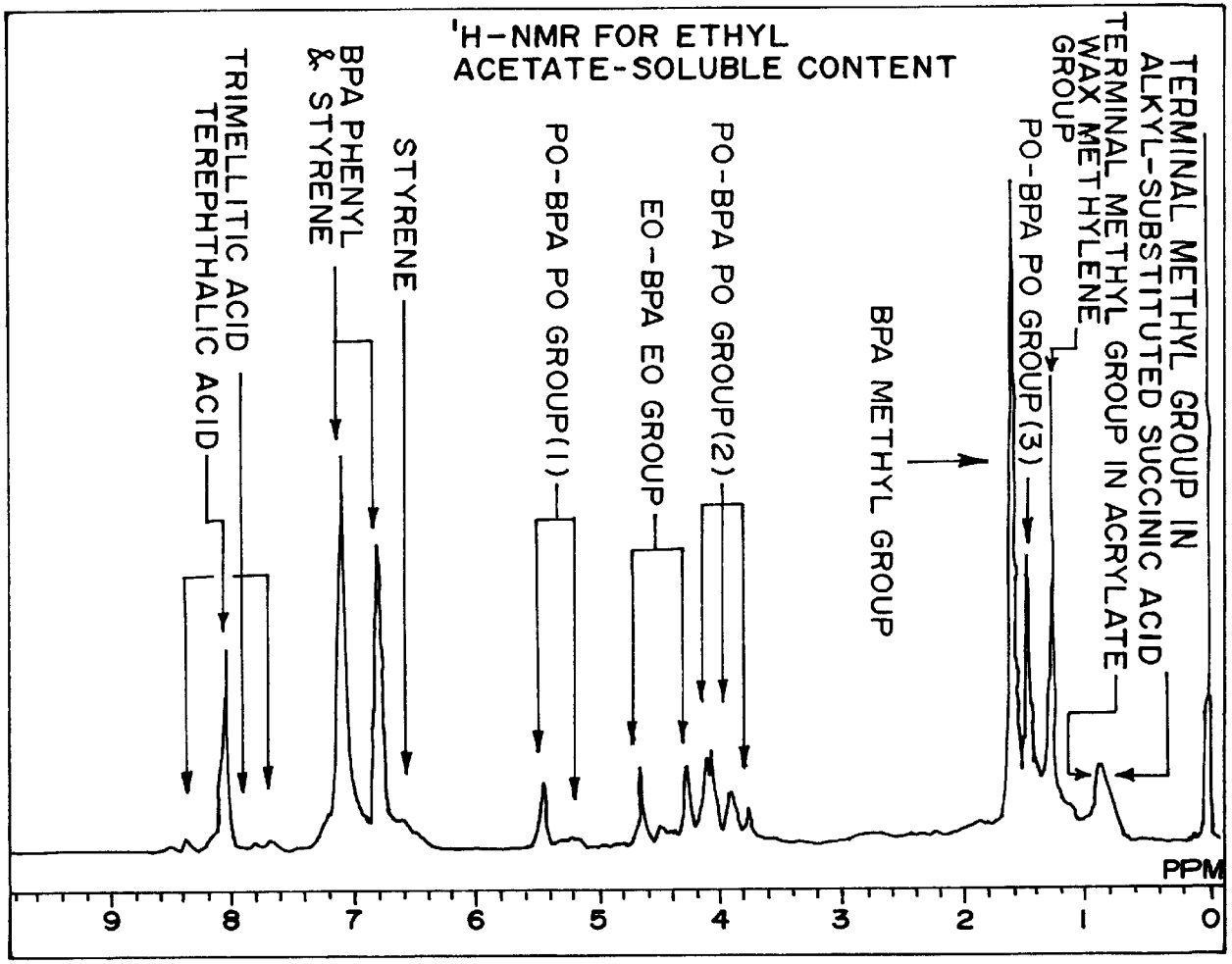
FIGS. 4 and 5 show $^{13}$C-NMR spectra of an ethyl acetate-soluble content and an ethyl acetate-insoluble content, respectively, of Binder resin (1) according to the invention.
Figure 5:
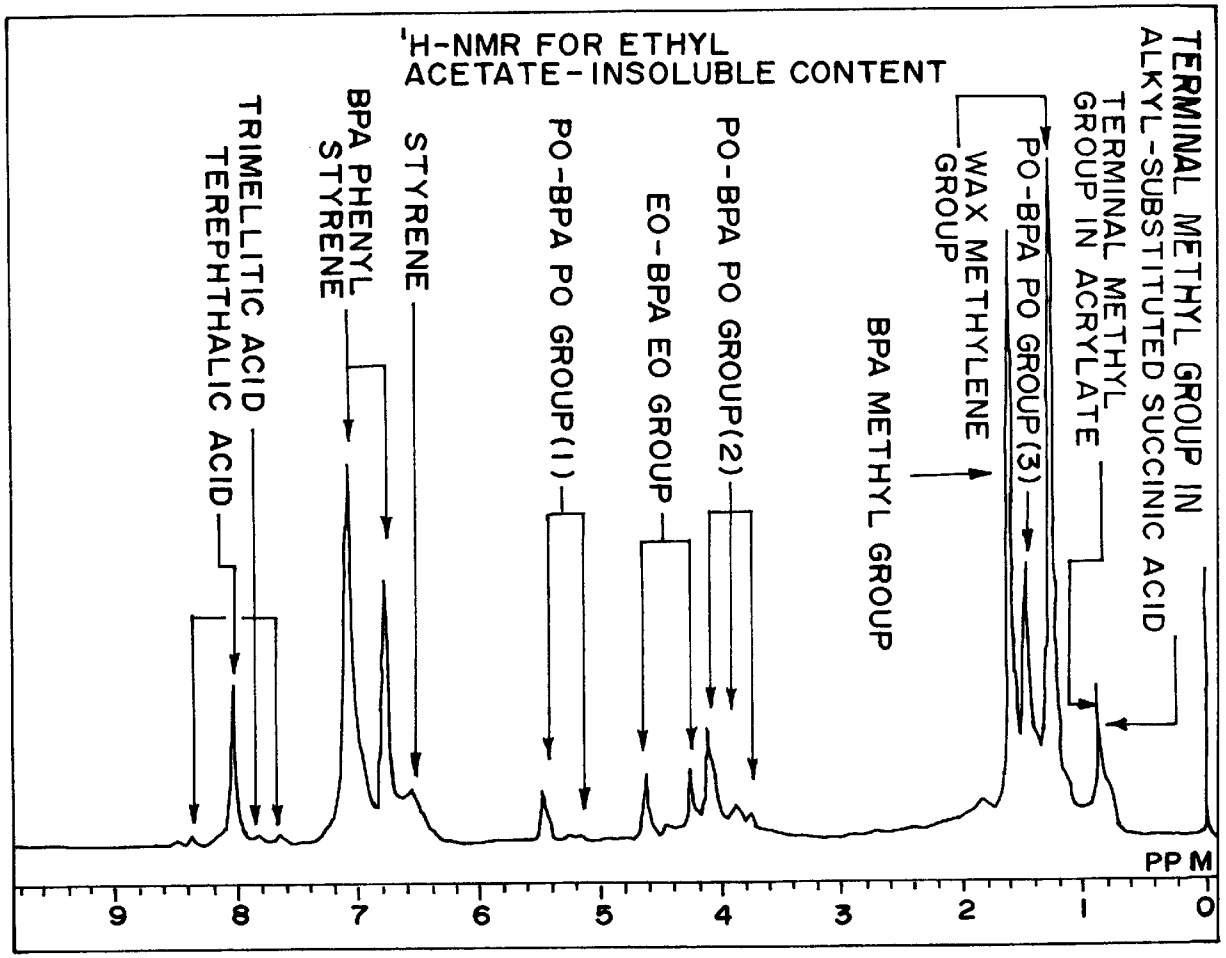

(i) Determination of Alcohol Component Ratio According to $^{1}$H-NMR (FIGS. 4 and 5)

Figure 6:
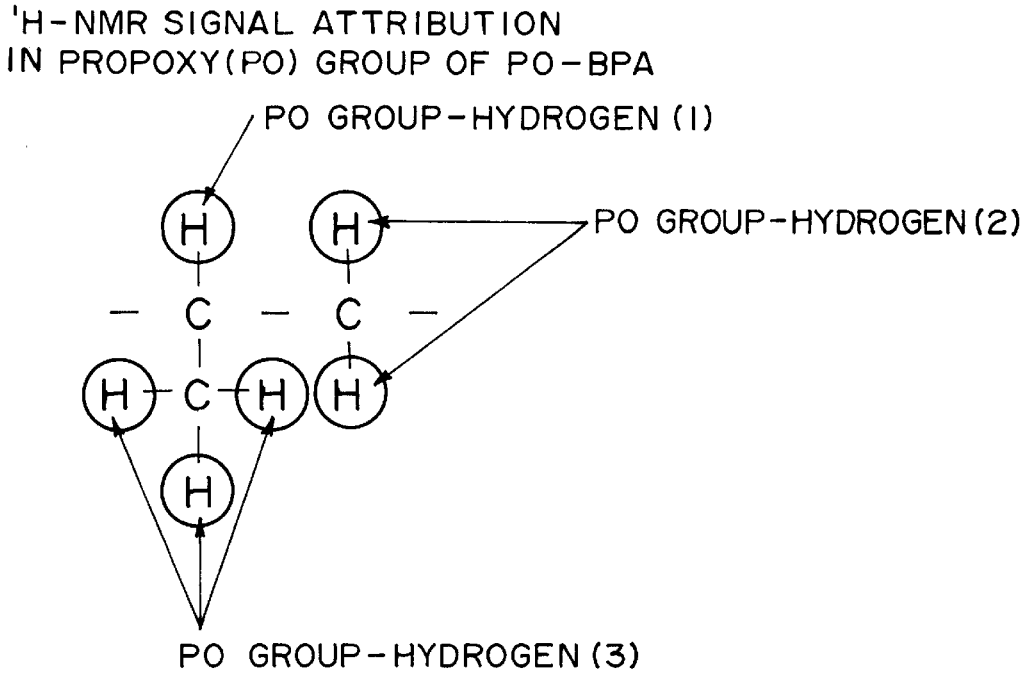
FIG. 6 illustrates assignment of $^{1}$H-NMR signals for a PO group in PO-BPA.

A quantitative ratio between propoxylated bisphenol A (PO-BPA) and ethoxylated bisphenol A is determined based on a ratio of intensity of signals at ca. 5.2 ppm, 5.3 ppm and 5.4 ppm for propoxy group-hydrogen (for each 1H, as illustrated in FIG. 6) and signals at ca. 4.3 ppm and 4.65 ppm for ethoxy group-hydrogen (for each 4H) on a $^{1}$H-NMR spectrum.

(ii) Determination of Aromatic Carboxylic Acid Component Ratio According to $^{1}$H-NMR (see FIGS. 4 and 5)

A quantitative ratio between terephthalic acid and trimellitic acid is determined based on an intensity ratio of a signal at ca. 8 ppm for hydrogen (for 4H) of terephthalic acid and signals at ca. 7.6 ppm, 7.8 ppm and 8.4 ppm for hydrogen (for each 1H) of trimellitic acid.

(iii) Determination of Styrene Content According to $^{1}$H-NMR

A styrene content is determined based on a relative signal intensity for hydrogen (for 1H) at ca. 6.6 ppm on a H-HMR spectrum.

Figure 2:
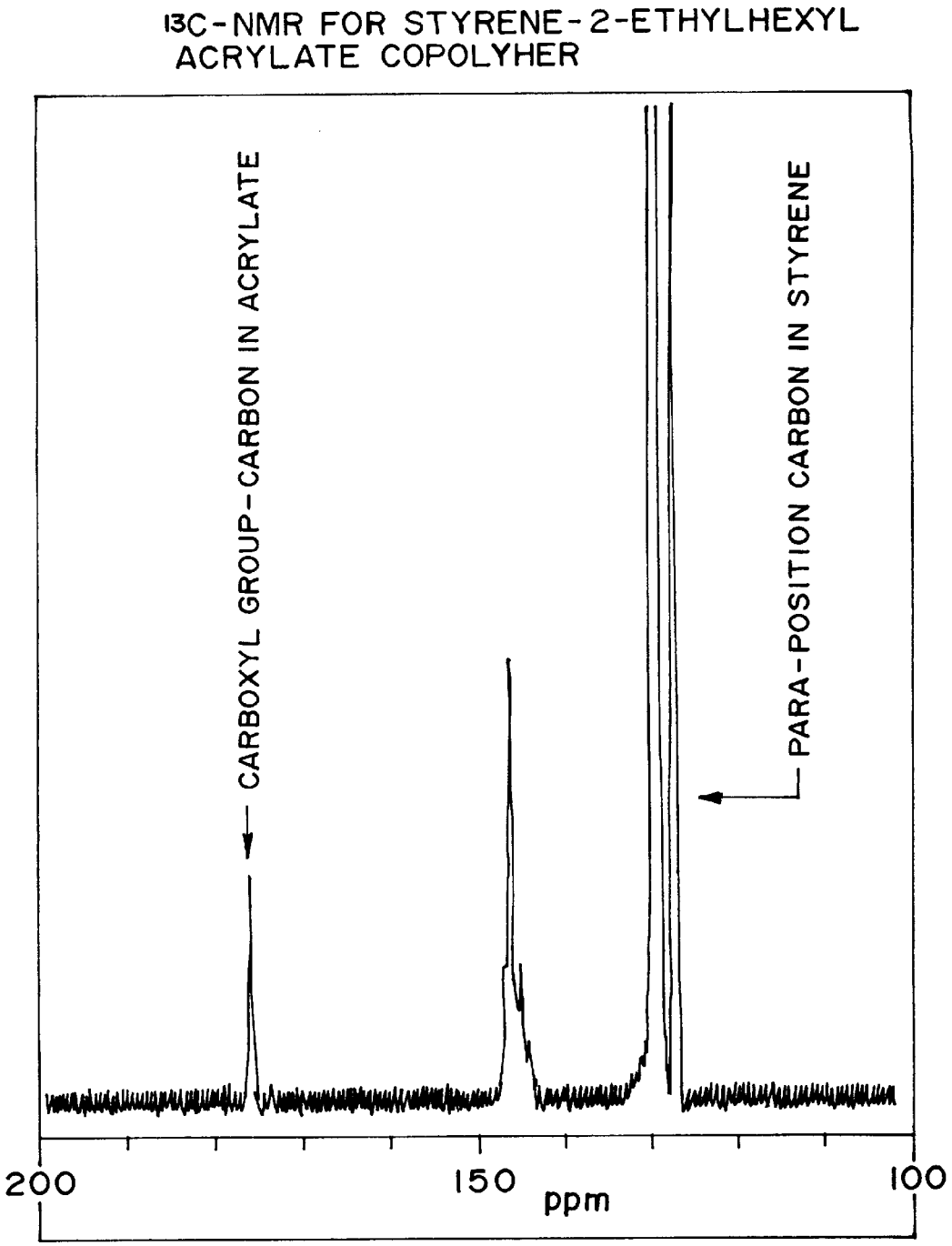
Figure 3:
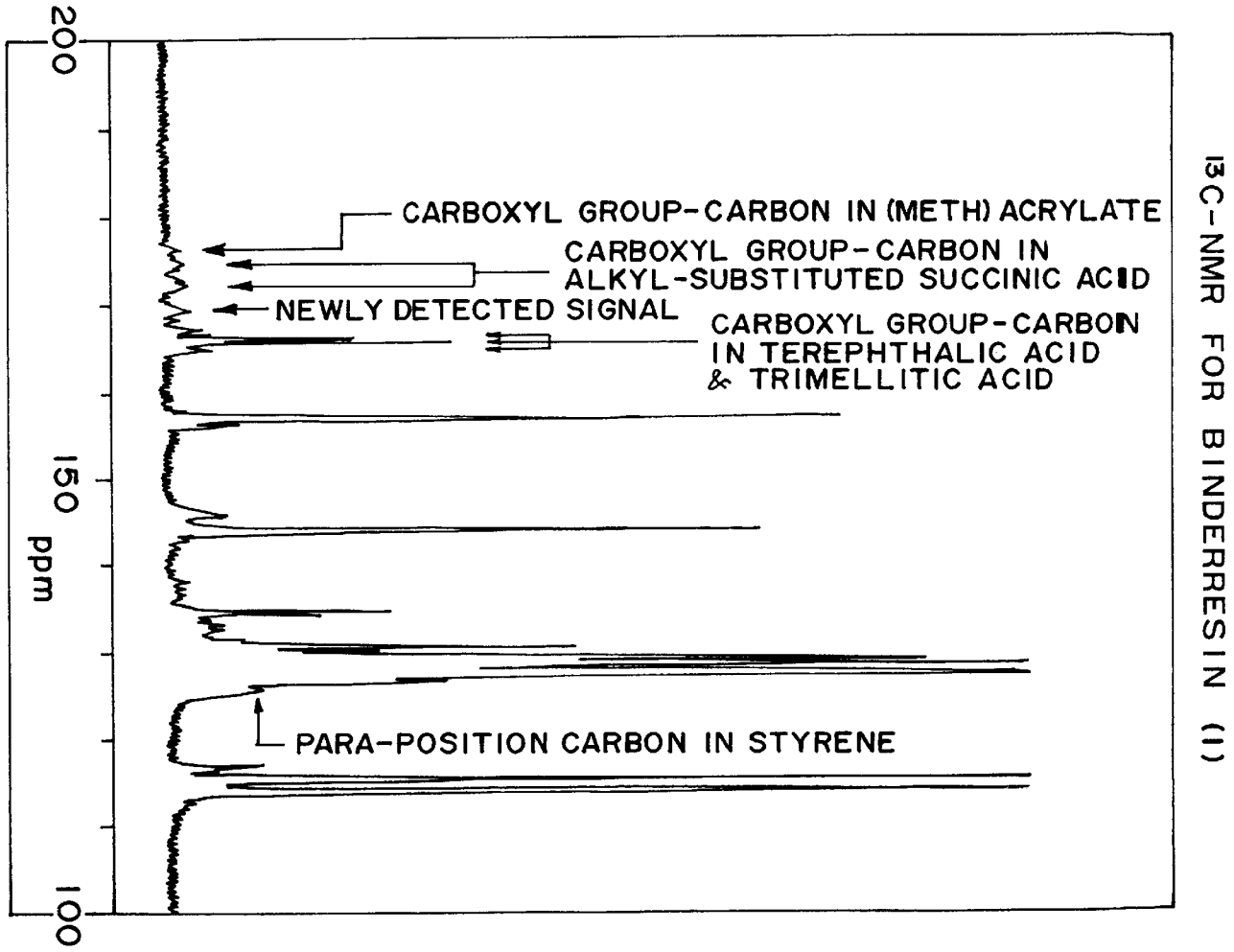
FIG. 3 shows a $^{13}$C-NMR spectrum of Binder resin (1) according to the invention.

(iv) Determination of Aliphatic Carboxylic Acid, (meth) acrylate, and (meth)acrylate of PO-BPA and EO-BPA (Reaction Product Between a Vinyl Polymer and Polyester Resin) (see FIG. 3 in Comparison with FIGS. 1 and 2)

Relative contents of aliphatic carboxylic acid, (meth) acrylate, and a reaction product between a vinyl polymer and a polyester resin are determined based on relative intensities of signals at ca. 173.5 ppm and 174 ppm for carboxyl group-carbon in aliphatic carboxylic acid (for 1c), a signal at ca. 176 ppm for carboxyl group-carbon in (meth)acrylate and a newly found peak signal for carboxyl group-carbon in (meth)acrylate on a $^{13}$C-NMR spectrum.

(v) Determination of Aliphatic Carboxylic Acid and Aromatic Carboxylic Acid (FIG. 3)

Relative contents of aliphatic carboxylic acid and aromatic carboxylic acid are determined based on relative intensities of signals at ca. 165 ppm for carboxyl group-carbon in terephthalic acid (for 1C) and the signals for carboxyl group-carbon in aliphatic carboxylic acid (for 1C) discussed in (i) above on a $^{13}$C-NMR spectrum.

(vi) Determination of Styrene According to $^{13}$C-NMR (FIG. 3)

Relative content of styrene is determined based on a relative intensity of a signal at ca. 125 ppm for para-position carbon (for 1C) on a $^{13}$C-NMR spectrum.

(vii) Determination of Polyester Resin in Ethyl Acetate-Insoluble and -Soluble Contents From the $^{1}$N-NMR spectra (as shown in FIGS. 4 and 5) discussed in (i)–(iii) above, the relative amounts of monomers of PO-BPA, EO-BPA, terephthalic acid, trimellitic acid and styrene are determined in terms of mol ratios. From the $^{13}$C-NMR spectra (e.g., as shown in FIG. 3) discussed in (iv), the relative amounts of (meth)acrylates of PO-BPA and EO-BPA (including a reaction product between a vinyl polymer and a polyester resin), aliphatic carboxylic acid, aromatic carboxylic acid and styrene monomers are determined in terms of mol ratios. From these values, the relative amounts of all the monomers are determined in mol ratios, from which a polyester resin content is calculated in wt. % while disregarding the amount of water removed during esterification.

(3) Melting Point of a Wax

Measurement may be performed in the following manner by using a differential scanning calorimeter ("DSC-7", available from Perkin-Elmer Corp.) according to ASTM D3418-82.

A sample in an amount of 2–10 mg, preferably about 5 mg, is accurately weighed.

The sample is placed on an aluminum pan and subjected to measurement in a temperature range of 30–200° C. at a temperature-raising rate of 10° C./min in a normal temperature—normal humidity environment in parallel with a blank aluminum pan as a reference.

In the course of temperature increase, a main absorption peak appears at a temperature ($T_{MHA}$) in the range of 30–200° C. on a DSC curve. The temperature is taken as a wax melting point.

(4) Toner DSC Curve

A toner's DSC curve is taken in the course of temperature increase similarly as in the above-described wax melting point measurement (5) Glass Transition Temperature (Tg) of a Binder Resin Measurement may be performed in the following manner by using a differential scanning calorimeter ("DSC-7", available from Perkin-Elmer Corp.) according to ASTM D3418-82.

A sample in an amount of 5–20 mg, preferably about 10 mg, is accurately weighed.

The sample is placed on an aluminum pan and subjected to measurement in a temperature range of 30–200° C. at a temperature-raising rate of 10° C./min in a normal temperature—normal humidity environment in parallel with a blank aluminum pan as a reference.

In the course of temperature increase, a main absorption peak appears in the temperature region of 40–100° C.

In this instance, the glass transition temperature (Tg) is determined as a temperature of an intersection between a DSC curve and an intermediate line passing between the base lines obtained before and after the appearance of the absorption peak.

(6) Molecular Weight Distribution of a Wax

The molecular weight (distribution) of a wax may be measured by GPC under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

(7) Molecular Weight Distribution of a Binder Resin as a Starting Material or a Toner Binder Resin The molecular weight (distribution) of a binder resin as a starting material or a THF-soluble content in a toner may be measured based on a chromatogram obtained by GPC (gel permeation chromatography).

In the GPC apparatus, a column is stabilized in a heat chamber at 40° C., tetrahydrofuran (THF) solvent is caused to flow through the column at that temperature at a rate of 1 ml/min., and 50–200 $\mu$l of a GPC sample solution adjusted at a concentration of 0.05–0.6 wt. % is injected. In the case of a starting binder resin, the GPC sample solution may be prepared by passing the binder resin through a roll mill at 130° C. for 15 min. and dissolving the rolled resin in THF and, in the case of a toner sample, the GPC sample solution may be prepared by dissolving the toner in THF and then filtrating the solution through a 0.2 $\mu$m-filter to recover a THF-solution. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K.K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10^3$–$2\times10^6$. A preferred example thereof may be a combination of $\mu$-styragel 500, $10^3$, $10^4$ and $10^5$ available from Waters Co.; or a combination of Shodex KA-801, 802, 803, 804, 805, 806 and 807 available from Showa Denko K.K.

(8) $^{13}$C-NMR Spectrum of a Binder Resin Contained in a Toner

Measurement may be performed by using an FT-NMR (Fourier transform-nuclear magnetic resonance) apparatus ("JNM-EX400", available from Nippon Denshi K.K.) under the following conditions.

Measurement frequency: 100.40 MHz

Pulse condition: 5.0 $\mu$sec (45 deg.) according to the DEPT method

Data point: 32768

Delay time: 25 sec.

Frequency range: 10500 Hz

Integration times: 50000 times

Temperature: 26° C.

Sample: Prepared by adding 10 g of a toner to 100 ml of conc. (ca. 12H) hydrochloric acid and stirring the mixture for ca. 70 hours at room temperature to dissolve a magnetic material contained therein, followed by repetition of filtration and washing with water until the filtrate becomes weakly acidic (ca. pH 5), and vacuum drying of the residual resin at 60° C. for ca. 20 hours. Ca. 1 g of the sample resin is placed in a 10 mm-dia. sample table and dissolved by adding 3 ml of deuterium chloroform ($CDCl_3$) and standing at 55° C. in a thermostat vessel.

(9) Acid Value

Measured according to JIS K0070-1992.

Apparatus: Automatic potentiometer titration apparatus, "AT-400" (available from Kyoto Denshi K.K.)

Apparatus calibration: Performed by using a mixture solvent of toluene 120 ml and ethanol 30 ml Temperature: 25° C.

Sample: Prepared by adding 0.5 g of a toner (or 0.3 g of ethyl acetate-soluble content) in 120 ml of toluene, followed by stirring at room temperature (ca. 25° C.) for ca. 10 hours for dissolution, and addition of 30 ml of ethanol.

(10) OH Value (Hydroxyl Value)

Ca. 0.5 g of a sample is accurately weighed into a 100 ml-round-bottomed flask, and 5 ml of an acetylating agent is accurately added thereto. Then, the system is heated by dipping into a bath of 100° C.±5° C. After 1–2 hours, the flask is taken out of the bath and allowed to cool by standing, and water is added thereto, followed by shaking to decompose acetic anhydride. In order to complete the decomposition, the flask is again heated for more than 10 min. by dipping into the bath. After cooling, the flask wall is sufficiently washed with an organic solvent. The resultant liquid is titrated with a N/2-potassium hydroxide solution in ethyl alcohol by potentiometric titration using glass electrodes (according to JIS K0070-1966).

(11) Particle Size Distribution

Coulter counter Model TA-II or Coulter Multisizer (available from Coulter Electronics Inc.) may be used as an instrument for measurement. For measurement, a 1%-NaCl aqueous solution as an electrolyte solution is prepared by using a reagent-grade sodium chloride (e.g., "Isotron® II", available from Coulter Scientific Japan Co. may be commercially available). To 100 to 150 ml of the electrolyte solution, 0.1 to 5 ml of a surfactant, preferably an alkylbenzenesulfonic acid salt, is added as a dispersant, and 2 to 20 mg of a sample is added thereto. The resultant dispersion of the sample in the electrolyte liquid is subjected to a dispersion treatment for about 1–3 minutes by means of an ultrasonic disperser, and then subjected to measurement of particle size distribution in the range of 2–40 $\mu$m by using the above-mentioned apparatus with a 100 micron-aperture to obtain a volume-bias distribution and a number-basis distribution. From the results of the volume-basis distribution, the weight-average particle size (D4) and volume-average particle size (Dv) of the toner may be obtained (while using a central value for each channel as the representative value of the channel).

(12) Solubility of a Charge Control Agent

Ca. 2 g of a charge control agent is weighed and placed in a 300 ml-Erlenmeyer flask. Into the flask, 100 ml of methanol is added, and the system is heated to 50° C. under heating, followed by 1 hour of stirring. In case where the charge control agent is completely dissolved, the addition of further 2 g of the charge control agent and the stirring are repeated until some insoluble matter is found.

Thereafter, the system is cooled to room temperature and the insoluble portion of the charge control agent is removed by filtration through a 0.1 $\mu$m—filter to form a sample solution, which is then subjected to measurement of absorbance at a maximum absorption wavelength by means of a spectrophotometer. In this instance, in case where the charge control agent concentration in the filtrate solution is high, the solution may be diluted with methanol according to necessity before the measurement.

On the other hand, a separately prepared standard solution (methanol solution at a concentration of 20 ppm) of the charge control agent is subjected to measurement of absorbance at the maximum absorption wavelength. Based on the difference in absorbances of the standard solution and the sample solution, the concentration of charge concentration is calculated according to the following Lambert-Beer's law:

$$\log_e(I_0/I)=\epsilon_0 cd,$$

wherein I denote an intensity of transmitted light through sample solution; $I_0$, an intensity of transmitted light through methanol; $\epsilon_0$, a light absorption coefficient determined from the standard solution; c, a concentration (g/100 ml-ethanol) of the charge control agent; and d, the thickness of the measured solution in a cell.

Figure 7:
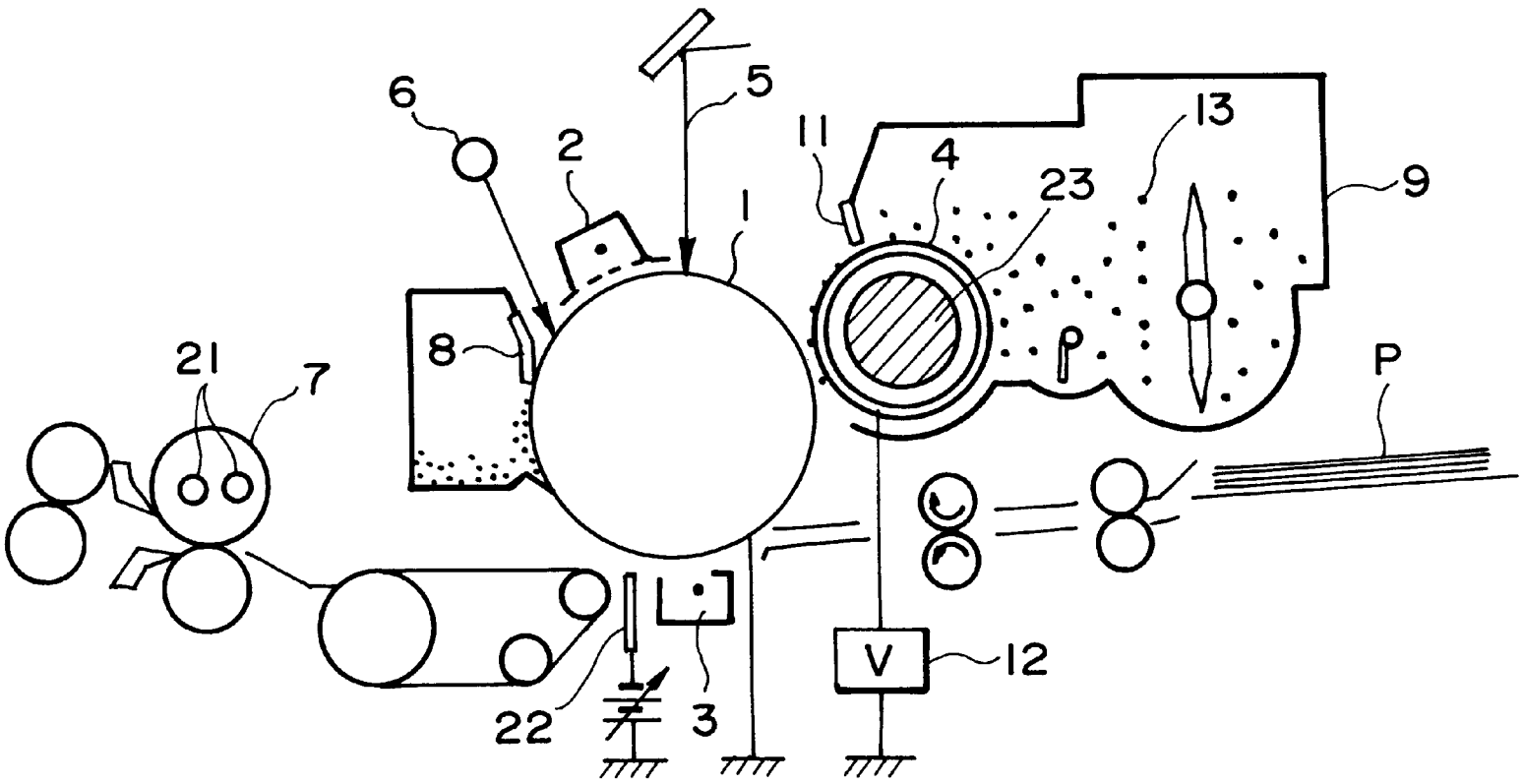
FIG. 7 is a schematic illustration of an image forming apparatus capable of practicing an embodiment of the image forming method according to the invention.

Now, an embodiment of the image forming method using a toner, particularly a magnetic toner, according to the present invention will be described with reference to FIGS. 7 and 8. The surface of an electrostatic image-bearing member (photosensitive member) 1 is charged to a negative potential or a positive potential by a primary charger 2 and exposed to image light 5 as by analog exposure or laser beam scanning to form an electrostatic image (e.g., a digital latent image as by laser beam scanning) on the photosensitive member. Then, the electrostatic image is developed with a magnetic toner 13 carried on a developing sleeve 4 according to a reversal development mode or a normal development mode. The toner 13 is initially supplied to a vessel of a developing device 9 and applied as a layer by a magnetic blade 11 on the developing sleeve 4 containing therein a magnet 23 having magnetic poles $N_1$, $N_2$, $S_1$ and $S_2$. At the development zone, a bias electric field is formed between the electroconductive substrate 16 of the photosensitive member 1 and the developing sleeve 4 by applying an alternating bias, a pulse bias and/or a DC bias voltage from a bias voltage application means to the developing sleeve 4.

The magnetic toner image thus formed on the photosensitive member 1 is transferred via or without via an intermediate transfer member onto a transfer-receiving material (transfer paper) P. When transfer paper P is conveyed to a transfer position, the back side (i.e., a side opposite to the photosensitive member) of the paper P is positively or negatively charged to electrostatically transfer the negatively or positively charged magnetic toner image on the photosensitive member 1 onto the transfer paper P. Then, the transfer paper P carrying the toner image is charge-removed by discharge means 22, separated from the photosensitive member 1 and subjected to heat-pressure fixation of the toner image by a hot pressure roller fixing device 7.

Residual magnetic toner remaining on the photosensitive member 1 after the transfer step is removed by a cleaning means comprising a cleaning blade 8. The photosensitive member 1 after the cleaning is charge-removed by erase exposure means 6 and then again subjected to an image forming cycle starting from the charging step by the primary charger 2.

Figure 8:
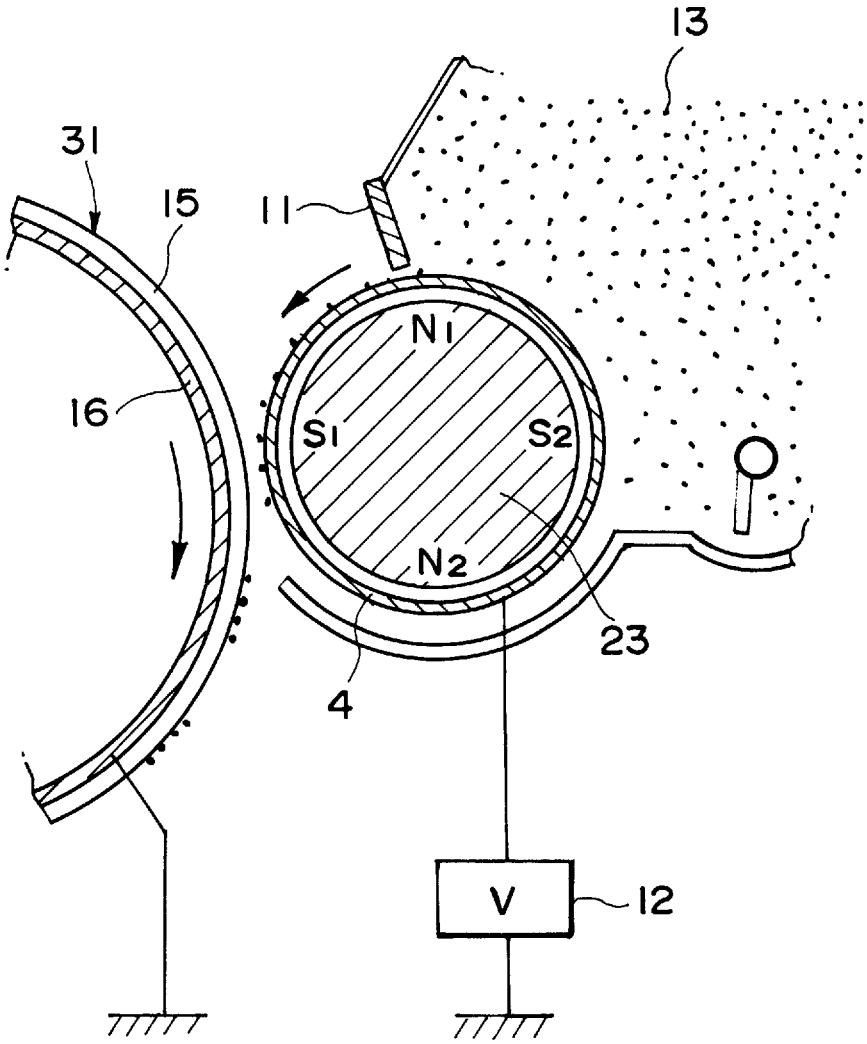
FIG. 8 is a partial enlargement view around a developing section of the apparatus of FIG. 7.

The electrostatic image bearing or photosensitive member in the form of a drum 1 may comprise a photosensitive layer 15 formed on an electroconductive support 16 (FIG. 8). The non-magnetic cylindrical developing sleeve 4 is rotated so as to move in an identical direction as the photosensitive member 1 surface at the developing position. Inside the non-magnetic cylindrical developing sleeve 4, a multi-polar permanent magnet (magnet roll) 23 is disposed so as to be not rotated. The magnetic toner 13 in the developing device 9 is applied onto the developing sleeve 4 and provided with a triboelectric change due to friction between the developing sleeve 4 surface and the magnetic toner particles. Further, by disposing an iron-made magnetic blade 11 in proximity to (e.g., with a gap of 50–500 $\mu$m from) the developing sleeve 4 surface so as to be opposite to one magnetic pole of the multi-polar permanent magnet, the magnetic toner is controlled to be in a uniformly small thickness (e.g., 30–300 $\mu$m) that is identical to or smaller than the clearance between the photosensitive member 1 and the developing sleeve 4 at the developing position. The rotation speed of the developing sleeve 4 is controlled so as to provide a circumferential velocity identical or close to that of the photosensitive member 1 surface. The iron blade 11 as a magnetic doctor blade can be replaced by a permanent magnet so as to provide a counter magnetic pole. At the developing position, an AC bias or a pulse bias voltage may be applied to the developing sleeve 4 from a bias voltage application means. The AC bias voltage may preferably have a frequency 5 of 200–4,000 Hz and a peak-to-peak voltage Vpp of 500–3,000 volts.

Under the action of an electrostatic force on the photosensitive member surface and the AC bias or pulse bias electric field at the developing position, the magnetic toner particles are transferred onto an electrostatic image on the photosensitive member 1.

It is also possible to replace the magnetic blade with an elastic blade comprising an elastic material, such as silicone rubber, so as to apply a pressing force for applying a magnetic toner layer on the developing sleeve while regulating the magnetic toner layer thickness.

Another image forming method to which to toner according to the present invention is applicable will now be described with reference to FIG. 9.

Figure 9:
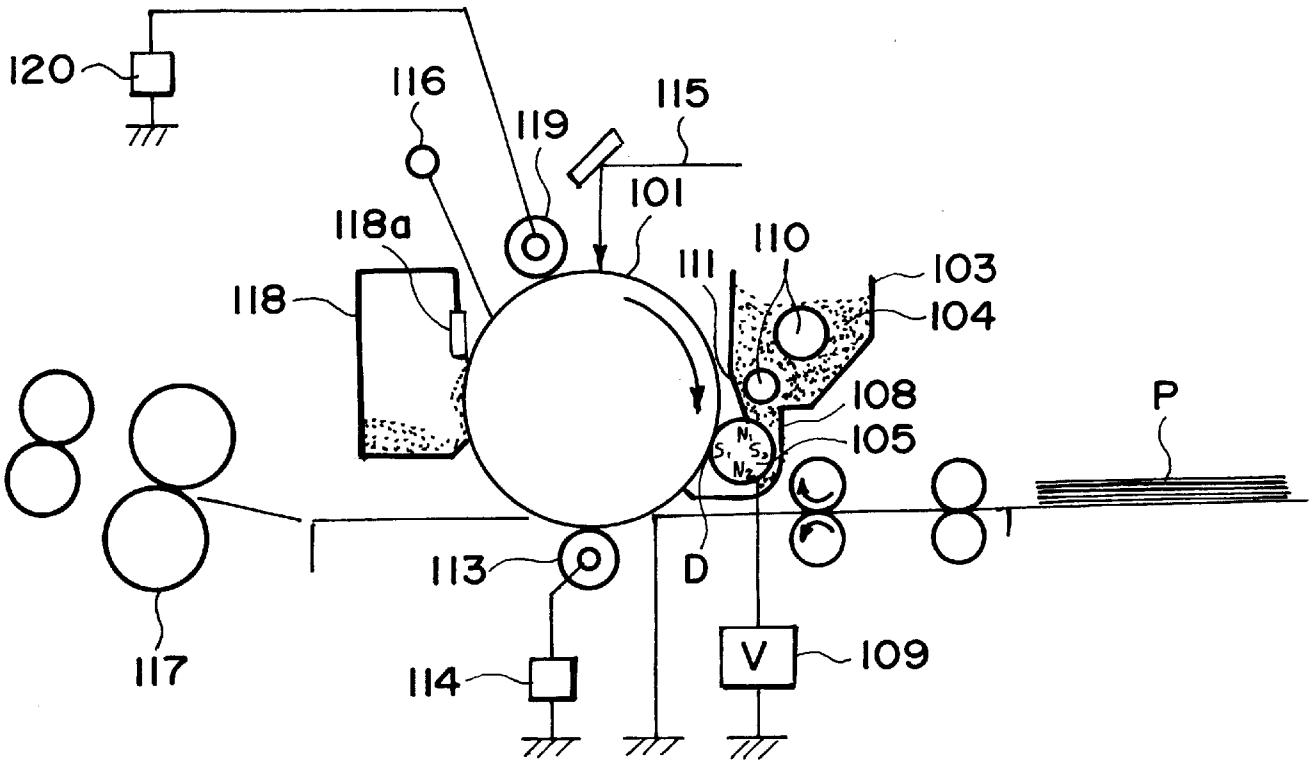
FIGS. 9 and 11 are schematic illustrations of other image forming apparatus each capable of practicing an embodiment of the image forming method according to the invention.

Referring to FIG. 9, the surface of a photosensitive drum 101 as an electrostatic image-bearing member is charged to a negative polarity by a contac (roller) charging means 119 as a primary charging means and exposed to image scanning light 115 from a laser to form a digital electrostatic latent image on the photosensitive drum 101. The digital latent image is developed by a reversal development mode with a magnetic toner 104 held in a hopper 103 of a developing device equipped with a developing sleeve 108 (as a toner-carrying member) enclosing a multi-polar permanent magnet 105 and an elastic regulating blade 111 as a toner layer thickness-regulating member. As shown in FIG. 9, at a developing region D, an electroconductive substrate of the photosensitive drum 101 is grounded, and the developing sleeve 108 is supplied with an alternating bias, a pulse bias and/or a direct current bias from a bias voltage application means 109. When a recording material P is conveyed and arrives at a transfer position, a backside (opposite to the photosensitive drum) of the recording material P is charged by a contact (roller) transfer means 113 as a transfer means connected to a voltage application means 114, whereby the toner image formed on the photosensitive drum 101 is transferred onto the recording material P. The recording material P is then separated from the photosensitive drum 101 and conveyed to a hot pressure roller fixing device 117 as a fixing means, whereby the toner image is fixed onto the recording material P.

A portion of the magnetic toner 104 remaining on the photosensitive drum 101 after the transfer step is removed by a cleaning means 118 having a cleaning blade 118*a*. If the amount of the residual toner is little, the cleaning step can be omitted. The photosensitive drum 101 after the cleaning is charge-removed by erasure exposure means 116, as desired, and further subjected a series of the above-mentioned steps starting with the charging step by the contact (roller) charging means 119 as a primary charging means.

In the above-mentioned series of steps, the photosensitive drum 101 (i.e., an electrostatic image-bearing member) comprises a photosensitive layer and an electroconductive substrate, and rotates in a direction of an indicated arrow. The developing sleeve 108 as a toner-carrying member in the form of a non-magnetic cylinder rotates so as to move in a direction to the surface-moving direction of the photosensitive drum 101 at the developing region D. Inside the developing sleeve 108, a multi-polar permanent magnet (magnet roll) 105 is disposed so as not to rotate. The magnetic toner 104 in the developer vessel 103 is applied onto the developing sleeve 108 and provided with a triboelectric charge of, e.g., negative polarity, due to friction with the developing sleeve 108 surface and/or other magnetic toner particles. Further, the elastic regulation blade 111 is elastically pressed against the developing sleeve 108 so as to regulate the toner layer in a uniformly small thickness (30–300 μm) that is smaller than a gap between the photosensitive drum 101 and the developing sleeve 108 in the developing region D. The rotation speed of the developing sleeve 108 is adjusted so as to provide a surface speed thereof that is substantially equal or close to the surface speed of the photosensitive drum 101. In the developing region D, the developing sleeve 108 may be supplied with a bias voltage comprising an AC bias, a pulse bias on an AC-DC superposed bias from the bias voltage application means 109. The AC bias may have f=200–4000 Hz and Vpp=500–3000 volts. At the developing region, the magnetic toner is transferred onto the electrostatic image side under the action of an electrostatic force on the photosensitive drum 101 surface and the developing bias voltage.

Figure 10:
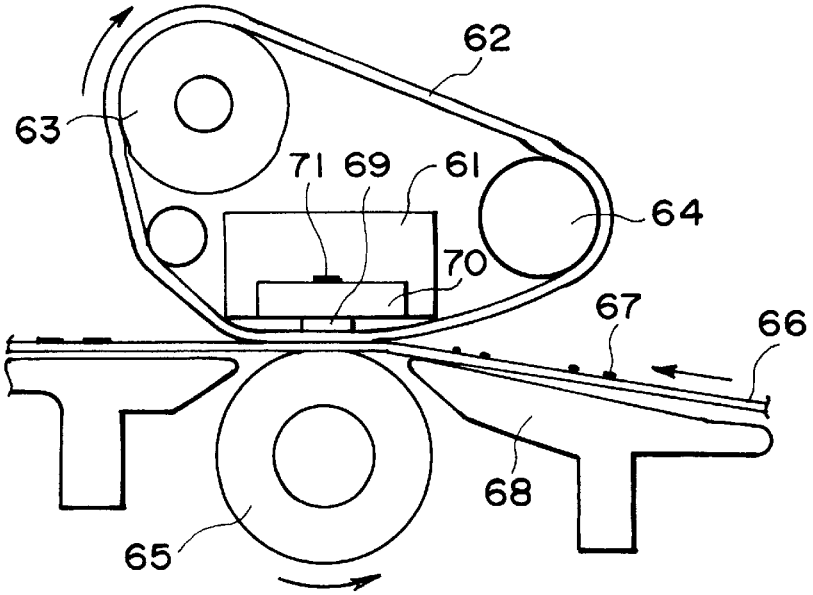
FIG. 10 is a schematic illustration of a film heat-fixing device as another heat-fixing means usable in an embodiment of the image forming method according to the invention.

In the image forming method according to the present invention, the hot roller fixing device used in a fixing step can be replaced a film heat-fixing device as another heat-fixing means. FIG. 10 shows an example of such a film heat-fixing device.

Referring to FIG. 10, the fixing device includes a heating member which has a heat capacity smaller than that of a conventional hot roller and has a linear heating part exhibiting a maximum temperature of preferably 100–300° C.

The film disposed between the heating member and the pressing member may preferably comprise a heat-resistant sheet having a thickness of 1–100 μm. The heat-resistant sheet may comprise a sheet of a heat-resistant polymer, such as polyester, PET (polyethylene terephthalate), PFA (tetrafluoro-ethylene-perfluoroalkyl vinyl ether copolymer), PTFE (polytetrafluoroethylene), polyimide, or polyamide; a sheet of a metal such as aluminum, or a laminate of a metal sheet and a polymer sheet.

The film may preferably have a release layer and/or a low resistivity layer on such a heat-resistant sheet.

An embodiment of the fixing device will be described with reference to FIG. 10.

The device includes a low-heat capacity linear heating member 61, which may for example comprise an aluminum substrate 70 of 1.0 mm-t×10 mm-W×250 mm-L, and a resistance material 69 which has been applied in a width of 1.0 mm on the aluminum substrate and is energized from both longitudinal ends. The energization is performed by applying pulses of DC 100 V and a cycle period of 20 msec while changing the pulse widths so as to control the evolved heat energy and provide a desired temperature depending on the output of a temperature sensor 71. The pulse width may range from ca. 0.5 msec to 5 msec. In contact with the heating member 61 thus controlled with respect to the energy and temperature, a fixing film 62 is moved in the direction of an indicated arrow.

The fixing film 62 may for example comprise an endless film including a 20 μm-thick heat-resistant film (of, e.g., polyimide, polyether imide, PES or PFA, provided with a coating of a fluorine-containing-resin such as PTFE or PAF on its image contact side) and a 10 μm-thick coating release layer containing an electroconductive material therein. The total thickness may generally be less than 100 μm, preferably less than 40 μm. The film is driven in the arrow direction under tension between a drive roller 63 and a mating roller 64.

The fixing device further includes a pressure roller 65 having a releasable elastomer layer of, e.g., silicone rubber and pressed against the heating member 61 via the film at a total pressure of 4–20 kg, while moving together with the film in contact therewith. A transfer material 66 carrying an unfixed toner image 67 is guided along an inlet guide 68 to the fixing station to obtain a fixed image by the heating described above.

The above-described embodiment includes a fixing film in the form of an endless belt but the film can also be an elongated sheet driven between a sheet supply axis and a sheet winding axis.

Some embodiments of developing stepment steps using the toner according to the present invention will be described with reference to FIGS. 11 to 14 showing other embodiments of image forming apparatus.

Development may be performed by using either a magnetic toner or a non-magnetic toner. A development method using a magnetic toner will now be described.

Figure 11:
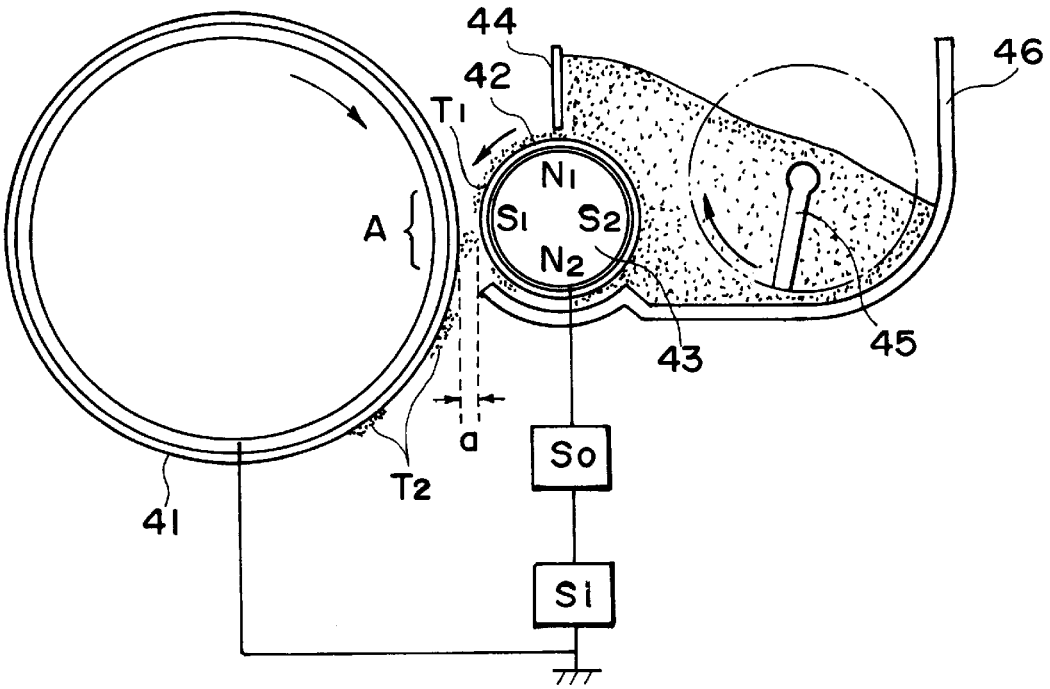

Referring to FIG. 11, almost a right half of a developing sleeve 42 (as a toner carrying member) is always contacted with a toner stock in a toner vessel 46, and the toner in the vicinity of the developing sleeve surface is attached to the sleeve surface under a magnetic force exerted by a magnetic force generating means 43 in the sleeve 42 and/or an electrostatic force. As the developing sleeve 22 is rotated, the magnetic toner layer is formed into a thin magnetic toner layer $T_1$ having an almost uniform thickness while moving through a doctor blade 44 (toner regulating member). The magnetic toner is charged principally by a frictional contact between the sleeve surface and the magnetic toner near the sleeve surface in the toner stock caused by the rotation of the developing sleeve 42. The magnetic toner thin layer on the developing sleeve is rotated to face a latent image-bearing member 41 in a developing region A at the closest gap a between the latent image-bearing member 41 and the developing sleeve. At the time of passing through the developing region A, the magnetic toner in a thin layer is caused to jump and reciprocally move through the gap a between the latent image-bearing member 1 and the developing sleeve 42 surface at the developing region A under an AC-superposed DC electric field applied between the latent image-bearing member 41 and the developing sleeve. Consequently, the magnetic toner on the developing sleeve 42 is selectively transferred and attached to form a toner image $T_2$ on the latent image-bearing member depending on a latent image potential pattern on the member 41.

The developing sleeve surface having passed through the developing region A and selectively consumed the magnetic toner is returned by rotation to the toner stock in the vessel 41 to be replenished with the magnetic toner, followed by repetition of a development cycle including formation of the magnetic thin toner layer $T_1$ on the sleeve 42 and development at the developing region A.

The toner regulating member used in the present invention may exhibit good performances regarding image density and negative sleeve ghost when it is in the form of being abutted against the toner-carrying member surface. This is presumably because this form of toner-carrying member can further improve the chargeability of the toner according to the present invention, which leads to better image density and negative sleeve ghost suppression performances.

The toner regulating member may comprise, e.g., elastomers, such as silicone rubber, urethane rubber and NBR; elastic synthetic resins, such as polyethylene terephthalate; and elastic metals, such as steel and stainless steel. A composite material of these can also be used. It is preferred to use an elastomeric blade.

The material of the toner regulating member may largely affect the chargeability of the toner on the toner-carrying member (sleeve). For this reason, it is possible to add an organic or inorganic substance to the elastic material as by melt-mixing or dispersion. Examples of such additive may include metal oxide, metal powder, ceramics, carbon, whisker, inorganic fiber, dye, pigment and surfactant. In order to control the charge-imparting ability, it is also possible to line the part of an elastic blade of a rubber, synthetic resin or metal abutted to the sleeve with a resin, rubber, metal oxide or metal. If the durability is required of the elastic blade and the sleeve, it is preferred to line the part abutted to the sleeve of a metal elastic blade with a resin or rubber.

In the case of a negatively chargeable toner, it is preferred to use urethane rubber, urethane resin, polyamide or nylon resin. In the case of a positively chargeable toner, it is preferred to use urethane rubber, urethane resin, fluorine-containing resin (such as teflon resin) or polyimide resin. When the portion abutted to the sleeve of the toner regulating member is formed as a molded product of a resin or rubber, it is preferable to incorporate an additive, inclusive of metal oxides, such as silica, alumina, titania tin oxide, zirconium oxide and zinc oxide; carbon black and a charge control agent generally used in a toner.

An upper side of the toner regulating member is fixed to the developer vessel and the lower side is pressed with a bending in resistance to the elasticity of the toner regulating member against the developing sleeve so as to extend in a direction forward or reverse with respect to the rotation direction of the sleeve and exert an appropriate elastic pressure against the sleeve surface with its inner side (or outer side in case of the reverse abutment). The relevant parts of image forming apparatus including a developing apparatus using a toner regulating member in the form of an elastic blade are for example shown in FIGS. 12 and 13.

The abutting pressure between the toner-regulating member (blade) and the toner-carrying member (sleeve) may be at least 0.98 N/m (1 g/cm), preferably 1.27–245 N/m (3–250 g/cm), further preferably 4.9–118 N/m (5–120 g/cm), in terms of a linear pressure along the generatrix of the sleeve. Below 0.98 N/m, the uniform application of the toner becomes difficult, thus resulting in a broad charge distribution of the toner causing fog or scattering. Above 245 N/m, an excessively large pressure can be applied to the developer to cause deterioration and agglomeration of the developer, and a large torque is required for driving the sleeve.

The spacing $\alpha$ between the latent image-bearing member and the developing sleeve may be set to e.g., 50–500 $\mu$m.

The thickness of the toner layer on the sleeve is most suitably smaller than the gap $\alpha$. It is however possible to set the toner layer thickness such that a portion of many ears of magnetic toner can touch the latent image bearing member.

In the present invention, it is preferred to apply a bias electric field including an alternating bias voltage component, providing a peak-to-peak voltage (Vpp) electric field of 2–8 MV/m or higher at the closest position between the toner-carrying member and the image-bearing member. The frequency may be 1.0–5.0 kHz, preferably 1.0–3.0 kHz, further preferably 1.5–3.0 kHz. The alternating bias voltage waveform may be rectangular, sinusoidal, saw teeth-shaped or triangular. A normal-polarity voltage, a reverse-polarity voltage or an asymmetrical AC bias voltage having different durations may also be used. It is also preferable to superpose a DC bias voltage.

The toner-carrying member (sleeve) may be composed of a rigid material, such as a metal or a ceramic, preferably of aluminum or stainless steel (SUS) in view of charge-imparting ability. The sleeve can be used in an as-drawn or as-cut state. However, in order to control the toner conveying ability and triboelectric charge-imparting ability, the sleeve may be ground, roughened in a peripheral or longitudinal direction, blasted or coated. In the present invention, it is preferred to use a sleeve blasted with definite-shaped particles and/or indefinite-shaped particles. These particles may be used singly, in mixture or sequentially for blasting.

It is also preferable to use a toner-carrying member having a coating layer thereon containing electroconductive fine particles. The electroconductive fine particles may preferably comprise carbon particles, crystalline graphite particles, or particles of an electroconductive metal oxide or metal complex oxide, such as electroconductive zinc oxide. Such electroconductive fine particles may be dispersed in a suitable resin, examples of which may include: phenolic resin, epoxy resin, polyamide resin, polyester resin, polycarbonate resin, polyolefin resin, silicone resin, fluorine-containing resin, styrene resin and acrylic resin. A thermosetting resin or a photosetting or photo-curable resin is particularly preferred.

Next, a developing method using the toner according to the present invention in the form of a non-magnetic toner will be described for example.

Figure 14:
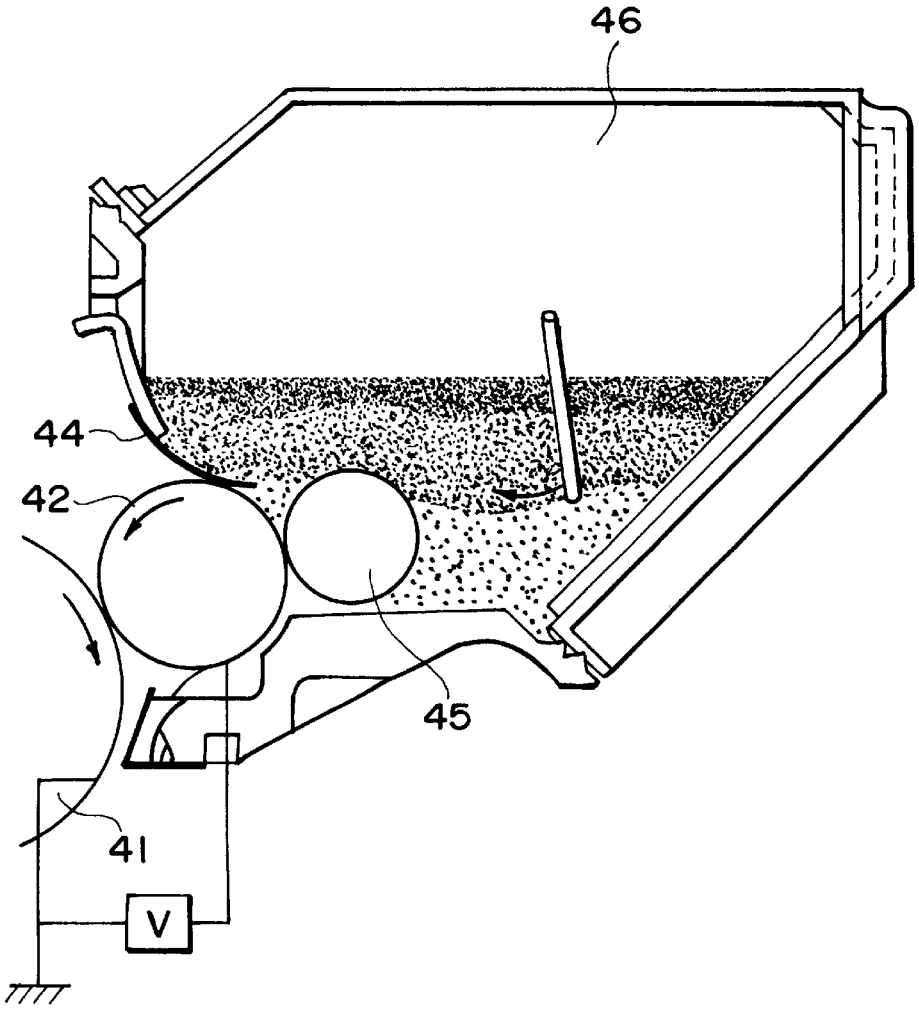
FIG. 14 illustrates an image forming apparatus using a non-magnetic toner for practicing the image forming method according to the invention.

FIG. 14 shows a developing apparatus for developing an electrostatic image formed on a latent image-bearing member 41. The electrostatic image may be formed by an electrophotographic means or electrostatic recording means (not shown). The developing apparatus includes a developing sleeve 42 (toner-carrying member) which is a non-magnetic sleeve composed of aluminum or stainless steel.

The developing sleeve can comprise a crude pipe of aluminum or stainless steel as it is. However, the surface thereof may preferably be uniformly roughened by blasting with glass beads, etc., mirror-finished or coated with a resin. The developing sleeve is similar to the one used in the magnetic monocomponent developing method described with reference to FIGS. 11–13.

A toner is stored in a toner vessel 46 and supplied to the developing sleeve 62 by a supply roller 45. The supply roller 45 comprises a foam material, such as polyurethane foam and is rotated at a non-zero relative speed with the developing sleeve 42 in a direction identical or reverse to that of the developing sleeve. In addition to the toner supply, the supply roller 45 functions to peel off the toner remaining on the developing sleeve 42 without being used after the development. The toner supplied to the developing sleeve 42 is uniformly applied by a toner regulating member (blade) 44 to form a thin layer on the sleeve 42.

Figure 12:
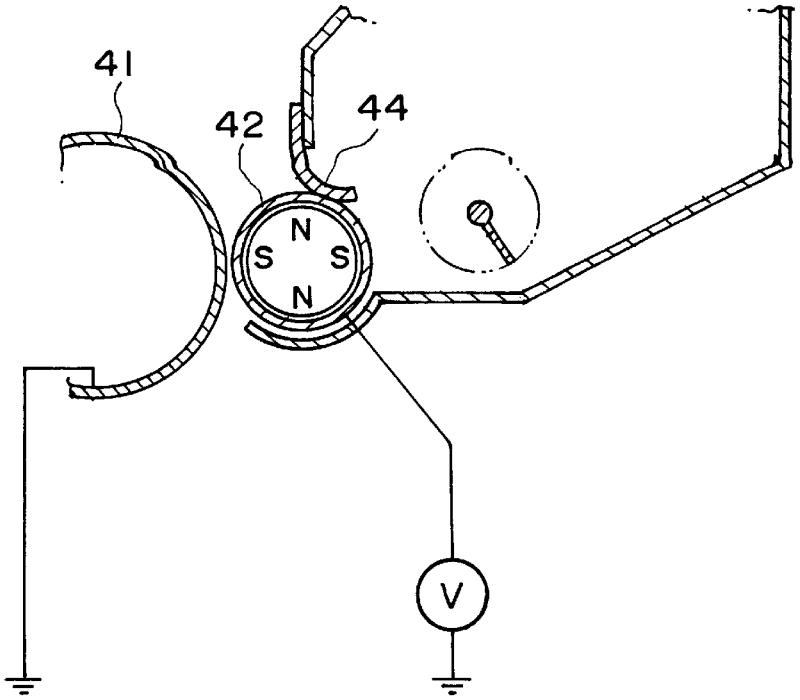
FIGS. 12 and 13 are partial enlargement views of image forming apparatus each usable for practicing the image forming method according to the invention.
Figure 13:
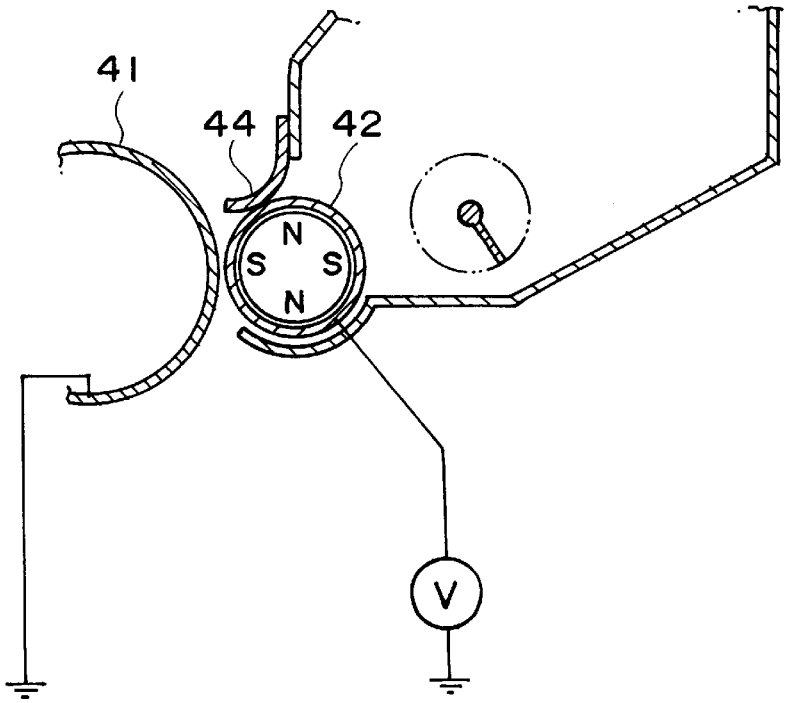

The material and manner of abutting of the toner-regulating member, the material of the toner-carrying member, the gap between the image-bearing member and the toner-carrying member, and the bias voltage applied to the toner carrying member are similar to those adopted in the development methods using a magnetic developer described with reference to FIGS. 11–13.

Another preferred embodiment of the image forming method according to the present invention will now be described with reference to FIG. 15.

Figure 15:
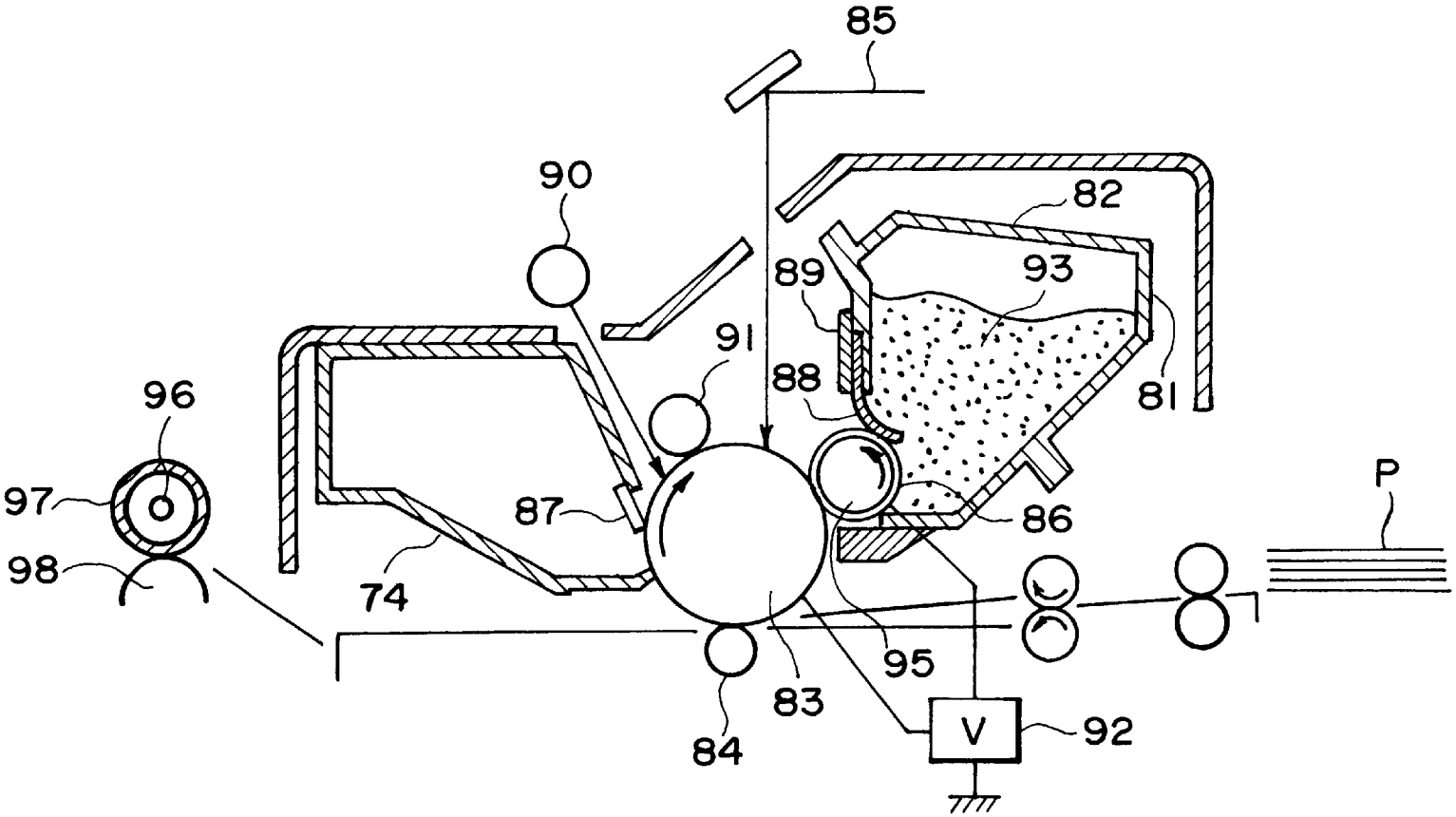
FIG. 15 illustrates a further different image forming apparatus usable for practicing the image forming method according to the invention.

Referring to FIG. 15, the peripheral surface of an OPC photosensitive drum 83 as an electrostatic latent image-bearing member is charged to a negative polarity by a contact charging member 91 in the form of a charging roller as a primary charging means and exposed to image scanning laser light 85 to form a digital electrostatic latent image on the photosensitive drum. The latent image is then developed according to a reversal development mode with a negatively triboelectrically chargeable magnetic toner 93 held within a developing device 81 equipped with a developing sleeve 86 enclosing a magnetic 95 and provided with a urethane rubber-made elastic blade 88 abutted against thereto in a counter direction. Alternatively, it is also possible to use a photosensitive member chargeable to a positive polarity, form an electrostatic latent image thereon and effect a normal-mode development with a negatively triboelectrically chargeable magnetic toner. The developing sleeve 86 is supplied with an alternating bias, a pulse bias and/or a direct current bias from a bias voltage application means 92. When a transfer paper P is conveyed and arrives at a transfer position, the backside (opposite side from the photosensitive member side) of the transfer paper P is charged by a contact transfer member 84 in the form of a transfer roller as a transfer means, whereby the toner image on the photosensitive drum 83 is electrostatically transferred onto transfer paper P. The transfer paper P is then separated from the photosensitive drum 83 and conveyed to a hot-pressure fixing device comprising a heating roller 97 having therein a heating means 96, and a pressure roller 98, where the toner image is fixed onto the transfer paper P.

Residual magnetic toner remaining on the photosensitive drum 83 is removed by a cleaning device 94 having a cleaning blade 89. The photosensitive rum 83 after cleaning is charge-removed by exposure to erase exposure light 90 and then recycled to a series of image forming steps starting with a primary charging step by the charge 91.

The photosensitive drum 83 comprises a photosensitive layer and an electroconductive substrate, and rotates in a direction of an indicated arrow. The non-magnetic cylindrical developing sleeve 86 rotates so as to move in a direction identical to the surface moving direction of the photosensitive drum 83. Inside the developing sleeve, a multi-polar permanent magnet 95 (magnet roll) as a magnetic filed generating means is disposed so as not to rotate. The magnetic toner 93 in the developing device 91 is applied onto the non-magnetic developing sleeve surface and is provided with a negative triboelectric charge through friction with the sleeve 86 surface and friction with other magnetic toner particles. Further, the elastic blade 88 is disposed so as to form a uniform thin toner layer in a thickness of, e.g., 30–300 $\mu$m, which is smaller than the gap between the photosensitive drum 83 and the developing sleeve 86 at the developing region, where the toner layer therefore does not contact the photosensitive drum 86. The rotation speed of the developing sleeve 86 is adjusted so as to provide a surface speed which is substantially equal to or close to that of the photosensitive drum at the developing region The developing sleeve 86 may be supplied with an AC bias or a pulse bias from the bias application means 92. The AC bias may have f=200–4000 Hz and Vpp=500–3000 volts.

At the developing region, the magnetic toner particles are transferred onto the electrostatic latent image side on the photosensitive drum 83 under the action of the electrostatic force exerted by the electrostatic image and the AC or pulse bias electric field.

Among the above-mentioned electrostatic latent image-bearing member, such as a photosensitive drum, developing device, and cleaning device, a plurality of members may be integrated into an apparatus unit so as to form a process cartridge, that may detachably mountable to an apparatus main assembly. For example, the charging means and the developing device may be integrally supported together with the photosensitive drum to form a single unit, i.e., process cartridge, that can be incorporated in or released from the apparatus main assembly as desired by means of a guide means, such as a rail, provided to the apparatus main assembly. In this instance, it is also incorporate the cleaning means in the process cartridge.

Figure 16:
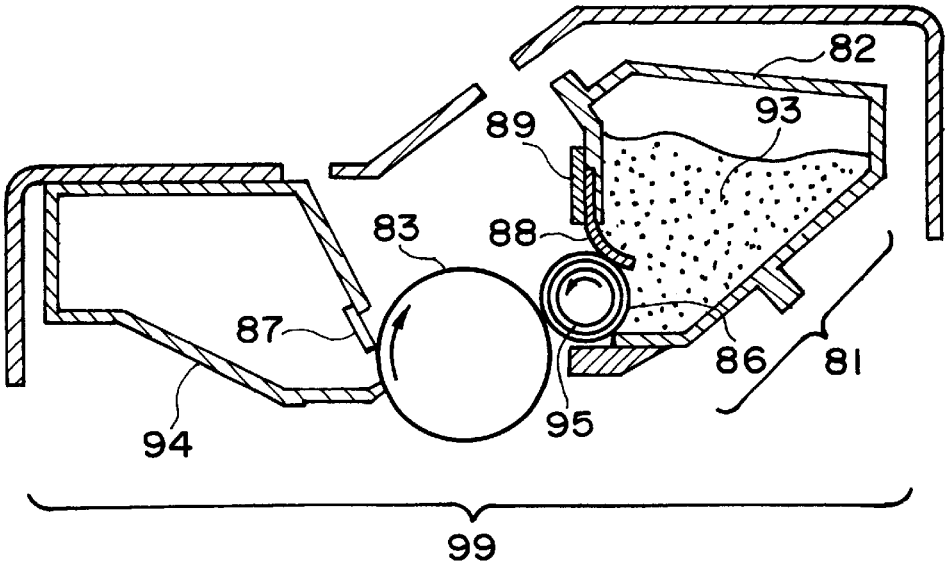
FIG. 16 illustrates a process cartridge incorporated in the image forming apparatus shown in FIG. 15.

FIG. 16 shows an example of such a process cartridge 99 taken out of the entire apparatus shown in FIG. 15, including the developing device 81, the photosensitive drum 83, the cleaner 94 and the primary charger 91 as an integral unit.

Such a process cartridge 99 may be replaced by a fresh one when the magnetic toner 93 in the developing sleeve 81 is used up.

In the above-described embodiment, the developing device 81 contains a magnetic toner 93, and at the time of development, a prescribed electric field is formed between the photosensitive drum 83 and the developing sleeve 86. Accordingly, in order to effectively operate the development step, the gap between the photosensitive drum 83 and the developing sleeve 86 is very critical. In this embodiment, the gap is controlled at 300 $\mu$m as a central value with a tolerance of ±20 $\mu$m.

In the process cartridge shown in FIG. 16, the developing device 81 includes a toner vessel 82 for containing a magnetic toner 93, a developing sleeve 86 for carrying the toner in the toner vessel 82 and conveying it to the developing region confronting the electrostatic image-bearing member 83, and an elastic blade 88 for regulating the magnetic toner carried on the developing sleeve 86 and conveyed to the developing region to form a thin toner layer having a prescribed thickness on the developing sleeve 86.

The developing sleeve 86 may assume an arbitrary structure, but ordinarily, may comprise a non-magnetic sleeve enclosing a magnet 95. The developing sleeve 86 may be in the form of a cylindrical rotating member as shown or may be in the form of a circulating belt. Ordinarily, the sleeve may preferably comprise aluminum or SUS (stainless steel).

The elastic blade 88 may comprise an elastomer, such as urethane rubber, silicone rubber, or NBR; a metal elastic material, such as a sheet of phosphor bronze or stainless steel; or an elastic sheet formed of a resinous elastic material, such as polyethylene terephthalate or high-density polyethylene. The elastic blade 88 is abutted against the developing sleeve because of its inherent elasticity and fixed to the toner vessel 82 by means of a blade-supporting member 89 of a rigid material, such as iron. The elastic blade 88 may preferably be abutted at a linear pressure of 5–80 g/cm against the developing sleeve in a counter direction relative to the rotation direction of the developing sleeve 86.

It is also possible to use a magnetic doctor blade of, e.g., iron, in place of such an elastic blade 88.

As a primary changing means in the above embodiment, a charging roller 91 has been described as a contact changing means, but it is also possible to use another contact charging means, such as a charging blade or a charging brush, or use a non-contactive corona charging means. However, the contact charging means is preferred because of less occurrence of ozone during the charging. The transfer means has been descried with reference to a transfer roller 88, but another contact charging means, such as a transfer blade, can be used, or a non-contactive corona transfer mean can also be used. Also in this case, however, the contact transfer means is preferred because of less occurrence of ozone for the transfer operation.

Figure 17:
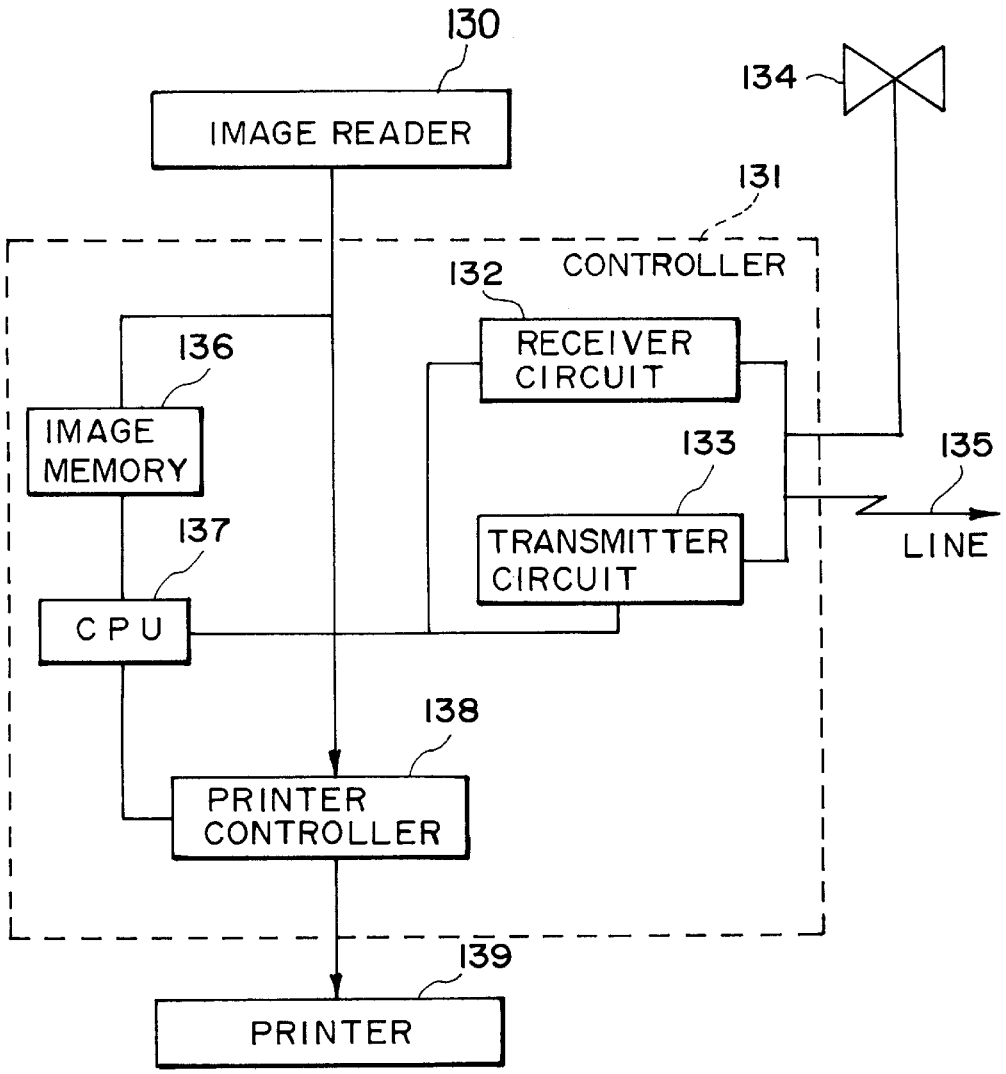
FIG. 17 is a block diagram of a facsimile apparatus to which the image forming method according to the invention is applicable.

In case where an image forming apparatus as described above is used as a printer for facsimile, the above-mentioned image exposure means corresponds to that for printing received data. FIG. 17 shows such an embodiment by using a block diagram.

Referring to FIG. 17, a controller 131 controls an image reader (or image reading unit) 130 and a printer 139. The entirety of the controller 131 is regulated by a CPU (central processing unit) 137. Read data from the image reader 130 is transmitted through a transmitter circuit 133 to another terminal such as facsimile. On the other hand, data received from another terminal such as facsimile is transmitted through a receiver circuit 132 to the printer 139. An image memory 136 stores prescribed image data. A printer controller 138 controls the printer 139. In FIG. 17, reference numeral 134 denotes a telephone set.

More specifically, an image received from a line (or circuit) 135 (i.e., image information received from a remote terminal connected by the line) is demodulated by means of the receiver circuit 132, decoded by the CPU 137, and sequentially stored in the image memory 136. When image data corresponding to at least one page is stored in the image memory 136, image recording is effected with respect to the corresponding page. The CPU 137 reads image data corresponding to one page from the image memory 136, and transmits the decoded data corresponding to one page to the printer controller 138. When the printer controller 138 receives the image data corresponding to one page from the CPU 137, the printer controller 138 controls the printer 139 so that image data recording corresponding to the page is effected. During the recording by the printer 139, the CPU 137 receives another image data corresponding to the next page.

Thus, receiving and recording of an image may be effected by means of the apparatus shown in FIG. 17 in the above-mentioned manner.

As described, because of uniform dispersion of the wax in the binder resin, the toner according to the present invention can exhibit good fixability and excellent performance in respects of anti-offset property, anti-blocking performance and continuous image forming performances on a large number of sheets.

EXAMPLES

Hereinbelow, the present invention will be described more specifically based on Examples, to which the present invention should not be construed to be limited.

Series I

Production of Binder Resins

Resin Production Example I-1

(I-a) Production of Resin Composition of Low Degree of Crosslinkage (i.e., Chloroform-Insoluble Content=0–10 wt. %)

| | |
|---|---|
| Terephthalic acid | 5.0 mol |
| Succinic acid derivative of Formula (1-3) | 1.0 mol |
| Trimellitic anhydride | 7.0 mol |
| PO-BPA (propoxylated bisphenol A) | 7.0 mol |
| EO-BPO (ethoxylated bisphenol A) | 3.0 mol |

The above polyester monomers were charged together with an esterification catalyst in an autoclave equipped with a vacuum device, a water separator, a nitrogen gas introduction device, a temperature detector and a stirring device. Then, while the system pressure was gradually lowered under a nitrogen gas atmosphere in an ordinary manner, the monomers were heated to 210° C. to effect polycondensation, thereby providing a low-crosslinked polyester resin having a chloroform-insoluble content of ca. 3 wt. %.

Then, together with 50 wt. parts of zylene, 80 wt. parts of the above-prepared polyester resin, 16 wt. parts of styrene, 4 wt. parts of 2-ethylhexyl acrylate, 0.01 wt. part of divinylbenzene and 0.3 wt. part of dibutyltin oxide (esterification catalyst) were added and heated to 110° C. for dissolution and swelling. Into the system under a nitrogen atmosphere, a solution of 1 wt. part of t-butyl hydroperoxide (radical polymerization initiator) in 10 wt. parts of xylene was added dropwise in ca. 30 min. The system was held at that temperature for further 10 hours to complete the radical polymerization. The system was further heated under a reduced pressure for solvent removal to obtain a low-crosslinked Resin composition (I-A) having a chloroform insoluble content of ca. 7 wt. % and comprising a low-crosslinked polyester resin, a vinyl resin and a hybrid resin component comprising a vinyl polymer unit and a polyester unit.

(I-b) Production of Resin Composition of High Degree of Crosslinkage (Chloroform-Insoluble Content=15–70 wt. %)

| | |
|---|---|
| Terephthalic acid | 2.0 mol |
| Succinic acid derivative of Formula (1-3) | 4.0 mol |
| Trimellitic anhydride | 4.0 mol |
| PO-BPA | 10.0 mol |

The above polyester monomers were charged together with an esterification catalyst in an autoclave equipped with a vacuum device, a water separator, a nitrogen gas introduction device, a temperature detector and a stirring device. Then, while the system pressure was gradually lowered under a nitrogen gas atmosphere in an ordinary manner, the monomers were heated to 210° C. to effect polycondensation, thereby providing a high-crosslinked polyester resin having a chloroform-insoluble content of ca. 25 wt. %.

Then, together with 50 wt. parts of xylene, 80 t. parts of the above-prepared polyester resin, 10 wt. parts of styrene, 10 wt. parts of 2-ethylhexyl acrylate, 0.01 wt. part of divinylbenzene and 0.3 wt. part of dibutyltin oxide (esterification catalyst) were added and heated to 110° C. for dissolution and swelling. Into the system under a nitrogen atmosphere, a solution of 1 wt. part of t-butyl hydroperoxide (radical polymerization initiator) in 10 wt. parts of xylene was added dropwise in ca. 30 min. The system was held at that temperature for further 10 hours to complete the radical polymerization. The system was further heated under a reduced pressure for solvent removal to obtain a high-crosslinked Resin composition (I-B) having a chloroform-insoluble content of ca. 33 wt. % and comprising a high-crosslinked polyester resin, a vinyl resin and a hybrid resin component comprising a vinyl polymer unit and a polyester unit.

(I-c) Production of Binder Resin

To 100 wt. parts of xylene, 60 wt. parts of low-crosslinked Resin composition (I-A), 30 wt. parts of high-crosslinked Resin composition (I-B), 5 wt. pats of styrene, 5 wt. parts of 2-ethylhexyl acrylate and 0.01 wt. part of divinylbenzene were added and heated to 110° C. for dissolution and swelling. Into the system under a nitrogen atmosphere, a solution of 1 wt. part of t-butyl hydroperoxide (radical polymerization initiator) in 10 wt. parts of xylene was added dropwise in ca. 30 min. The system was held at that temperature for further 10 hours to complete the radical polymerization. The system was further heated under a reduced pressure for solvent removal to obtain Binder resin (I-1) having a chloroform-insoluble content of ca. 28 wt. % and comprising a low-crosslinked polyester resin, a high-crosslinked polyester resin, a vinyl resin, and a hybrid resin component comprising a vinyl polymer unit and a polyester unit.

Resin Production Example I-2

In the step of producing high-crosslinked Resin composition (I-B) in Resin Production Example I-1, ca. 16.7 wt. parts of Wax (1) shown in Table 5 was added per 80 wt. parts of polyester resin (5 wt. parts of Wax (1) per 30 wt. parts of the product resin) together with the styrene and 2-ethylhexyl acrylate to obtain a wax-containing high-crosslinked Resin composition (I-C) having a chloroform-insoluble content of 37 wt. %. Similarly as in Resin Production Example I-1 except for using the wax-containing high-crosslinked Resin composition (I-C) in 35 wt. parts (including 30 wt. parts of resin and 5 wt. parts of wax), there was obtained Binder resin (I-2) having a chloroform-insoluble content of ca. 30 wt. % and comprising high- and low-crosslinked polyester resins, a vinyl resin and a hybrid resin component comprising a polyester resin and a vinyl polymer unit.

Resin Production Example I-3

Low-crosslinked Resin composition (I-D) having a chloroform-insoluble content of ca. 6 wt. % was prepared similarly as in the production of the low-crosslinked Resin composition (I-A) in Resin Production Example (I-1) except for replacing the monomers with a composition of monomers shown below:

| | |
|---|---|
| Terephthalic acid | 5.0 mol |
| Succinic acid derivative of Formula (2-2) | 1.0 mol |
| Trimellitic anhydride | 1.0 mol |
| PO-BPA (propoxylated bisphenol A) | 7.0 mol |
| EO-BPO (ethoxylated bisphenol A) | 3.0 mol |

Then, wax-containing high-crosslinked Resin composition (I-E) having a chloroform-insoluble content of ca. 19 wt. % and containing 5 wt. parts of Wax (2) per 30 wt. parts of the resin was prepared similarly as in the production of the wax-containing high-crosslinked Resin composition (I-C) in Resin Production Example (I-2) except for using the following monomers for polycondensation:

| | |
|---|---|
| Terephthalic acid | 2.0 mol |
| Succinic acid derivative of Formula (2-2) | 4.0 mol |
| Trimellitic anhydride | 4.0 mol |
| PO-BPA (propoxylated bisphenol A) | 8.0 mol |
| EO-BPO (ethoxylated bisphenol A) | 3.0 mol |

Binder resin (I-3) comprising high- and low-crosslinked polyester resins, a vinyl resin and a hybrid resin component comprising a polyester unit and a vinyl polymer unit and having compositions shown in Table 1–3 was prepared similarly as in Resin Production Example I-1 except for using the low-crosslinked Resin composition (I-D) and the high-crosslinked (I-E) prepared above.

Resin Production Examples I-4 to I-7

Similarly as in Resin Production Example I-3 except for modifying the species and amounts of monomers and waxes, Binder resins (I-4)–(I-7) were prepared as shown in Tables 1–3.

Comparative Resin Production Example I-1

Comparative Binder resin (I-1) as shown in Tables 1–3 was prepared in a similar manner as in Resin Production Example (I-1) except for using terephthalic acid in place of the succinic acid derivative of Formula (I-3).

Comparative Resin Production Example I-2

Comparative Binder resin (I-2) as shown in Tables 1–3 was prepared in a similar manner as in Resin Production Example (I-2) except for using terephthalic acid and Comparative wax shown in Table 5 in place of the succinic acid derivative of Formula (I-3) and Wax 2, respectively.

Comparative Resin Production Example I-3

Comparative Binder resin (I-3) as shown in Tables 1–3 was prepared in a similar manner as in Resin Production Example (I-1) except for using terephthalic acid in place of the succinic acid derivative of Formula (I-3) and trimellitic anhydride.

Comparative Resin Production Example I-4

Comparative Binder resin (I-4) as shown in Tables 1–3 was prepared in a similar manner as in Resin Production Example (I-1) except for using trimellitic anhydride in place of the succinic acid derivative of Formula (I-3).

Comparative Resin Production Example I-5

Into an autoclave equipped with a vacuum device, a water separator, a nitrogen gas introduction device, a temperature detector and a stirring device, 200 wt. parts of styrene/2-ethylhexyl acrylate (84/16 by weight) copolymer (Mw=$1.9\times10^4$, Mw/Mn=2.3) and polyester monomers shown below were added. Then, while the system pressure was lowered under a nitrogen gas atmosphere in an ordinary manner, the system was heated to 210° C. to effect polycondensation reaction, whereby Comparative Binder resin (I-5) as shown in Tables 1–3 were prepared:

| | |
|---|---|
| Fumaric acid | 191 wt.parts |
| Trimellitic anhydride | 168 wt.parts |
| EO-BPA | 463 wt.parts |
| PO-BPA | 551 wt.parts |

TABLE 1

Low-crosslinked Resin Compositon

| Binder resin | Monomers*1 for polyester (mol) TPA | TMA | other acids (Formula) | PO-BPA | EO-BPA | other alcohls (Formula) | Monomers*2 for vinyl polymer (wt. parts*3) styrene | acrylate | cross-linking agent |
|---|---|---|---|---|---|---|---|---|---|
| (I-1) | 5.0 | 1.0 | (1-3) 1.0 | 7.0 | 3.0 | — | 16 | 2-EHA 4 | — |
| (I-2) | 5.0 | 1.0 | (2-2) 1.0 | 7.0 | 3.0 | — | 16 | 2-EHA 4 | — |
| (I-3) | 5.0 | 1.0 | (2-2) 1.0 | 7.0 | 3.0 | — | 16 | BA 4 | — |
| (I-4) | 6.0 | 1.0 | — | 7.0 | 3.0 | (4-2) 1.0 | 17 | BA 3 | — |
| (I-5) | 3.0 | 6.0 | — | 6.0 | 4.0 | — | 16 | 2-EHA 4 | DVB 0.02 |
| (I-6) | 5.0 | 3.0 | (1-2) 2.0 | 7.5 | 2.5 | (4-1) 2.0 | 17 | LA 3 | DVB 0.01 |
| (I-7) | 5.0 | 1.0 | (1-1) 2.0 | 7.0 | 3.0 | — | 18 | BA 2 | DVB 0.05 |
| Comp. (I-1) | 6.0 | 1.0 | — | 7.0 | 3.0 | — | 16 | 2-EHA 4 | — |
| Comp. (I-2) | 6.0 | 1.0 | — | 7.0 | 3.0 | — | 16 | 2-EHA 4 | — |
| Comp. (I-3) | 70 | — | — | 7.0 | 3.0 | — | 16 | 2-EHA 4 | — |
| Comp. (I-4) | 6.0 | 2.0 | — | 7.0 | 3.0 | — | 16 | 2-EHA 4 | — |

*1TPA: terephthalic acid
TMA: trimellitic anhydride
PO-BPA: propoxylated bisphenol A
EO-BPA: ethoxylated bisphenol A
*2 2-EHA: 2-ethylhexyl acrylate
BA: butyl acrylate
LA: lauryl acrylate
DVB: divinylbenzene
*3wt. parts for vinyl monomers are based on 80 wt. parts of the polyester.

TABLE 2

High-crosslinked Resin Compositon

| Binder resin | Monomers*1 for polyester (mol) TPA | TMA | other acids (Formula) | PO-BPA | EO-BPA | other alcohls (Formula) | Monomers*2 for vinyl polymer (wt. parts*3) styrene | acrylate | cross-linking agent |
|---|---|---|---|---|---|---|---|---|---|
| (I-1) | 2.0 | 4.0 | (1-3) 4.0 | 10.0 | 4.0 | — | 10.0 | 2-EHA 10.0 | DVB 0.01 |
| (I-2) | 2.0 | 4.0 | (1-3) 4.0 | 10.0 | 4.0 | — | 10.0 | 2-EHA 10.0 | DVB 0.01 |
| (I-3) | 2.0 | 4.0 | (2-2) 4.0 | 10.0 | 4.0 | — | 10.0 | BA 10.0 | DVB 0.01 |
| (I-4) | 6.0 | 4.0 | — | 10.0 | 2.0 | (4-2) 2.0 | 10.0 | BA 10.0 | DVB 0.15 |
| (I-5) | 2.0 | 4.0 | (1-2) 4.0 | 10.0 | 2.0 | (4-1) 2.0 | 12.0 | BA 8.0 | DVB 0.2 |
| (I-6) | 3.0 | 4.0 | (1-2) 3.0 | 10.0 | 4.0 | — | 8.0 | 2-EHA 12.0 | DVB 0.2 |
| (I-7) | 2.0 | 4.0 | (1-2) 3.0 | 10.0 | 3.0 | (1-2) 1.0 | 8.0 | MA 12.0 | — |
| Comp. (I-1) | 6.0 | 4.0 | — | 10.0 | 4.0 | — | 10 | 2-EHA 10 | DVB 0.01 |
| Comp. (I-2) | 6.0 | 4.0 | — | 10.0 | 4.0 | — | 10 | 2-EHA 10 | DVB 0.01 |
| Comp. (I-3) | 6.0 | 4.0 | — | 10.0 | 4.0 | — | 10 | 2-EHA 10 | DVB 0.01 |

TABLE 2-continued

| High-crosslinked Resin Compositon | | | | | | | | | |
|---|---|---|---|---|---|---|---|---|---|
| | Monomers*1 for polyester (mol) | | | | | | Monomers*2 for vinyl polymer (wt. parts*3) | | |
| Binder resin | TPA | TMA | other acids (Formula) | PO-BPA | EO-BPA | other alcohls (Formula) | styrene | acrylate | cross-linking agent |
| Comp. (I-4) | 6.0 | 4.0 | — | 10.0 | 4.0 | — | 10 | 2-EHA 10 | DVB 0.01 |

*1TPA: terephthalic acid
TMA: trimellitic anhydride
PO-BPA: propoxylated bisphenol A
EO-BPA: ethoxylated bisphenol A
*22-EHA: 2-ethylhexyl acrylate
BA: butyl acrylate
LA: lauryl acrylate
DVB: divinylbenzene
MA: methyl acrylate
*3wt. parts for vinyl monomers are based on 80 wt. parts of the polyester.

TABLE 3

| Binder resin (charge-basis composition (wt. parts)) | | | | | | |
|---|---|---|---|---|---|---|
| | Low-crosslinked Resin Comp. | | Binder resin | | | |
| | | | Low-crosslinked | High-crosslinked | | |
| Binder resin | poly-ester | vinyl polymer | Resin Comp. | Resin Comp. | vinyl polymer | wax |
| (I-1) | 80 | 20 | 60 | 30 | 10 | — |
| (I-2) | 80 | 20 | 60 | 30 | 10 | wax (1) 5 |
| (I-3) | 80 | 20 | 60 | 30 | 10 | wax (2) 5 |
| (I-4) | 85 | 15 | 70 | 20 | 10 | — |
| (I-5) | 85 | 15 | 70 | 20 | 10 | wax (3) 5 |
| (I-6) | 85 | 15 | 80 | 15 | 5 | — |
| (I-7) | 70 | 30 | 50 | 40 | 10 | — |
| Comp. (I-1) | 80 | 20 | 60 | 30 | 10 | — |
| Comp. (I-2) | 80 | 20 | 60 | 30 | 10 | Comp. wax 5 |
| Comp. (I-3) | 10 | 90 | 90 | 0 | 10 | — |
| Comp. (I-4) | 80 | 20 | 80 | 10 | 10 | — |

Example I-1

| | |
|---|---|
| Binder resin (I-1) | 100 wt.parts |
| Azo iron complex (1) | 2 wt.parts |
| Magnetic iron oxide | 100 wt.parts |
| (Dav. (average particle size) = 0.2 $\mu$m, Hc = 120 Oe, $\sigma_s$ = 75 emu/g, $\sigma_r$ = 6 emu/g) | |
| Wax (1) | 5 wt.parts |

The above mixture was melt-kneaded through a twin-screw extruder heated at 130° C., and after being cooled, was coarsely crushed by a hammer mill, followed by pulverization by a jet mill and classification by a pneumatic classifier, to obtain Magnetic toner (I-1) having a weight-average particle size (D4) of 6.8 $\mu$m.

Magnetic toner (I-1) was subjected to Soxhlet extraction separately with solvents of tetrahydrofuran (THF), ethyl acetate and chloroform, respectively, to determine soluble contents and insoluble contents for the respective solvents, whereby the toner was found to contain a binder resin composition (exclusive of the wax) having a THF-insoluble content (W2)=31 wt. % including chloroform-insoluble content (W6A)=6.7 wt. %, an ethyl acetate-insoluble content (W4)=34 wt. % including chloroform-insoluble content (W6B)=8.3 wt. %, and a total chloroform-insoluble content (W6)=15 wt. %, thus giving a ratio W4/W6=2.7.

As a result of molecular weight distribution measurement by GPC of the THF-insoluble content (W1), it provided a chromatogram exhibiting a main peak molecular weight (Mp)=4400, an areal percentage for a molecular weight range of 500 to below $10^4$ (A1)=48.9%, an areal percentage for a molecular weight range of $10^4$ to below $10^5$ (A2)=26.7% and an areal percentage for a molecular weight range of $10^5$ or larger (A3)=24.4%, giving a ratio (A1/A2)=1.83.

As a result of acid value measurement, the binder resin and the ethyl acetate-insoluble content (W3) exhibited an acid value (AV1)=26.7 mgKOH/g and an acid value (AV2)=21.6 mgKOH/g, giving a ratio (AV1/AV2)=1.2.

As a result of $^1$H-NMR and $^{13}$C-NMR measurement, it was confirmed that the toner contained a vinyl resin, a polyester resin and a hybrid resin component comprising a polyester unit and a vinyl polymer unit.

Generally, the presence of a hybrid resin component comprising a polyester unit and a vinyl polymer unit can be confirmed by the presence of a newly found ester bond in its $^{13}$C-NMR spectrum, i.e., not found in any of the $^{13}$C-NMR spectra of the corresponding polyester resin and vinyl resin (i.e., styrene-acrylate copolymer).

It has been known that an ester group in a styrene-acrylate ester copolymer provides a signal on a $^{13}$C-NMR spectrum of the copolymer which is shifted by several ppm toward a higher magnetic field side than a corresponding signal on a $^{13}$C-NMR spectrum of an acrylate ester homopolymer because of the influence of the benzene ring of the styrene. This is also true with a hybrid resin component wherein the alcohol portion of the acrylate ester group has been exchanged with a polyester unit containing additional benzene ring as a result of transesterification, so that the signal for the carboxyl group-carbon is further shifted toward a higher magnetic field side due to the influence of the additional benzene group in the polyester unit.

With respect to the toner of this Example, FIG. 1 shows a $^{13}$C-NMR spectrum of a low-crosslinked polyester resin produced in the section (I-a) in Production Example I-1, FIG. 2 shows a $^{13}$C-NMR spectrum of styrene-2-ethylhexyl acrylate copolymer produced separately under the condition shown in the section (I-a) in Production Example I-1, and FIG. 3 shows a $^{13}$C-NMR spectrum of Binder resin (I-1) contained in the toner. From these charts in comparison, it was determined that ca. 22% of the acrylate ester group was transesterified with the polyester unit to form a hybrid resin component.

The $^{13}$C-NMR measurement results are summarized in the following Table 4, wherein "○" represents the presence and "–" represents the absence.

TABLE 4

| | | $^{13}$C-NMR results | | | |
|---|---|---|---|---|---|
| | | Signals for | | | |
| | | Newly found at ca. | Carboxyl group in succinic acid derivative | | Carboxyl group in acrylate ester copolymer |
| Sample | Figure | 168 ppm | ca. 172 ppm | ca. 174 ppm | ca. 176 ppm |
| Low-crosslinked polyester resin | FIG. 1 | — | ○ | ○ | — |
| Styrene-2-ethyl hexyl copolymer | FIG. 2 | — | — | — | ○ |
| Binder resin (I-1) | FIG. 3 | ○ | ○ | ○ | ○ |

From the NMR chart, the proportions Gp and Sp of polyester resin contained the ethyl acetate-insoluble content (W4) and the ethyl acetate-soluble content (W3), respectively, of the binder resin, whereby the results showed Gp=ca. 89 wt. %, Sp=ca. 64 wt. % and a ratio Sp/Gp=0.93. Further, ca. 74 wt. % of the succinic acid derivative of Formula (1-3) totally charged was determined to be contained in the ethyl acetate-insoluble content.

The amount of wax contained in the ethyl acetate-insoluble content (W4) could be determined as ca. 61 wt. % of the total wax added to the toner as a result of melting enthalpy determination based on DSC measurement.

100 wt. parts of Magnetic toner (I-1) was blended with 1.0 wt. part of externally added hydrophobic dry-process silica (SBET (BET specific surface area)=200 $m^2/g$) by a Henschel mixer to obtain a blend toner or flowability-improved toner which is simply referred to as Toner (I-1). The thus-obtained Toner (I-1) subjected to image forming tests by using a digital copying machine ("GP-55", mfd. by Canon K.K.) and a printer ("LBP-720", mfd. by Canon K.K.) respectively having a structure as representatively illustrated in FIG. 9, whereby good image forming performances as shown in Tables 8 and 9 were obtained. More specifically, "GP-55" was a copying machine using a hot roller fixing device and operated at a process speed of ca. 150 mm/sec for a continuous image formation on $10^4$ sheets. "LBP-720" was a laser beam printer using a film heating fixing device and operated at a process speed of ca. 38 mm/sec for a continuous image formation on 3000 sheets.

Table 8 also included results of a fixing test performed at varying fixing temperatures by using a test apparatus obtained by taking out the fixing devices of the image forming apparatus and attaching thereto an external drive and a temperature controller.

Example I-2

Toner (I-2) was prepared in the same manner as in Example I-1 except for replacing the starting ingredients with the following.

| | |
|---|---|
| Binder resin (I-2) | 105 wt.parts |
| Azo iron complex (1) | 2 wt.parts |
| Magnetic iron oxide (Dav. = 0.2 $\mu$m, Hc = 120 Oe, $\sigma_s$ = 75 emu/g, $\sigma_r$ = 6 emu/g) | 100 wt.parts |

The thus obtained Toner (I-2) was subjected to analysis and evaluation of image forming performances similarly as in Example I-1. The results are inclusively shown in Tables 6–9 together with those of Example I-1 and Examples and Comparative Examples described hereinafter.

Examples I-3 to I-7

Toners (I-3) to (I-7) were prepared and evaluated in the same manner as in Example I-1 except for using Binder resins (I-3) to (I-7), respectively, in place of Binder resin (I-1).

Comparative Examples I-1 to I-6

Comparative Toners (I-1) to (I-6) were prepared and evaluated in the same manner as in Example I-1 except for using Comparative Binder resins (I-1) to (I-6), respectively, in place of Binder resin (I-1).

TABLE 5

| Waxes | | | | |
|---|---|---|---|---|
| Identification | Type | Tmp (° C.) | Mw | Mw/Mn |
| Wax (1) | hydrocarbon | 108 | 1450 | 1.32 |
| Wax (2) | " | 93 | 1040 | 1.18 |
| Wax (3) | " | 115 | 2569 | 1.25 |
| Wax (4) | " | 124 | 4100 | 1.19 |
| Comparative Wax | polypropylene | 148 | 6230 | 4.65 |

TABLE 6

| | THF (tetrahydrofuran) extraction | | | | | | | EA* extraction | | | Chloroform extraction | | | | | | |
|---|---|---|---|---|---|---|---|---|---|---|---|---|---|---|---|---|---|
| | soluble | | | | | | insoluble | soluble | | insoluble | | | Chloroform-insoluble | | | | |
| | | | | | | | | | | | | | in THF-insoluble | in EA-insoluble | | | |
| | W1 (wt. %) | Mp** | A1 | A2 | A3 | A1/A2 | W2 (wt. %) | W3 (wt. %) | acid value (AV2) | W4 (wt. %) | soluble W5 (wt. %) | W6 (wt. %) | W6A (wt. %) | W6B (wt. %) | W6A:W6B | W4/W6 | AV1/AV2 |
| Ex. I-1 | 69 | 4400 | 48.9 | 26.7 | 24.4 | 1.83 | 31 | 66 | 21.6 | 34 | 85 | 15 | 6.7 | 8.3 | 1:1.2 | 2.7 | 1.2 |
| Ex. I-2 | 68 | 5100 | 48.7 | 28.3 | 23.0 | 1.72 | 32 | 63 | 21.3 | 37 | 83 | 17 | 7.3 | 9.7 | 1:1.3 | 2.2 | 1.2 |
| Ex. I-3 | 68 | 5900 | 48.9 | 30.4 | 20.7 | 1.61 | 32 | 63 | 28.6 | 37 | 82 | 18 | 7.6 | 10.4 | 1:1.4 | 2.1 | 1.0 |
| Ex. I-4 | 64 | 6800 | 50.6 | 32.0 | 17.4 | 1.58 | 36 | 54 | 36.8 | 46 | 79 | 21 | 6.4 | 14.6 | 1:2.3 | 2.2 | 1.2 |
| Ex. I-5 | 67 | 7100 | 49.3 | 34.5 | 16.2 | 1.43 | 33 | 62 | 22.4 | 38 | 74 | 26 | 9.6 | 16.4 | 1:1.7 | 1.5 | 1.1 |
| Ex. I-6 | 53 | 7800 | 49.1 | 38.7 | 12.2 | 1.27 | 47 | 49 | 23.2 | 51 | 72 | 28 | 12.7 | 15.3 | 1:1.2 | 1.8 | 1.3 |
| Ex. I-7 | 54 | 8300 | 37.3 | 34.6 | 28.1 | 1.08 | 46 | 48 | 24.5 | 52 | 59 | 41 | 10.8 | 30.2 | 1:2.8 | 1.3 | 1.6 |
| Comp. Ex. I-1 | 96.2 | 3700 | 66.7 | 15.6 | 17.7 | 4.26 | 3.8 | 99 | 41.6 | 1 | 100 | 0 | 0 | 0 | — | — | — |
| Comp. Ex. I-2 | 47 | 10500 | 28.3 | 41.5 | 30.2 | 0.68 | 53 | 48 | 6.9 | 52 | 52 | 48 | 26.7 | 21.3 | 1:0.8 | 0.9 | 2.3 |
| Comp. Ex. I-3 | 83 | 6100 | 17.1 | 47.6 | 35.3 | 2.77 | 17 | 81 | 31.3 | 19 | 88 | 12 | 5 | 7 | 1:1.4 | 1.6 | 1.1 |
| Comp. Ex. I-4 | 54 | 8600 | 36.8 | 36.1 | 27.1 | 1.02 | 46 | 48 | 22.1 | 52 | 58 | 42 | 14 | 28 | 1:2.5 | 1.2 | 1.3 |
| Comp. Ex. I-5 | 95.8 | 18400 | 17.3 | 52.2 | 30.5 | 3.01 | 4.2 | 94.7 | 16.5 | 5.3 | 98 | 2 | 0.8 | 1.2 | 1:1.5 | 1.3 | 1.2 |

*EA = ethyl acetate
**Mp = peak molecular weight

TABLE 7

| | Binder resin | Wax dispersibility H:H1:H2:H3 | Polyester resin Gp (wt. %) | Polyester resin Sp (wt. %) | Polyester resin Sp/Gp | Hybrid resin content (mol %) (Based on acrylate) |
|---|---|---|---|---|---|---|
| Ex. I-1 | I-1 | 1.0:0.8:0.7:0.9 | 83 | 77 | 0.93 | 22 |
| Ex. I-2 | I-2 | 1.0:1.0:0.9:1.0 | 70 | 84 | 0.83 | 24 |
| Ex. I-3 | I-3 | 1.0:0.9:0.9:0.9 | 69 | 85 | 0.81 | 27 |
| Ex. I-4 | I-4 | 1.0:0.9:0.8:0.9 | 65 | 86 | 0.76 | 32 |
| Ex. I-5 | I-5 | 1.0:1.0:0.9:1.0 | 82 | 84 | 0.93 | 36 |
| Ex. I-6 | I-6 | 1.0:1.3:1.2:1.1 | 94 | 72 | 0.77 | 39 |
| Ex. I-7 | I-7 | 1.0:1.5:1.4:1.6 | 91 | 53 | 0.58 | 46 |
| Comp. Ex. I-1 | Comp. I-1 | 1.0:—:2.6:— | — | 82 | — | 2.5 |

TABLE 7-continued

| | Binder resin | Wax dispersibility H:H1:H2:H3 | Polyester resin Gp (wt. %) | Polyester resin Sp (wt. %) | Polyester resin Sp/Gp | Hybrid resin content (mol %) (Based on acrylate) |
|---|---|---|---|---|---|---|
| Comp. Ex. I-2 | Comp. I-2 | 1.0:2.2:2.2:2.3 | 8 | 93 | 0.08 | 62 |
| Comp. Ex. I-3 | Comp. I-3 | 1.0:0.2:0.2:0.3 | 37 | 17 | 0.46 | 13 |
| Comp. Ex. I-4 | Comp. I-4 | 1.0:2.4:2.1:2.3 | 32 | 35 | 1.10 | 16 |
| Comp. Ex.I-5 | Comp. I-5 | 1.0:12:13:13 | 100 | 82 | 0.82 | 0 |

TABLE 8

| | Image density during continuous image formation: GP-55 initial | GP-55 final | LBP-720 initial | LBP-720 final | Toner fixability: GP-55 IDLP at 130° C. | GP-55 Hot offset at 220° C. | LBP-720 IDLP at 150° C. | LBP-720 Hot offset at 220° C. | Blocking (50° C., 7 days) |
|---|---|---|---|---|---|---|---|---|---|
| Ex. I-1 | 1.36 | 1.41 | 1.37 | 1.40 | 10.3% | none | 8.6% | none | no change |
| Ex. I-2 | 1.39 | 1.42 | 1.41 | 1.41 | 6.5 | none | 4.2 | none | no change |
| Ex. I-3 | 1.37 | 1.38 | 1.35 | 1.38 | 7.8 | none | 7.2 | none | no change |
| Ex. I-4 | 1.40 | 1.37 | 1.34 | 1.36 | 8.3 | none | 7.5 | none | no change |
| Ex. I-5 | 1.35 | 1.35 | 1.37 | 1.38 | 7.3 | none | 5.9 | none | no change |
| Ex. I-6 | 1.36 | 1.39 | 1.39 | 1.40 | 6.9 | none | 5.4 | none | no change |
| Ex. I-7 | 1.40 | 1.42 | 1.38 | 1.41 | 7.1 | none | 6.3 | none | no change |
| Comp. Ex. I-1 | 1.20 | 1.22 | 1.09 | 1.13 | 18.8 | remarkable | 23.8 | slight | slight agglomerate |
| Comp. Ex. I-2 | 1.13 | 1.04 | 0.96 | 1.05 | 22.3 | slight | 26.6 | slight | agglomerate |

TABLE 8-continued

| | Image density during continuous image formation | | | | Toner fixability | | | | |
|---|---|---|---|---|---|---|---|---|---|
| | | | | | GP-55 | | LBP-720 | | |
| | GP-55 | | LBP-720 | | IDLP at | Hot offset | IDLP at | Hot offset | Blocking |
| | initial | final | initial | final | 130° C. | at 220° C. | 150° C. | at 220° C. | (50° C., 7 days) |
| Comp. Ex. I-3 | 1.08 | 0.83 | 1.21 | 0.72 | 7.8 | remark-able | 8.2 | remark-able | agglomerate |
| Comp. Ex. I-4 | 0.92 | 1.13 | 0.81 | 1.18 | 27.1 | none | 30.3 | none | no change |
| Comp. Ex. I-5 | 0.64 | 0.81 | 0.72 | 0.66 | 35.6 | remark-able | 39.8 | remark-able | agglomerate |

Toner fixability shown in Table 8 was evaluated with respect to image density lowering percentage (IDLP) and occurrence of hot offset (HO, i.e., high temperature-offset) according to the following methods.

Copying Machine (GP-55)

The fixing device of a digital copying machine ("GP-55", mfd. by Canon K.K.) was taken out and an external drive mechanism and a temperature controller were attached thereto to provide a fixing test device. By using the test device, an unfixed halftone image carried on plain paper was fixed at temperatures of 130° C. and 220° C., respectively. The fixed image obtained at a fixing temperature of 130° C. was rubbed with soft tissue paper at a load of 4.9 $N/m^2$ (50 $g/cm^2$), whereby an image density lowering percentage (IDLP) after the rubbing was measured relative to the image density before the rubbing. The fixed image at a fixing temperature of 220° C. was observed with eyes as to whether hot offset (HO) occurred or not.

Laser Beam Printer ("LBP-720")

A similar fixing test as above was performed by using a fixing test device obtained by taking out the fixing of a laser beam printer ("LBP-720", mfd. by Canon K.K.) and attaching thereto an external drive mechanism and a temperature controller. The fixing temperatures were changed to 150° C. and 220° C.

Blocking test was performed in the following manner.

50 g of a sample toner was placed in a 100 ml-container and left standing in an environment of 50° C. for 7 days. Thereafter, the flowability of the sample toner is evaluated with eyes as to whether the flowability change occurred, or some agglomerate was found therein.

TABLE 9

| | Fog | | Melt-sticking on photosensitive drum | | Cleanability | |
|---|---|---|---|---|---|---|
| | GP-55 | LBP-720 | GP-55 | LBP-720 | GP-55 | LBP-720 |
| Ex. I-1 | B | B | B | B | B | B |
| Ex. I-2 | B | B | B | B | B | B |
| Ex. I-3 | A | B | A | B | A | A |
| Ex. I-4 | B | B | B | B | B | B |
| Ex. I-5 | A | A | A | B | A | A |
| Ex. I-6 | A | A | A | A | A | B |
| Ex. I-7 | A | A | A | A | A | B |
| Comp. Ex. I-1 | E | E | E | E | E | E |
| Comp. Ex. I-2 | C | D | D | D | D | D |

TABLE 9-continued

| | Fog | | Melt-sticking on photosensitive drum | | Cleanability | |
|---|---|---|---|---|---|---|
| | GP-55 | LBP-720 | GP-55 | LBP-720 | GP-55 | LBP-720 |
| Comp. Ex. I-3 | C | C | E | E | D | E |
| Comp. Ex. I-4 | C | C | D | D | D | D |
| Comp. Ex. I-5 | E | E | E | E | D | D |

Fog, Melt-sticking and Cleanability shown in Table 9 above were evaluated at 5 levels of A–E according to the following standards.

Fog

A: No fog toner was recognizable by observation through a magnifying glass of a medium level of magnification (ca. 5–10).

B: Slight fog toner was recognizable by observation through such a magnifying glass of a medium level of magnification.

C: Slight fog toner was recognizable by observation through a magnifying glass of a low level magnification (ca. 2–4).

D: Fog on images was recognizable by eye observation.

E: Remarkable fog on images was recognizable by eye observation.

Melt-sticking on the Photosensitive Drum

A: No toner was left attached on the drum by eye observation.

B: Slight toner was left attached on the drum by eye observation but could be removed easily. A level of practically no problem.

C: Melt-stuck toner on the drum was confirmed by eye observation and could not be removed easily.

D: Melt-stuck toner on the drum was confirmed by eye observation, and clear trace thereof was recognized in the resultant images.

E: Streak-like melt-sticking was observed on the drums by eye observation.

Cleanability

A: No soiling with toner was observed on the cleaning member by eye observation.

B: The cleaning member was partly soiled with toner by eye observation but at a level of practically no problem.

C: The cleaning member was soiled with toner at a possibly practically problematic level.

D: A residual portion of toner was found on the drum by eye observation, and a portion thereof appeared on the resultant images.

E: Residual toner was observed on the whole surface of the drum.

From the above-mentioned results of Examples I-1 to I-7 and Comparative Examples I-1 to I-5 in comparison, the toner according to the present invention using a specific binder resin containing a hybrid resin component comprising a polyester unit and a vinyl polymer unit, exhibits good fixability, anti-offset performance, anti-blocking property and continuous image-forming performances on a large number of sheets.

Series II

Production of Binder Resins

Resin Production Example II-1

(II-a) Production of Low-Crosslinked Resin Composition (II-A)

| | |
|---|---|
| Terephthalic acid | 6.0 mol |
| Succinic acid derivative of Formula (1-3) | 1.0 mol |
| Trimellitic anhydride | 7.0 mol |
| PO-BPA (propoxylated bisphenol A) | 7.0 mol |
| EO-BPO (ethoxylated bisphenol A) | 3.0 mol |

The above polyester monomers were charged together with an esterification catalyst in an autoclave equipped with a vacuum device, a water separator, a nitrogen gas introduction device, a temperature detector and a stirring device. Then, while the system pressure was gradually lowered under a nitrogen gas atmosphere in an ordinary manner, the monomer were heated to 210° C. to effect polycondensation, thereby providing a low-crosslinked polyester resin having a chloroform-insoluble content of ca. 4 wt. %.

Then, 70 wt. parts of the thus-obtained polyester resin was completely dissolved in 100 wt. parts of xylene, and a solution of 23 wt. parts of styrene, 7 wt. parts of 2-ethylhexyl acrylate, 0.3 wt. parts of dibutyltin oxide (esterification catalyst) and 1 wt. part of t-butyl hydroperoxide (polymerization initiator) in 30 wt. parts of xylene was added thereto at 110° C. under a nitrogen atmosphere in ca. 1 hour. Then, the system was held at the temperature for 6 hours to complete the polymerization. Thereafter, the system was reduced in pressure under heating to remove the solvent, thereby obtaining a low-crosslinked Resin composition (II-A) comprising a low-crosslinked polyester resin, a vinyl resin and a hybrid resin component comprising a polyester unit and a vinyl polymer unit.

(II-b) Production of High-Crosslinked Resin Composition (II-B)

The process of production of low-crosslinked Resin composition (II-A) was substantially followed except for replacing the species and compositions of the monomers (summarized at the row of Binder resin (II-1) in Table 10) with those shown at the row of Binder resin (II-1) in Table 11, thereby producing a high-crosslinked Resin composition (II-B) having a chloroform-insoluble content of ca. 18 wt. % and comprising a high-crosslinked polyester resin, a vinyl resin and a hybrid resin component comprising a polyester unit and a vinyl polymer unit.

(II-C) Production of Binder resin (II-1)

27 wt. parts of high-crosslinked Resin composition (II-B) and 70 wt. parts of low-crosslinked Resin composition (II-A) were swollen or dissolved in 200 wt. parts of xylene, and then a solution of 2 wt. parts of styrene, 1.0 wt. part of 2-ethylhexyl acrylate, 0.01 wt. part of divinylbenzene and 0.05 wt. part of t-butyl hydroperoxide (initiator) was added thereto at ca. 125° C. under a nitrogen atmosphere in ca. 1 hour. Then, the system was held at that temperature for 5 hours, followed by solvent removal, to obtain binder resin (II-1) comprising a high-crosslinked polyester resin, a low-crosslinked polyester resin, a vinyl resin, and a hybrid resin component comprising a polyester unit and vinyl polymer unit.

Resin Production Examples II-2 to II-6

Binder resins (II-2) to (II-6) were prepared in similar manners as in Resin Production Example II-1 except for changing the species and compositions of the monomers at the respective stages to those shown in Tables 10, 11 and 14, respectively.

Comparative Resin Production Examples II-1 to II-6

Comparative Binder resins (II-2) to (II-6) were prepared in similar manners as in Resin Production Example II-1 except for changing the species and compositions of the monomers at the respective stages to those shown in Tables 10, 11 and 14, respectively.

TABLE 10

Low-crosslinked Resin Compositon (Example)

| | Monomers*1 for polyester (mol) | | | | | | Monomers*2 for vinyl resin | | | Charged composition (wt. parts) | |
|---|---|---|---|---|---|---|---|---|---|---|---|
| Binder resin | TPA | TMA | other acids (Formula) | PO-BPA | EO-BPA | other alcohls (Formula) | styrene | acrylate | cross-linking agent | Polyester monomer | Vinyl monomer |
| (II-1) | 6 | 1 | (1-3) 1 | 7 | 3 | — | 77 | 2-EHA 23 | — | 70 | 30 |
| (II-2) | 6 | 1 | (1-1) 1 | 7 | 3 | — | 82 | BA 18 | — | 70 | 30 |
| (II-3) | 7 | 1 | — | 7 | 3 | (6-1) 1 | 85 | BA 15 | — | 50 | 50 |
| (II-4) | 2.5 | 6 | — | 6 | 4 | — | 78 | 2-EHA 21.5 | DVB 0.5 | 85 | 15 |
| (II-5) | 5.5 | 3 | (1-2) 2 | 7.5 | 2.5 | (6-1) 2 | 80 | LA 19.8 | DVB 0.2 | 60 | 40 |

TABLE 10-continued

Low-crosslinked Resin Compositon (Example)

| Binder resin | Monomers*1 for polyester (mol) TPA | TMA | other acids (Formula) | PO-BPA | EO-BPA | other alcohls (Formula) | Monomers*2 for vinyl resin styrene | acrylate | cross-linking agent | Charged composition (wt. parts) Polyester monomer | Vinyl monomer |
|---|---|---|---|---|---|---|---|---|---|---|---|
| (II-6) | 6 | 1 | (1-1) 2 | 7 | 3 | — | 83 | BA 17.5 | DVB 0.5 | 30 | 70 |

*1TPA: terephthalic acid
TMA: trimellitic anhydride
PO-BPA: propoxylated bisphenol A
EO-BPA: ethoxylated bisphenol A
*22-EHA: 2-ethylhexyl acrylate
BA: butyl acrylate
LA: lauryl acrylate
DVB: divinylbenzene

TABLE 11

High-crosslinked Resin Compositon (Example)

| Binder resin | Monomers*1 for polyester (mol) TPA | TMA | other acids (Formula) | PO-BPA | EO-BPA | other alcohls (Formula) | Monomers*2 for vinyl resin styrene | acrylate | cross-linking agent | Charged composition (wt. parts) Polyester monomer | Vinyl monomer |
|---|---|---|---|---|---|---|---|---|---|---|---|
| (II-1) | 2 | 4 | (1-3) 4 | 11 | 3 | — | — | — | — | 100 | — |
| (II-2) | 2 | 4 | (3-2) 4 | 11 | 3 | — | 80 | BA 18.8 | DVB 1.2 | 90 | 10 |
| (II-3) | 3 | 5 | — 4 | 7 | 3 | (6-1) 4 | 85 | BA 14.5 | DVB 0.5 | 60 | 40 |
| (II-4) | 3 | 5 | (1-1) 4 | 10 | 4 | (6-1) 4 | 78 | BA 20 | DVB 2 | 90 | 10 |
| (II-5) | 3 | 3 | (1-1) 2 | 11 | 3 | — | 81.5 | BA 17.2 | DVB 1.3 | 70 | 30 |
| (II-6) | 2 | 5 | (1-2) 3 | 11 | 3 | (6-1) 3 | 85 | BA 15 | — | 55 | 45 |

*1, *2Same as in Table 10

TABLE 12

Low-crosslinked Resin Compositon (Comparative Example)

| Binder resin | Monomers*1 for polyester (mol) TPA | TMA | PO-BPA | EO-BPA | styrene | acrylate | cross-linking agent | Charged composition (wt. parts) Polyester monomer | Vinyl monomer |
|---|---|---|---|---|---|---|---|---|---|
| Comparative (II-1) | 7 | 1 | 7 | 3 | 80 | 2-EHA 20 | — | 70 | 30 |
| Comparative (II-2) | 5 | 1 | 7 | 3 | 82 | BA 17 | DVB 1 | 70 | 30 |
| Comparative (II-3) | 6 | 1 | 7 | 3 | 80 | 2-EHA 20 | — | 98 | 2 |
| Comparative (II-4) | 6 | 1 | 7 | 3 | 80 | 2-EHA 20 | — | 15 | 85 |
| Comparative (II-5) | 6 | 1 | 7 | 3 | 80 | 2-EHA 20 | — | 80 | 20 |
| Comparative (II-6) | 6 | 1 | 7 | 3 | 80 | 2-EHA 20 | — | 40 | 60 |

*1, *2Same as in Table 10

TABLE 13

High-crosslinked Resin Compositon (Comparative Example)

| Binder resin | Monomers*1 for polyester (mol) TPA | TMA | PO-BPA | EO-BPA | styrene | acrylate | cross-linking agent | Charged composition (wt. parts) Polyester monomer | Vinyl monomer |
|---|---|---|---|---|---|---|---|---|---|
| Comparative (II-1) | 7 | 6 | 7 | 3 | — | — | — | 100 | — |
| Comparative (II-2) | 5 | 4 | 10 | 4 | 80 | BA 18 | DVB 2 | 80 | 20 |
| Comparative (II-3) | 5 | 6 | 7 | 3 | — | — | — | 100 | — |
| Comparative (II-4) | 5 | 6 | 7 | 3 | 80 | BA 18 | DVB 2 | 30 | 70 |
| Comparative (II-5) | 5 | 6 | 7 | 3 | 80 | BA 18 | DVB 2 | 60 | 40 |
| Comparative (II-6) | 5 | 6 | 7 | 3 | 80 | BA 18 | DVB 2 | 80 | 20 |

*1, *2Same as in Table 10

TABLE 14

| Binder resin | Charged composition at the final binder resin preparation stage: Low-crosslinked resin composition (wt.parts) | High-crosslinked resin composition (wt.parts) | Vinyl ** monomers (wt.parts) |
|---|---|---|---|
| II-(1) | 70 | 27 | 3 |
| II-(2) | 70 | 27 | 3 |
| II-(3) | 90 | 7 | 3 |
| II-(4) | 20 | 65 | 15 |
| II-(5) | 50 | 40 | 10 |
| II-(6) | 40 | 40 | 20 |
| Comp. | | | |
| II-(1) | 70 | 27 | 3 |
| II-(2) | 10 | 87 | 3 |
| II-(3) | 70 | 29.5 | 0.5 |
| II-(4) | 70 | 27 | 3 |
| II-(5) | 70 | 27 | 3 |
| II-(6) | 70 | 27 | 3 |

**: In all cases, the vinyl monomers were composed of styrene and 2-ethylhexyl acrylate in a weight ratio of 2:1.

Magnetic Iron Oxide Production Example 1

Into ferrous sulfate aqueous solution, sodium silicate containing silicon in an amount of 2.0 wt. % based on the iron in the ferrous sulfate was added, and then caustic soda in an amount of 1.0–1.1 times the equivalent of the ferrous ion to form an aqueous liquid containing ferrous hydroxide.

Then, air was blown into the aqueous liquid while retaining the pH at ca. 9 to cause oxidation at 80–90° C., thereby forming an aqueous slurry containing seed crystals. Then, into the slurry, a ferrous sulfate aqueous solution in an amount of 0.9–1.2 times the equivalent of the total alkali (i.e., the sum of sodium in the sodium silicate and sodium in the caustic soda) was added to proceed with the oxidation, followed by pH adjustment at the final stage to localize the siliceous component at the surface of resultant magnetic iron oxide particles. The thus-formed magnetic iron oxide particles were washed, filtrated an dried, followed by disintegration of agglomerates, to obtain Magnetic iron oxide particles (1), of which the analytical results are shown in Table 15 together with those of magnetic iron oxide particles obtained in the Production Examples described below.

Magnetic Iron Oxide Production Example 2

Magnetic iron oxide particles (2) were prepared in the same manner as in Production Example 1 except for omitting the addition of the caustic soda.

Magnetic Iron Oxide Production Example 3

Magnetic iron oxide particles (3) were prepared by blending Magnetic iron oxide particles (1) with silica fine powder in an amount sufficient to provide a silicon content of 3.5 wt. % based on iron by means of a Henschel mixer.

Magnetic Iron Oxide Production Example 4

Magnetic iron oxide particles (4) were prepared by blending Magnetic iron oxide particles (2) with silica fine powder in an amount sufficient to provide a silicon content of 3.5 wt. % based on iron by means of a Henschel mixer.

Magnetic Iron Oxide Production Example 5

Magnetic iron oxide particles (5) were prepared in the same manner as in Production Example 1 except that the sodium silicate was added in amount providing a silicon content of 0.8 wt. % based on iron, and the pH at the final stage of the oxidation was adjusted so as not to cause the surface localization of silicon.

Magnetic Iron Oxide Production Example 6

The oxidation was performed without adding the sodium silicate but by changing the amount of caustic soda so as to keep the aqueous system continually at a pH of 12–13 to obtain Magnetic iron oxide particles (6) comprising actahedral particles ($\phi$=0.67).

Properties of Magnetic iron oxide particles (1)–(6) thus prepared are summarized in the following Table 15 in terms of total silicon content (A wt. % based on iron), B/A (B (silicon content up to 20 wt. % dissolution of iron magnetic iron oxide)/A), C/A (C (silicon content localized at the surface of magnetic iron oxide particles)/A) and sphericity $\phi$.

TABLE 15

| Magnetic iron oxide particles | Silicon content (A) (wt. % based on Fe) | B/A | C/A | ø |
|---|---|---|---|---|
| (1) | 1.5 | 55 | 20 | 0.93 |
| (2) | 0 | — | — | 0.86 |
| (3) | 3.2 | 77 | 60 | 0.93 |
| (4) | 0.6 | — | 100 | 0.86 |
| (5) | 0.8 | 47 | 0 | 0.88 |
| (6) | 0 | — | — | 0.67** |

**:octahedral

Example II-1

| | |
|---|---|
| Binder resin (II-1) | 100 wt.parts |
| Azo iron complex (1) | 2 wt.parts |
| Magnetic iron oxide particles (1) | 100 wt.parts |
| Long-chain alkyl alcohol A (Table 17) | 5 wt.parts |
| Polyethylene wax (1) (Table 18) | 2 wt.parts |

The above mixture was melt-kneaded through a twin-screw extruder heated at 130° C., and after being cooled, was coarsely crushed by a hammer mill, followed by pulverization by a jet mill and classification by a pneumatic classifier, to obtain Magnetic toner (I-1) having a weight-average particle size (D4) of 6.5 $\mu$m and a volume-average particle size (Dv) of 5.7 $\mu$m.

Magnetic toner (II-1) was subjected to Soxhlet extraction separately with solvents of tetrahydrofuran (THF), ethyl acetate and chloroform to determine soluble contents and insoluble contents for the respective solvents, whereby the toner was found to contain a binder resin composition (exclusive of the wax) having a THF-insoluble content (W2)=33 wt. % including chloroform-insoluble content (W6A)=19 wt. %, an ethyl acetate-insoluble content (W4)=36 wt. % including chloroform-insoluble content (W6B)=22 wt. %, and a total chloroform-insoluble content (W6)=14 wt. %, thus giving a ratio W4/W6=2.6.

As a result of molecular weight distribution measurement by GPC of the THF-insoluble content (W1), it provided a chromatogram exhibiting a main peak molecular weight (Mp)=6100, an areal percentage for a molecular weight range of 500 to below $10^4$ (A1)=47.2%, an areal percentage for a molecular weight range of $10^4$ to below $10^5$ (A2)=28.8% and an areal percentage for a molecular weight range of $10^5$ or larger (A3)=24.0%, giving a ratio (A1/A2)=1.64.

As a result of acid value measurement, the binder resin and the ethyl acetate-insoluble content (W3) exhibited an acid value (AV1)=25.1 mgKOH/g and an acid value (AV2)=20.7 mgKOH/g, giving a ratio (AV1/AV2)=1.2.

As a result of $^1$H-NMR and $^{13}$C-NMR measurement, it was confirmed that the toner contained a vinyl resin, a polyester resin and a hybrid resin component comprising a polyester unit and a vinyl polymer unit.

From the results of $^{13}$C-NMR, ca. 29 mol % of the acrylate charged was formed to be contained in the Hybrid resin component.

The $^{13}$C-NMR measurement results are summarized in the following Table 16, wherein "○" represents the presence and "–" represents the absence.

TABLE 16

| | $^{13}$C-NMR results | | | |
|---|---|---|---|---|
| | Signals for | | | |
| | Newly found | Carboxyl group in succinic acid derivative | | Carboxyl group in acrylate |
| Sample | at ca. 168 ppm | ca. 172 ppm | ca. 174 ppm | ester copolymer ca. 176 ppm |
| Low-crosslinked polyester resin | — | o | o | — |
| Styrene-2-ethyl-hexyl copolymer | — | — | — | o |
| Binder resin (II-1) | o | o | o | o |

From the NMR chart, the proportions Gp and Sp of polyester resin contained the ethyl acetate-insoluble content (W4) and the ethyl acetate-soluble content (W3) of the binder resin, whereby the results showed Gp=ca. 88 wt. %, Sp=ca. 63 wt. % and a ratio Sp/Gp=0.72. Further, ca. 77 wt. % of the succinic acid derivative of Formula (1-3) totally charged was determined to be contained in the ethyl acetate-insoluble content.

The amount of wax contained in the ethyl acetate-insoluble content (W4) could be determined as ca. 68 wt. % of the total wax added to the toner as a result of melting enthalpy determination based on DSC measurement.

Evaluation of Image Forming Performances 100 wt. parts of Magnetic toner (II-1) was blended with 1.2 wt. parts of hydrophobic dry process silica ($S_{BET}$=100 $m^2/g$) surface-treated by dimethylsilicone oil by means of a Henschel mixer to obtain Toner (II-1). Then, Toner (II-1) was subjected to a continuous image forming test on 5000 sheets by using a laser beam printer ("LBP-450", mfd. by Canon K.K.) having a structure as shown in FIG. 12 around a developing device wherein the toner regulating member 44 was abutted against a toner carrying member 42. The results are shown in Table 21 together with the results of evaluation items described below.

Evaluation of Fixability

The fixing device of the laser beam printer ("LBP-430", mfd. by Canon K.K.) was taken out and an external drive mechanism and a temperature controller were attached thereto to provide a fixing test device. By using the test device, an unfixed halftone image carried on plain paper was fixed at temperatures of 120° C. and 200° C., respectively. The fixed image obtained at a fixing temperature of 120° C. was rubbed with soft tissue paper at a load of 4.9 $N/m^2$ (50 $g/cm^2$), whereby an image density lowering percentage (IDLP) after the rubbing was measured relative to the image density before the rubbing. The fixed image at a fixing temperature of 200° C. was observed with eyes with respect to the occurrence of hot offset and evaluated according to the following standard.

A: No hot offset was observed at all.

B: Slight hot offset was observed.

C: Remarkable offset was observed.

Evaluation of Negative Sleeve Ghost

Figure 19:
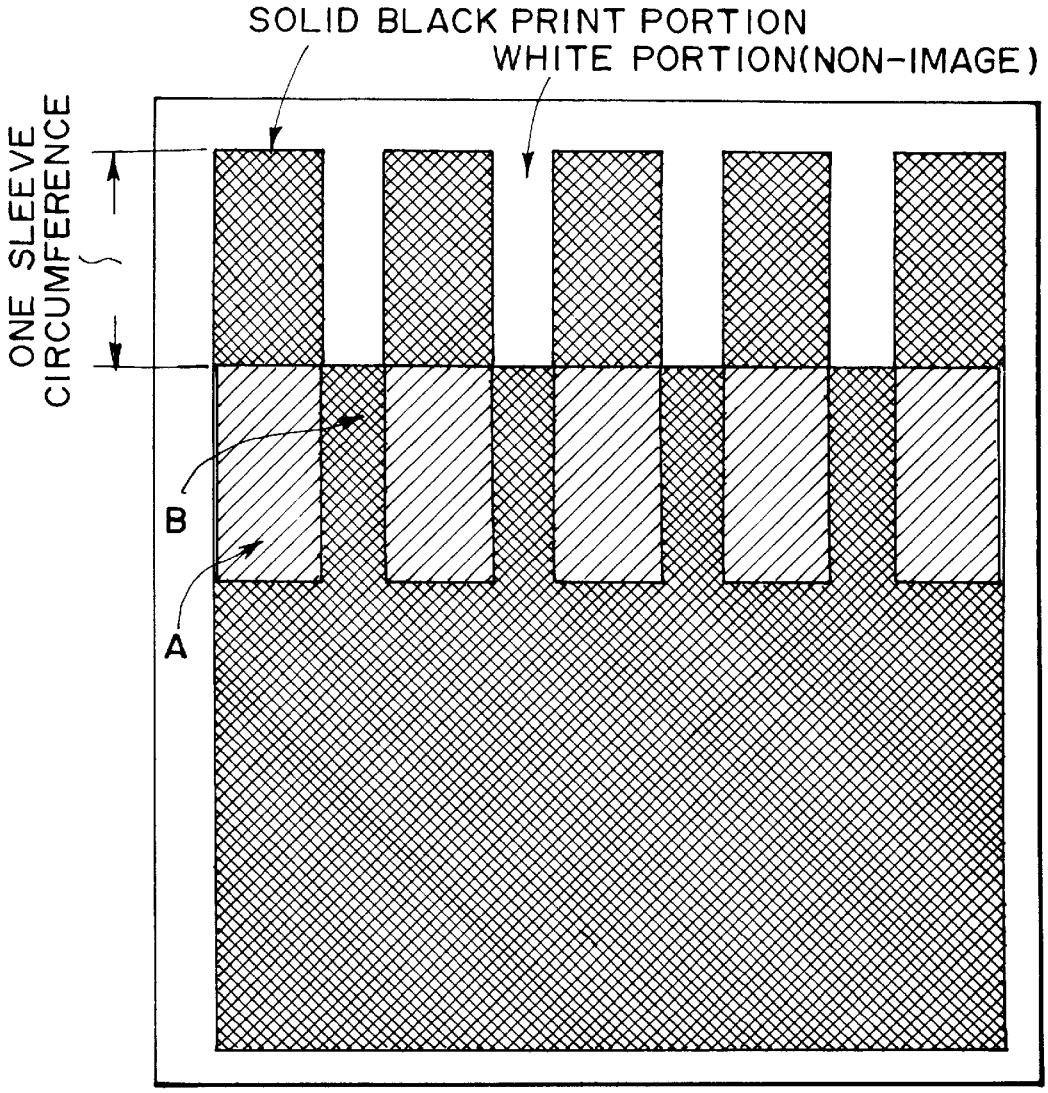
FIG. 19 illustrates a test pattern for negative sleeve ghost.

The test was performed by using a laser beam printer ("LBP430", mfd. by Canon) for reproducing a test pattern as shown in FIG. 19 including separate solid black print portions in a length equal to one circumference length of the sleeve (toner-carrying member) followed by a whole area solid image, to measure a lowering in image density of a portion (A) following a separate solid black print stripe portion relative to the image density of a surrounding solid black portion (B), i.e., the density at B—the density at A.

Pressure Roller Soiling

A continuous image formation on $10^5$ sheets was performed by using a laser beam printer ("LBP-430", mfd. by Canon K.K.) while changing the fixing temperature setting to 170° C. Thereafter, the degree of soiling in the pressure roller was evaluated by eye observation according to the following standard.

A: No soiling at all.

B: Slight soiling occurred.

C: Soling occurred.

Anti-Blocking Performance 50 g of a sample toner was placed in a 100 ml-container and left standing in an environment of 50° C. for 7 days. Thereafter, the flowability of the sample toner is evaluated with eyes according to the following standard.

A: No change in toner flowability.

B: Some agglomerate was observed.

Examples II-2 to II-6

Toners (II-2) to (II-6) having characteristic parameters shown in Tables 19 and 20 were prepared in the same manner as in Example II-1 except for using Binder resins (II-2) to (II-6), respectively, in place of binder resin (II-1). The thus-obtained toners were evaluated in the same manner as in Example II-1, and the results thereof are inclusively shown in Table 21 together with those of the following Examples and Comparative Examples.

Examples II-7 to II-11

Toners (II-7) to (II-11) having characteristic parameters shown in Tables 19 and 20 were prepared and evaluated in the same manner as in Example II-1 except for using Long-chain alkyl compounds B to F, respectively, shown in Table 17 in place of Long-chain alkyl alcohol A used in Example II-1.

Examples II-12 and II-13

Toners (II-12) and (II-13) having characteristic parameters shown in Tables 19 and 20 were prepared and evaluated in the same manner as in Example II-1 except for using Polyethylene wax (2) and Polyethylene wax (3), respectively, shown in Table 18 in place of Polyethylene wax (1).

Examples II-14 and II-15

Toners (II-14) and (II-15) having characteristic parameters shown in Tables 19 and 20 were prepared and evaluated in the same manner as in Example II-1 except for using Hydrocarbon wax (1) produced through the Arge process and Polypropylene wax (1), respectively, shown in Table 18 in place of Polyethylene wax (1).

Examples II-16 to II-20

Toners (II-16) to (II-20) having characteristic parameters shown in Tables 19 and 20 were prepared and evaluated in the same manner as in Example II-1 except for using Magnetic iron oxide particles (2) to (6), respectively, shown in Table 15 in place of Magnetic iron oxide particles (1).

Example II-21

Toner (II-21) having characteristic parameters shown in Tables 19 and 20 was prepared and evaluated in the same manner as in Example II-1 except for using hydrophobic dry-process silica ($S_{BET}$=180 $m^2/g$) surface-treated by dimethyldisilazane in place of the hydrophobic dry process silica treated by dimethylsilicone oil.

Example II-22

Toner (II-22) having characteristic parameters shown in Tables 19 and 20 was prepared and evaluated in the same manner as in Example II-1 except for omitting Polyethylene wax (1).

Example II-23

Toner (II-23) having characteristic parameters shown in Tables 19 and 20 was prepared and evaluated in the same manner as in Example II-1 except for using only 7 wt. parts of Polypropylene wax (1) shown in Table 18 in place of Long-chain alkyl alcohol A and Polypropylene wax (1).

Comparative Examples II-1 to II-6

Comparative Toners (II-1) to (II-6) having characteristic parameters shown in Tables 19 and 20 were prepared and evaluated in the same manner as in Example II-1 except for using Comparative Binder resins (II-1) to (II-6), respectively, in place of binder resin (II-1).

TABLE 17

Long-chain alkyl compounds

| Name | Formula | x | y | R | Mn | Mw | Mw/Mn | Acid value (mg KOH/g) | OH value (mg KOH/g) | Tmp. (° C.) |
|---|---|---|---|---|---|---|---|---|---|---|
| A | (A) | 48 | — | — | 440 | 860 | 1.9 | — | 70 | 102 |
| B | (A) | 40 | — | — | 350 | 670 | 1.9 | — | 85 | 96 |
| C | (A) | 35 | — | — | 290 | 520 | 1.8 | — | 95 | 92 |
| D | (A) | 140 | — | — | 1100 | 2800 | 2.5 | — | 20 | 115 |
| E | (B) | 55 | 2 | H | 690 | 1500 | 2.2 | — | 60 | 103 |
| F | (C) | 50 | — | — | 350 | 950 | 2.7 | 70 | — | 106 |

TABLE 18

Hydrocarbon waxes

| Name | Mn | Mw | Mw/Mn | Tmp (° C.) |
|---|---|---|---|---|
| Polyethylene wax (1) | 670 | 900 | 1.3 | 102 |
| Polyethylene wax (2) | 480 | 770 | 1.6 | 93 |
| Polyethylene wax (3) | 850 | 1150 | 1.4 | 110 |
| Hydrocarbon wax (1)* | 800 | 1350 | 1.7 | 110 |

TABLE 18-continued

| Name | Hydrocarbon waxes Mn | Mw | Mw/Mn | Tmp (° C.) |
|---|---|---|---|---|
| Polypropylene wax (1) | 830 | 3700 | 4.5 | 143 |

*:Hydrocarbon wax synthesized through the Arge process.

TABLE 19

| | THF (tetrahydrofuran) extraction: soluble | | | | | | insoluble | EA * extraction: soluble | | insoluble | Chloroform extraction: sol-uble | insol-uble | Chloroform-insoluble: in THF-insoluble | in EA-insoluble | | | |
|---|---|---|---|---|---|---|---|---|---|---|---|---|---|---|---|---|---|
| | W1 (wt %) | Mp** | A1 | A2 | A3 | A1/A2 | W2 (wt. %) | W3 (wt. %) | acid value (AV2) | W4 (wt. %) | W5 (wt. %) | W6 (wt. %) | W6A (wt. %) | W6B (wt. %) | W6A:W6B | W4/W6 | AV1/AV2 |
| Ex. II-1 | 67 | 6100 | 47.2 | 28.8 | 24.0 | 1.64 | 33 | 64 | 20.7 | 36 | 86 | 14 | 5.9 | 8.1 | 1:1.3 | 2.6 | 1.2 |
| Ex. II-2 | 65 | 6500 | 45.6 | 29.7 | 24.7 | 1.54 | 35 | 61 | 22.1 | 39 | 85 | 15 | 6.8 | 8.2 | 1:1.2 | 2.6 | 1.2 |
| Ex. II-3 | 84 | 4300 | 58.1 | 30.3 | 11.1 | 1.92 | 16 | 75 | 30.7 | 25 | 89 | 11 | 2.9 | 8.1 | 1:2.8 | 2.6 | 1.2 |
| Ex. II-4 | 53 | 8400 | 37.4 | 33.8 | 28.8 | 1.10 | 47 | 48 | 13.1 | 52 | 60 | 40 | 14.8 | 25.2 | 1:1.7 | 1.3 | 1.1 |
| Ex. II-5 | 69 | 7100 | 42.7 | 29.4 | 27.9 | 1.45 | 41 | 52 | 18.8 | 48 | 67 | 33 | 11.5 | 21.5 | 1:1.9 | 1.5 | 1.7 |
| Ex. II-6 | 74 | 7800 | 41.3 | 30.5 | 28.8 | 1.35 | 26 | 67 | 26.3 | 33 | 80 | 20 | 6.2 | 12.8 | 1:2.2 | 1.7 | 1.4 |
| Ex. II-7 | Same as in Ex. II-1 | | | | | | | | | | | | | | | | |
| Ex. II-8 | | | | | | | | | | | | | | | | | |
| Ex. II-9 | | | | | | | | | | | | | | | | | |
| Ex. II-10 | | | | | | | | | | | | | | | | | |
| Ex. II-11 | | | | | | | | | | | | | | | | | |
| Ex. II-12 | | | | | | | | | | | | | | | | | |
| Ex. II-13 | | | | | | | | | | | | | | | | | |
| Ex. II-14 | | | | | | | | | | | | | | | | | |
| Ex. II-15 | | | | | | | | | | | | | | | | | |
| Ex. II-16 | | | | | | | | | | | | | | | | | |
| Ex. II-17 | | | | | | | | | | | | | | | | | |
| Ex. II-18 | | | | | | | | | | | | | | | | | |
| Ex. II-19 | | | | | | | | | | | | | | | | | |
| Ex. II-20 | | | | | | | | | | | | | | | | | |
| Ex. II-21 | | | | | | | | | | | | | | | | | |
| Ex. II-22 | | | | | | | | | | | | | | | | | |
| Ex. II-23 | | | | | | | | | | | | | | | | | |
| Comp. Ex. II-1 | 88 | 3800 | 42.3 | 48.9 | 8.8 | 0.87 | 12 | 90 | 24.4 | 10 | 91 | 9 | 6.9 | 2.1 | 1:0.3 | 1.0 | 0.8 |
| Comp. Ex. II-2 | 46 | 18300 | 16.7 | 46.4 | 34.9 | 0.40 | 54 | 28 | 7.5 | 72 | 52 | 48 | 9.6 | 38.5 | 1:4.0 | 1.3 | 0.8 |
| Comp. Ex. II-3 | 97 | 3100 | 68.9 | 22.0 | 9.1 | 3.13 | 3 | 100 | 19.3 | 0 | 100 | 0 | 0 | 0 | — | — | 0.9 |
| Comp. Ex. II-4 | 48 | 10700 | 36.8 | 41.8 | 21.4 | 0.88 | 54 | 33 | 26.1 | 67 | 51 | 49 | 13.6 | 35.4 | 1:3.6 | 1.3 | 0.8 |
| Comp. Ex. II-5 | 87 | 3700 | 40.6 | 47.7 | 11.7 | 0.85 | 13 | 83 | 42.1 | 17 | 88 | 12 | 10 | 2 | 1:0.2 | 0.2 | 2.5 |
| Comp. Ex. II-6 | 93 | 3600 | 48.1 | 23.3 | 28.6 | 2.06 | 7 | 90 | 46.3 | 10 | 94 | 6 | 1.2 | 4.8 | 1:4 | 0.6 | 3.3 |

*EA = ethyl acetate
**Mp = peak molecular weight

TABLE 20

| | Binder resin | Wax dispersibility H:H1:H2:H3 | Polyester resin: Gp (wt. %) | Sp (wt. %) | Sp/Gp | Hybrid resin: Content (mol %) (Based on acrylate) |
|---|---|---|---|---|---|---|
| Ex. II-1 | II-1 | 1.0:0.9:0.9:1.0 | 91 | 72 | 0.79 | 29 |
| Ex. II-2 | II-2 | 1.0:0.9:1.0:1.0 | 86 | 70 | 0.76 | 31 |
| Ex. II-3 | II-3 | 1.0:1.0:0.9:1.2 | 83 | 42 | 0.51 | 16 |
| Ex. II-4 | II-4 | 1.0:0.8:0.9:1.1 | 81 | 69 | 0.85 | 52 |
| Ex. II-5 | II-5 | 1.0:1.4:1.3:1.5 | 62 | 54 | 0.87 | 48 |
| Ex. II-6 | II-6 | 1.0:1.6:1.7:1.7 | 54 | 33 | 0.61 | 22 |
| Ex. II-7 | II-1 | 1.0:0.9:0.8:0.9 | | | | |

TABLE 20-continued

| | Binder resin | Wax dispersibility H:H1:H2:H3 | Polyester resin Gp (wt. %) | Sp (wt. %) | Sp/Gp | Hybrid resin Content (mol %) (Based on acrylate) |
|---|---|---|---|---|---|---|
| Ex. II-8 | II-1 | 1.0:0.8:0.8:0.8 | | | | |
| Ex. II-9 | II-1 | 1.0:1.2:1.0:1.2 | | | | |
| Ex. II-10 | II-1 | 1.0:1.3:1.1:1.3 | | | | |
| Ex. II-11 | II-1 | 1.0:1.5:1.2:1.5 | | | | |
| Ex. II-12 | II-1 | 1.0:0.8:1.0:1.0 | | | | |
| Ex. II-13 | II-1 | 1.0:1.2:1.3:1.3 | | | | |
| Ex. II-14 | II-1 | 1.0:0.9:0.9:0.9 | | | | |
| Ex. II-15 | II-1 | 1.0:1.4:1.4:1.4 | | Same as in Example II-1 | | |
| Ex. II-16 | II-1 | 1.0:0.9:0.9:1.0 | | | | |
| Ex. II-17 | II-1 | 1.0:0.9:0.9:1.0 | | | | |
| Ex. II-18 | II-1 | 1.0:0.9:0.9:1.0 | | | | |
| Ex. II-19 | II-1 | 1.0:0.9:0.9:1.0 | | | | |
| Ex. II-20 | II-1 | 1.0:0.9:0.9:1.0 | | | | |
| Ex. II-21 | II-1 | 1.0:0.9:0.9:1.0 | | | | |
| Ex. II-22 | II-1 | 1.0:0.9:0.9:1.0 | | | | |
| Ex. II-23 | II-1 | 1.0:0.8:0.7:0.9 | | | | |
| Comp. Ex. II-1 | Comp. II-1 | 1.0:8:11:13 | 13 | 83 | 6.4 | 0 |
| Comp. Ex. II-2 | Comp. II-2 | 1.0:0.3:0.4:0.4 | 99 | 18 | 0.18 | 7 |
| Comp. Ex. II-3 | Comp. II-3 | — | — | 71 | — | 0 |
| Comp. Ex. II-4 | Comp. II-4 | 1.0:0.3:0.4:0.4 | 18 | 19 | 1.06 | 0 |
| Comp. Ex. II-5 | Comp. II-5 | 1.0:0.5:0.4:0.5 | 44 | 78 | 1.77 | 4 |
| Comp. Ex. II-6 | Comp. II-6 | 1.0:3.1:2.6:3.3 | 8 | 56 | 7.00 | 0 |

TABLE 21

| | Image density during continuous image formation initial | final | Negative sleeve ghost | Fixability 120° C. (ILDP) | 200° C. | Pressure roller soiling | Blocking |
|---|---|---|---|---|---|---|---|
| Ex. II-1 | 1.41 | 1.42 | 0.01 | 4.7 | A | A | A |
| Ex. II-2 | 1.41 | 1.41 | 0.01 | 4.5 | A | A | A |
| Ex. II-3 | 1.39 | 1.36 | 0.04 | 7.1 | A | A | A |
| Ex. II-4 | 1.39 | 1.38 | 0.05 | 8.5 | A | A | A |
| Ex. II-5 | 1.39 | 1.37 | 0.03 | 7.2 | A | A | A |
| Ex. II-6 | 1.40 | 1.38 | 0.05 | 6.8 | A | A | A |
| Ex. II-7 | 1.40 | 1.40 | 0.01 | 5.1 | A | A | A |
| Ex. II-8 | 1.41 | 1.39 | 0.01 | 4.0 | A | A | A |
| Ex. II-9 | 1.40 | 1.37 | 0.04 | 6.5 | A | A | A |
| Ex. II-10 | 1.40 | 1.41 | 0.01 | 4.7 | A | A | A |
| Ex. II-11 | 1.41 | 1.39 | 0.03 | 5.8 | A | A | A |
| Ex. II-12 | 1.41 | 1.40 | 0.01 | 3.8 | A | A | A |
| Ex. II-13 | 1.40 | 1.41 | 0.01 | 5.3 | A | A | A |
| Ex. II-14 | 1.40 | 1.40 | 0.01 | 5.5 | A | A | A |
| Ex. II-15 | 1.37 | 1.33 | 0.02 | 6.5 | A | B | A |
| Ex. II-16 | 1.41 | 1.39 | 0.03 | 5.1 | A | A | A |
| Ex. II-17 | 1.40 | 1.38 | 0.03 | 4.5 | A | A | A |
| Ex. II-18 | 1.40 | 1.36 | 0.03 | 4.7 | A | A | A |
| Ex. II-19 | 1.50 | 1.38 | 0.04 | 4.9 | A | A | A |
| Ex. II-20 | 1.37 | 1.37 | 0.04 | 5.1 | A | A | A |
| Ex. II-21 | 1.38 | 1.37 | 0.05 | 5.2 | A | A | A |
| Ex. II-22 | 1.42 | 1.41 | 0.01 | 4.8 | A | B | A |
| Ex. II-23 | 1.32 | 1.30 | 0.08 | 12.3 | A | B | A |
| Comp. Ex. II-1 | 1.20 | 1.05 | 0.09 | 23.0 | C | C | B |
| Comp. Ex. II-2 | 1.39 | 1.37 | 0.03 | 37.0 | A | A | A |
| Comp. Ex. II-3 | 1.27 | 1.16 | 0.08 | 24.2 | C | C | B |
| Comp. Ex. II-4 | 1.38 | 1.38 | 0.08 | 23.1 | B | A | B |
| Comp. Ex. II-5 | 1.26 | 1.15 | 0.03 | 19.2 | B | A | A |
| Comp. Ex. II-6 | 1.28 | 1.16 | 0.03 | 23.7 | B | A | A |

From the above-mentioned results of Examples II-1 to II-23 and Comparative Examples II-1 to II-6 in comparison, the toner according to the present invention using a specific binder resin containing a hybrid resin component comprising a polyester unit and a vinyl polymer unit, especially when it contains a long-chain alkyl compound as a wax, exhibits good fixability, anti-offset performance, anti-blocking property, continuous image-forming performances on a large number of sheets and negative sleeve ghost suppression, because of uniform dispersion of the long-chain alkyl compound in the binder resin.

Series III

Example III-1

| | |
|---|---|
| Binder resin (II-1) | 100 wt.parts |
| Azo iron complex (1)** | 2 wt.parts |
| Magnetic iron oxide particles (1) | 100 wt.parts |
| Polyethylene wax (Tmp = 102° C., Mn = 1000) | 4 wt.parts |

**Containing 91% of $NH_4^+$ and 9% of mixture of $Na^+$ and $H^+$, having a solubility in methanol of 0.88 g/100 ml.

The above mixture was melt-kneaded through a twin-screw extruder heated at 130° C., and after being cooled, was coarsely crushed by a hammer mill, followed by pulverization by a jet mill and classification by a pneumatic classifier, to obtain Magnetic toner (III-1) having a weight-average particle size (D4) of 6.2 μm and a volume-average particle size (Dv) of 5.5 μm.

Magnetic toner (III-1) was subjected to Soxhlet extraction separately with solvents of tetrahydrofuran (THF), ethyl acetate and chloroform to determine soluble contents and insoluble contents for the respective solvents, whereby the toner was found to contain a binder resin composition (exclusive of the wax) having a THF-insoluble content (W2)=33 wt. % including chloroform-insoluble content (W6A)=5.9 wt. %, an ethyl acetate-insoluble content (W4)=36 wt. % including chloroform-insoluble content (W6B)=8.1 wt. %, and a total chloroform-insoluble content (W6)=14 wt. %, thus giving a ratio W4/W6=2.6.

As a result of molecular weight distribution measurement by GPC of the THF-insoluble content (W1), it provided a chromatogram exhibiting a main peak molecular weight (Mp)=6300, an areal percentage for a molecular weight range of 500 to below $10^4$ (A1)=46.8%, an areal percentage for a molecular weight range of $10^4$ to below $10^5$ (A2)=28.5% and an areal percentage for a molecular weight range of $10^5$ or larger (A3)=24.7%, giving a ratio (A1/A2)=1.64.

As a result of acid value measurement, the binder resin and the ethyl acetate-insoluble content (W3) exhibited an acid value (AV1)=24.7 mgKOH/g and an acid value (AV2)=21.0 mgKOH/g, giving a ratio (AV1/AV2)=1.2.

As a result of $^1$H-NMR and $^{13}$C-NMR measurement, it was confirmed that the toner contained a vinyl resin, a polyester resin and a hybrid resin component comprising a polyester unit and a vinyl polymer unit.

From the results of $^{13}$C-NMR, ca. 29 mol % of the acrylate charged was found to be contained in the hybrid resin component.

The $^{13}$C-NMR measurement results are summarized in the following Table 22, wherein "○" represents the presence and "–" represents the absence.

TABLE 22

| | $^{13}$C-NMR results | | | |
|---|---|---|---|---|
| | Signals for | | | |
| | Newly found | Carboxyl group in succinic acid derivative | | Carboxyl group in acrylate |
| Sample | at ca. 168 ppm | ca. 172 ppm | ca. 174 ppm | ester copolymer ca. 176 ppm |
| Low-crosslinked polyester resin | — | ○ | ○ | — |

TABLE 22-continued

| | $^{13}$C-NMR results | | | |
|---|---|---|---|---|
| | Signals for | | | |
| | Newly found | Carboxyl group in succinic acid derivative | | Carboxyl group in acrylate |
| Sample | at ca. 168 ppm | ca. 172 ppm | ca. 174 ppm | ester copolymer ca. 176 ppm |
| Styrene-2-ethyl-hexyl copolymer | — | — | — | ○ |
| Binder resin (I-1) | ○ | ○ | ○ | ○ |

From the NMR chart, the proportions Gp and Sp of polyester resin contained the ethyl acetate-insoluble content (W4) and the ethyl acetate-soluble content (W3) of the binder resin, whereby the results showed Gp=ca. 88 wt. %, Sp=ca. 63 wt. % and a ratio Sp/Gp=0.72. Further, ca. 77 wt. % of the succinic acid derivative of Formula (1-3) totally charged was determined to be contained in the ethyl acetate-insoluble content.

The amount of wax contained in the ethyl acetate-insoluble content (W4) could be determined as ca. 60 wt. % of the total wax added to the toner as a result of melting enthalpy determination based on DSC measurement.

Evaluation of Image Forming Performances 100 wt. parts of Magnetic toner (III-1) was blended with 1.2 wt. parts of hydrophobic dry process silica (SBET=100 $m^2/g$) surface-treated with dimethylsilicone oil by means of a Henschel mixer to obtain Toner (III-1). Then, Toner (III-1) was subjected to a continuous image forming test on 15000 sheets by using a laser beam printer ("LBP-930", mfd. by Canon K.K.) having a structure as shown in FIG. 15 but equipped with a process cartridge including a developing device wherein a toner regulating member 88 was abutted against a toner carrying member 95. The process speed was 106.8 mm/sec. The results are shown in Table 26 together with the results of evaluation items described below.

Evaluation of Fixability

The fixing device of a laser beam printer ("LBP-430", mfd. by Canon K.K.; process speed=48 mm/sec) was taken out and an external drive mechanism and a temperature controller were attached thereto to provide a fixing test device. By using the test device, an unfixed halftone image carried on plain paper was fixed at temperatures of 120° C. and 200° C., respectively. The fixed image obtained at a fixing temperature of 120° C. was rubbed with soft tissue paper at a load of 4.9 $N/m^2$ (50 $g/cm^2$), whereby an image density lowering percentage (IDLP) after the rubbing was measured relative to the image density before the rubbing. The fixed image at a fixing temperature of 200° C. was observed with eyes as to whether hot offset (HO) occurred or not.

Evaluation of Negative Sleeve Ghost

The test was performed by using a laser beam printer ("LBP-450", mfd. by Canon K.K.; process speed=70.7 mm/sec) for reproducing a test pattern as shown in FIG. 19 including separate solid black stripe print portions in a length equal to one circumference length of the sleeve (toner-carrying member) followed by a whole area solid image, to measure a lowering in image density of a portion (A) following a separate solid black print portion relative to the image density of a surrounding solid black portion (B), i.e., the density at B—the density at A.

Anti-Blocking Performance

Blocking test was performed in the following manner.

50 g of a sample toner was placed in a 100 ml-container and left standing in an environment of 50° C. for 7 days. Thereafter, the flowability of the sample toner is evaluated with eyes as to whether the flowability change occurred, or some agglomerate was found therein.

The results of evaluation are summarized in Table 26 together with those of Examples and Comparative Examples described below.

Examples III-2 to III-6

Toners (III-2) to (III-6) having characteristic values as shown in Tables 24 and 25 were prepared and evaluated in the same manner as in Example III-1 except for using Binder resins (II-2) to (II-6), respectively, in place of Binder resin (II-1).

Comparative Example III-1

Comparative Toner (III-1) having characteristic values as shown in Tables 24 and 25 was prepared and evaluated in the same manner as in Example III-1 except for using Comparative Binder resin (II-1) in place of Binder resin (II-1).

Examples III-7 to III-11

Toners (III-7) to (III-11) having characteristic values as shown in Tables 24 and 25 were prepared and evaluated in the same manner as in Example III-1 except for using Azo iron complexes (2), (3) and (7)–(9), respectively, of which the structures have been shown before and the characteristic values are shown in Table 23 below, in place of Azo iron complex (1) used in Example III-1.

Examples III-12 to III-16

Toners (III-12) to (III-16) having characteristic values as shown in Tables 24 and 25 were prepared and evaluated in the same manner as in Example III-1 except for using Magnetic iron oxide particles (2)–(6), respectively, produced in Production Examples 2–6, in place of Magnetic iron oxide particles (1).

Example III-17

Toner (III-17) having characteristic values as shown in Tables 24 and 25 was prepared and evaluated in the same manner as in Example III-1 except for using 1.2 wt. parts of hydrophobic dry-process silica ($S_{BET}$=180 $m^2/g$) surface-treated with hexamethyldisilazane in place of the hydrophobic dry-process silica surface-treated by dimethylsilicone oil.

TABLE 23

| Charge control agents | | |
|---|---|---|
| Azo iron complex | Cations | Solubility in methanol (g/100 ml) |
| (1) | $NH_4^+$: 91%, $Na^+$, $H^+$: 9% | 0.88 |
| (2) | $NH_4^+$: 76%, $Na^+$, $H^+$, $K^+$: 24% | 0.74 |
| (3) | $NH_4^+$: 63%, $Na^+$, $H^+$, $K^+$: 24% | 0.67 |
| (7) | $NH_4^+$: 44%, $Na^+$, $H^+$, $K^+$: 56% | 0.55 |
| (8) | $NH_4^+$: 28%, $H^+$: 72% | 0.21 |
| (9) | $NH_4^+$: 34%, $Na^+$, $H^+$, $K^+$: 66% | 0.35 |

TABLE 24

| | THF (tetrahydrofuran) extraction | | | | | | | EA * extraction | | | Chloroform extraction | | | | | | |
|---|---|---|---|---|---|---|---|---|---|---|---|---|---|---|---|---|---|
| | soluble | | | | | | insoluble | soluble | | | soluble | insoluble | Chloroform-insoluble | | | | |
| | W1 (wt %) | Mp** | A1 | A2 | A3 | A1/A2 | W2 (wt. %) | W3 (wt. %) | acid value (AV2) | W4 (wt. %) | W5 (wt. %) | W6 (wt. %) | in THF-insoluble W6A (wt. %) | in EA-insoluble W6B (wt. %) | W6A:W6B | W4/W6 | AV1/AV2 |
| Ex. III-1 | 67 | 6300 | 46.8 | 28.5 | 24.7 | 1.64 | 33 | 64 | 21.0 | 36 | 86 | 14 | 5.9 | 8.1 | 1:1.4 | 2.6 | 1.2 |
| Ex. III-2 | 65 | 6600 | 45.0 | 30.2 | 24.8 | 1.49 | 35 | 61 | 22.3 | 39 | 85 | 15 | 6.8 | 8.2 | 1:1.2 | 2.6 | 1.2 |
| Ex. III-3 | 84 | 4200 | 58.6 | 30.9 | 10.5 | 1.90 | 16 | 75 | 31.1 | 25 | 89 | 11 | 2.9 | 8.1 | 1:2.8 | 1.5 | 1.4 |
| Ex. III-4 | 53 | 8500 | 36.7 | 33.5 | 29.8 | 1.10 | 47 | 48 | 13.6 | 52 | 60 | 40 | 14.8 | 25.2 | 1:1.7 | 1.3 | 1.1 |
| Ex. III-5 | 69 | 7100 | 42.5 | 29.8 | 27.7 | 1.43 | 41 | 52 | 19.0 | 48 | 67 | 33 | 11.5 | 21.5 | 1:1.9 | 1.5 | 1.7 |
| Ex. III-6 | 74 | 7700 | 42.2 | 30.9 | 26.9 | 1.37 | 26 | 67 | 27.0 | 33 | 80 | 20 | 6.2 | 12.8 | 1:2.2 | 1.7 | 1.4 |
| Comp. Ex. III-1 | 88 | 3700 | 44.1 | 49.2 | 6.7 | 0.90 | 12 | 90 | 24.8 | 10 | 91 | 9 | 6.9 | 2.1 | 1:0.3 | 1.0 | 0.8 |
| Ex. III-7 | Same as in Example III-1 | | | | | | | | | | | | | | | | |
| Ex. III-8 | | | | | | | | | | | | | | | | | |
| Ex. III-9 | | | | | | | | | | | | | | | | | |
| Ex. III-10 | | | | | | | | | | | | | | | | | |
| Ex. III-11 | | | | | | | | | | | | | | | | | |
| Ex. III-12 | | | | | | | | | | | | | | | | | |
| Ex. III-13 | | | | | | | | | | | | | | | | | |
| Ex. III-14 | | | | | | | | | | | | | | | | | |
| Ex. III-15 | | | | | | | | | | | | | | | | | |
| Ex. III-16 | | | | | | | | | | | | | | | | | |
| Ex. III-17 | | | | | | | | | | | | | | | | | |

*EA = ethyl acetate

**Mp = peak molecular weight

TABLE 25

| | Binder resin | Wax dispersibility H:H1:H2:H3 | Polyester resin Gp (wt. %) | Polyester resin Sp (wt. %) | Polyester resin Sp/Gp | Hybrid resin Content (mol %) (Based on acrylate) |
|---|---|---|---|---|---|---|
| Ex. III-1 | II-1 | 1.0:0.9:0.9:1.0 | 91 | 72 | 0.79 | 29 |
| Ex. III-2 | II-2 | 1.0:0.9:1.0:1.0 | 86 | 70 | 0.76 | 31 |
| Ex. III-3 | II-3 | 1.0:1.0:0.9:1.2 | 83 | 42 | 0.51 | 16 |
| Ex. III-4 | II-4 | 1.0:0.8:0.9:1.1 | 81 | 69 | 0.85 | 52 |
| Ex. III-5 | II-5 | 1.0:1.4:1.3:1.5 | 62 | 54 | 0.87 | 48 |
| Ex. III-6 | II-6 | 1.0:1.6:1.7:1.7 | 54 | 33 | 0.61 | 22 |
| Comp. Ex. III-1 | Comp. III-1 | 1.0:8:11:13 | 13 | 83 | 6.4 | 0 |
| Ex. III-7 | II-1 | Same as in Example III-1 | | | | |
| Ex. III-8 | II-1 | | | | | |
| Ex. III-9 | II-1 | | | | | |
| Ex. III-10 | II-1 | | | | | |
| Ex. III-11 | II-1 | | | | | |
| Ex. III-12 | II-1 | | | | | |
| Ex. III-13 | II-1 | | | | | |
| Ex. III-14 | II-1 | | | | | |
| Ex. III-15 | II-1 | | | | | |
| Ex. III-16 | II-1 | | | | | |
| Ex. III-17 | II-1 | | | | | |

TBLE 26

| | Image density during continuous image formation LBP-930 initial | LBP-930 final | Negative sleeve ghost | Fixability ILDP at 120° C. | Fixability Hot offset at 200° C. | Blocking (50° C., 7 days) |
|---|---|---|---|---|---|---|
| Ex. III-1 | 1.41 | 1.41 | 0.01 | 5.1% | none | no change |
| Ex. III-2 | 1.40 | 1.42 | 0.01 | 5.6 | none | no change |
| Ex. III-3 | 1.38 | 1.36 | 0.04 | 7.2 | none | no change |
| Ex. III-4 | 1.35 | 1.33 | 0.05 | 7.3 | none | no change |
| Ex. III-5 | 1.35 | 1.32 | 0.05 | 7.8 | none | no change |
| Ex. III-6 | 1.37 | 1.35 | 0.04 | 6.7 | none | no change |
| Comp. Ex. III-1 | 1.13 | 1.10 | 0.10 | 29.4 | slight | slight ogglomerate |
| Ex. III-7 | 1.39 | 1.41 | 0.02 | 5.5 | none | no change |
| Ex. III-8 | 1.35 | 1.38 | 0.02 | 5.4 | none | no change |
| Ex. III-9 | 1.30 | 1.32 | 0.04 | 5.6 | none | no change |
| Ex. III-10 | 1.28 | 1.30 | 0.05 | 5.8 | none | no change |
| Ex. III-11 | 1.25 | 1.27 | 0.07 | 5.7 | none | no change |
| Ex. III-12 | 1.28 | 1.29 | 0.09 | 5.3 | none | no change |
| Ex. III-13 | 1.35 | 1.36 | 0.07 | 5.9 | none | no change |
| Ex. III-14 | 1.36 | 1.36 | 0.06 | 5.1 | none | no change |
| Ex. III-15 | 1.34 | 1.37 | 0.08 | 5.5 | none | no change |
| Ex. III-16 | 1.22 | 1.23 | 0.13 | 5.7 | none | no change |
| Ex. III-17 | 1.30 | 1.33 | 0.15 | 5.4 | none | no change |

From the above-mentioned results of Examples III-1 to III-17 and Comparative Example III-1 in comparison, the toner according to the present invention using a specific binder resin containing a hybrid resin component comprising a polyester unit and a vinyl polymer unit, especially when it contains a specific azo iron complex as a charge control agent, exhibits good fixability, anti-offset performance, anti-blocking property, continuous image-forming performances on a large number of sheets, and negative sleeve ghost suppression effect, because of uniform dispersion of the azo metal complex in the binder resin.

What is claimed is:

1. A toner, comprising: at least a binder resin, a colorant, and a wax;

wherein the binder resin is characterized by (a) comprising a polyester resin, a vinyl resin and a hybrid resin component comprising a polyester unit and a vinyl polymer unit, (b) having a THF (tetrahydrofuran)-soluble content (W1) of 50–85 wt. % and a THF-insoluble content (W2) of 5–50 wt. %, after 10 hours of Soxhlet extraction with THF, (c) having an ethyl acetate-soluble content (W3) of 40–98 wt. % and an ethyl acetate-insoluble content (W4) of 2–60 wt. %, after 10 hours of Soxhlet extraction with ethyl acetate, (d) having a chloroform-soluble content (W5) of 55–90 wt. % and a chloroform-insoluble content (W6) of 10–45 wt. %, after 10 hours of Soxhlet extraction with chloroform, (e) showing a ratio W4/S6 of 1.1–4.0, and (f) containing a THF-soluble content providing a GPC (gel permeation chromatography) chromatogram exhibiting a main peak in a molecular weight range of 4000–9000, including 35.0–65.0% (A1) of a component haing molecular weight range of 500 to below $1\times10^4$, 25.0–45.0% (A2) of a component having molecular weights in a range of $1\times10^4$ to below $1\times10^5$ and 10.0–30.0% (A3) of a component having molecular weights of at least $1\times10^5$ giving a ratio A1/A2 of 1.05–2.00.

2. The toner according to claim 1, wherein the polyester resin and the polyester unit in the binder resin have a crosslinked structure formed with a polybasic carboxylic acid having three or more carboxyl groups or its anhydride, or a polyhydric alcohol having three or more hydroxyl groups.

3. The toner according to claim 1, wherein the vinyl resin and the vinyl polymer unit in the binder resin have a crosslinked structure formed with a crosslinking agent having two or more vinyl groups.

4. The toner according to claim 1, wherein the binder resin has a THF-insoluble content (W2) of 20–45 wt. %.

5. The toner according to claim 1, wherein the binder resin has a THF-insoluble content (W2) of 25–40 wt. %.

6. The toner according to claim 1, wherein the binder resin has an ethyl acetate-insoluble content (W4) of 5–50 wt. %.

7. The toner according to claim 1, wherein the binder resin has an ethyl acetate-insoluble content (W4) of 10–40 wt. %.

8. The toner according to claim 1, wherein the binder resin has a chloroform-insoluble content (W6) of 15–40 wt. %.

9. The toner according to claim 1, wherein the binder resin has a chloroform-insoluble content (W6) of 17–37 wt. %.

10. The toner according to claim 1, wherein the binder resin has a ratio (W4/W6) of 1.2–3.5 between the ethyl acetate-insoluble content (W4) and the chloroform-insoluble content (W6).

11. The toner according to claim 1, wherein the binder resin has a ratio (W4/W6) of 1.5–3.0 between the ethyl acetate-insoluble content (W4) and the chloroform-insoluble content (W6).

12. The toner according to claim 1, wherein the THF-insoluble content (W2) contains a chloroform-insoluble content (W6A), and the ethyl acetate-insoluble content (W4) contains a chloroform-insoluble content (W6B), satisfying the following conditions:

$$3\text{ wt. }\% \leqq W6A \leqq 25\text{ wt. }\%,$$

$$7\text{ wt. }\% \leqq W6B \leqq 30\text{ wt. }\%,$$

$$10\text{ wt. }\% \leqq W6A+W6B \leqq 45\text{ wt. }\%,$$

and $$W6B/W6A=1\text{–}3.$$

13. The toner according to claim 1, wherein the THF-insoluble content (W2) contains a chloroform-insoluble content (W6A), and the ethyl acetate-insoluble content (W4) contains a chloroform-insoluble content (W6B), satisfying the following conditions:

$$5\text{ wt. }\% \leqq W6A \leqq 20\text{ wt. }\%,$$

$$10\text{ wt. }\% \leqq W6B \leqq 25\text{ wt. }\%,$$

$$15\text{ wt. }\% \leqq W6A+W6B \leqq 40\text{ wt. }\%,$$

and $$W6B/W6A=1.5\text{–}2.5.$$

14. The toner according to claim 1, wherein the THF-soluble content (W1) exhibits GPC molecular weight distribution showing a peak in a molecular weight range of 5000–8500.

15. The toner according to claim 1, wherein the THF-soluble content (W1) exhibits GPC molecular weight distribution showing a peak in a molecular weight range of 5000–8000.

16. The toner according to claim 1, wherein the THF-soluble content (W1) contains a component having molecular weights of 500 to below $10^4$ at a content (A1) of 37.0–60.0% based on GPC.

17. The toner according to claim 1, wherein the THF-soluble content (W1) contains a component having molecular weights of 500 to below $10^4$ at a content (A1) of 40.0–50.0% based on GPC.

18. The toner according to claim 1, wherein the THF-soluble content (W1) contains a component having molecular weights of $10^4$ to below $10^5$ at a content (A2) of 27.0–42.0% based on GPC.

19. The toner according to claim 1, wherein the THF-soluble content (W1) contains a component having molecular weights of $10^4$ to below $10^5$ at a content (A2) of 30.0–40.0% based on GPC.

20. The toner according to claim 1, wherein the THF-soluble content (W1) contains a component having molecular weights of at least $10^6$ at a content (A3) of 12.0–25.0% based on GPC.

21. The toner according to claim 1, wherein the THF-soluble content (W1) contains a component having molecular weights of at least $10^6$ at a content (A3) of 15.0–20.0% based on GPC.

22. The toner according to claim 1, wherein the THF-soluble content (W1) contains a component having molecular weights of 500 to below $10^4$ at a content A1 and a component having molecular weights of $10^4$ to below $10^5$ at a content A2 giving a ratio A1/A2 of 1.10–1.90.

23. The toner according to claim 1, wherein the THF-soluble content (W1) contains a component having molecular weights of 500 to below $10^4$ at a content A1 and a component having molecular weights of $10^4$ to below $10^5$ at a content A2 giving a ratio A1/A2 of 1.15–1.80.

24. The toner according to claim 1, wherein the hybrid resin component comprises the vinyl polymer unit and the polyester unit bonded to each other via a —CO.O— bond or a —CO.O.CO— bond.

25. The toner according to claim 1, wherein the hybrid resin component is a copolymer formed through transesterification between a polyester resin and a vinyl polymer comprising polymerized units having a carbozylate ester group.

26. The toner according to claim 1, wherein the hybrid resin component comprises a graft polymer comprising the vinyl polymer unit as a trunk polymer and the polyester unit as a graft polymer unit.

27. The toner according to claim 25, wherein the hybrid resin component is contained in the binder resin in a proportion of providing a carboxylate exchange rate of 10–60 mol. %.

28. The toner according to claim 25, wherein the hybrid resin component is contained in the binder resin in a proportion of providing a carboxylate exchange rate of 15–55 mol. %.

29. The toner according to claim 1, wherein the ethyl acetate-insoluble content (W4) of the binder resin contains a polyester resin at a concentration (Gp) of 40–98 wt. %, the ethyl acetate-soluble content (W3) of the binder resin contains a polyester resin at a concentration (Sp) of 20–90 wt. % giving a ratio Sp/Gp of 0.5–1.0, and the wax comprises a hydrocarbon wax.

30. The toner according to claim 29, wherein the ethyl acetate-insoluble content (W4) of the binder resin contains a polyester resin at a concentration (Gp) of 55–95 wt. %.

31. The toner according to claim 29, wherein the ethyl acetate-insoluble content (W4) of the binder resin contains a polyester resin at a concentration (Gp) of 60–90 wt. %.

32. The toner according to claim 29, wherein the ethyl acetate-soluble content (W3) of the binder resin contains a polyester resin at a concentration (Sp) of 25–85 wt. %.

33. The toner according to claim 29, wherein the ethyl acetate-soluble content (W3) of the binder resin contains a polyester resin at a concentration (Sp) of 30–80 wt. %.

34. The toner according to claim 29, wherein the ratio Sp/Gp is 0.60–0.95.

35. The toner according to claim 29, wherein the ratio Sp/Gp is 0.65–0.90.

36. The toner according to claim 1, wherein the binder resin has an acid value (AV1) of 7–40 mgKOH/g.

37. The toner according to claim 1, wherein the binder resin has an acid value (AV1) of 10–37 mgKOH/g.

38. The toner according to claim 1, wherein the ethyl acetate-soluble content (W3) has an acid value (AV2) of 10–45 mgKOH/g.

39. The toner according to claim 1, wherein the ethyl acetate-soluble content (W3) has an acid value (AV2) of 15–45 mgKOH/g.

40. The toner according to claim 1, wherein the binder resin has an acid value (AV1) and the ethyl acetate-soluble content (W3) has an acid value (AV2) giving a ratio AV1/AV2 of 0.7–2.0.

41. The toner according to claim 1, wherein the binder resin has an acid value (AV1) and the ethyl acetate-soluble content (W3) has an acid value (AV2) giving a ratio AV1/AV2 of 1.0–1.5.

42. The toner according to claim 1, wherein the wax has a melting point of 70–140° C. in terms of a heat-absorption peak temperature on temperature increase by differential scanning calorimetry.

43. The toner according to claim 42, wherein the wax has a melting point of 80–135° C.

44. The toner according to claim 42, wherein the wax has a melting point of 90–130° C.

45. The toner according to claim 1, wherein the binder resin has been produced in the presence of a wax.

46. The toner according to claim 1, wherein the wax comprises at least one species of long-chain alkyl compound represented by the following formulae (A), (B) or (C):

(A)

$$CH_3\text{-}(CH_2)_x\text{-}CH_2OH,$$

wherein x denotes an average number of the range of 35–150;

(B)

$$CH_3\text{-}(CH_2)_x\text{-}O\text{-}(CH(R)CH_2\text{-}O)_y\text{-}H,$$

wherein x denotes an average number in the range of 35–150, y denotes an average number in the range of 1–5, and R denotes a hydrogen atom or an alkyl group having 1–10 carbon atoms; and (C)

$$CH_3\text{-}(CH_2)_x\text{-}CH_2COOH,$$

wherein x denotes an average number in the range of 35–150.

47. The toner according to claim 46, wherein the toner further contains a hydrocarbon wax or a petroleum wax.

48. The toner according to claim 46, wherein the long-chain alkyl compound has a molecular weight distribution according to GPC showing a number-average molecular weight (Mn) of 200–2500, a weight-average molecular weight (Mw) of 400–5000, and a ratio Mw/Mn of at most 3.

49. The toner according to claim 46, wherein the long-chain alkyl compound is one represented by the formula (A) or (B) and has an OH value of 2–150 mgKOH/g.

50. The toner according to claim 49, wherein the long-chain alkyl compound has an OH value of 10–120 mgKOH/g.

51. The toner according to claim 46, wherein the long-chain alkyl compound is one represented by the formula (C) and has an acid value of 2–150 mgKOH/g.

52. The toner according to claim 51, wherein the long-chain alkyl compound has an acid value of 5–120 mgKOH/g.

53. The toner according to claim 46, wherein the long-chain alkyl compound has a melting point of 70–140° C. in terms of a heat-absorption peak temperature on temperature increase by differential scanning calorimetry.

54. The toner according to claim 53, wherein the wax has a melting point of 80–135° C.

55. The toner according to claim 53, wherein the wax has a melting point of 90–130° C.

56. The toner according to claim 47, wherein the hydrocarbon wax or petroleum wax has a melting point of 70–140° C. in terms of a heat-absorption peak temperature on temperature increase by differential scanning calorimetry.

57. The toner according to claim 56, wherein the hydrocarbon wax or petroleum has a melting point of 80–135° C.

58. The toner according to claim 56, wherein the hydrocarbon wax or petroleum wax has a melting point of 90–130° C.

59. The toner according to claim 47, wherein the hydrocarbon wax or petroleum wax has a GPC molecular weight distribution showing a ratio Mw/Mn of 1 to 3 between weight-average molecular weight (Mw) and number-average molecular weight (Mn).

60. The toner according to claim 1, wherein the toner contains a charge control agent comprising an azo metal complex represented by the following formula (1):

(1)

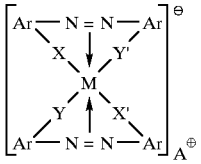

wherein M denotes a coordination center metal selected from the group consisting of Mn, Fe, Ti and Al; Ar denotes an aryl group capable of having a substituent, selected from nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $A^+$ denotes hydrogen, sodium, potassium, ammonium or aliphatic ammonium.

61. The toner according to claim 60, wherein the toner contains a charge control agent comprising an azo iron complex represented by the following formula (2):

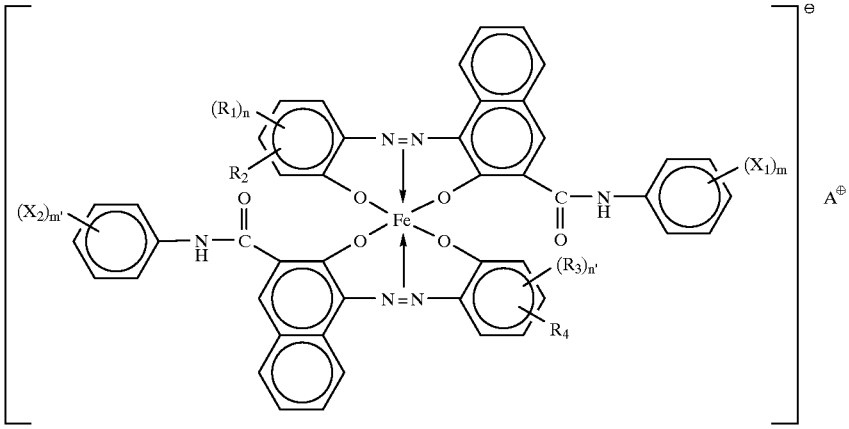

(2)

wherein $X_1$ and $X_2$ independently denote hydrogen atom, lower alkyl group, lower alkoxy group, nitro group or halogen atom; m and m' denote an integer of 1–3; $R_1$ and $R_3$ independently denote hydrogen atom, $C_{1-18}$ alkyl or alkenyl, sulfonamide, mesyl, sulfonic acid group, carboxy ester group, hydroxy, $C_{1-18}$ alkoxy, acetylamino, benzoylamino or halogen atom; n and n' denote an integer of 1–3; $R_2$ and $R_4$ denote hydrogen atom or nitro group; and $A^{\oplus}$ denotes hydrogen ion, sodium ion, potassium ion, ammonium ion or a mixture of these ions.

62. The toner according to claim 61, wherein the cation $A^{\oplus}$ in the formula (2) comprises 75–98 mol. % of ammonium ion, and the remainder of hydrogen ion, sodium ion, potassium ion or a mixture of these ions.

63. The toner according to claim 61, wherein the azo iron complex has a solubility in methanol of 0.1–8 g/100 ml.

64. The toner according to claim 61, wherein the azo iron complex has a solubility in methanol of 0.3–4 g/100 ml.

65. The toner according to claim 61, wherein the azo iron complex has a solubility in methanol of 0.4–2 g/100 ml.

66. The toner according to claim 1, wherein the colorant comprises at least magnetic iron oxide particles.

67. The toner according to claim 66, wherein the toner contains 10–200 wt. parts of the magnetic iron oxide particles per 100 wt. parts of the binder resin.

68. The toner according to claim 66, wherein the magnetic iron oxide particles have a sphericity (ϕ) of at least 0.8.

69. The toner according to claim 68, wherein the magnetic iron oxide particles contain silicon.

70. The toner according to claim 69, wherein the magnetic iron oxide particles have such a silicon distribution as to provide a silicon content B contained up to an iron distribution of 20 wt. % with respect to the total silicon content A in the magnetic iron oxide giving a percentage (B/A)×100=44–84% and a silicon content C at the surface of the magnetic iron oxide particles giving a percentage (C/A)×100=10–55%.

71. The toner according to claim 1, wherein the toner is in mixture with hydrophobized silica fine powder externally added thereto.

72. The toner according to claim 71, wherein the silica fine powder has been hydrophobized by treatment with silicone oil.

73. The toner according to claim 71, wherein the toner has a weight-average particle size of 3–9 μm.

74. An image forming method, comprising:

a developing step of developing an electrostatic latent image held on an image-bearing member with a toner to form a toner image on the image-bearing member, a transfer step of transferring the toner image on the image-bearing member onto a recording material via or without via an intermediate transfer member, and a fixing step of fixing the toner image onto the recording material by a heat-fixing means, wherein the toner comprises at least a binder resin, a colorant, and a wax; and the binder resin is characterized by (a) comprising a polyester resin, a vinyl resin and a hybrid resin component comprising a polyester unit and a vinyl polymer unit, (b) having a THF (tetrahydrofuran)-soluble content (W1) of 50–85 wt. % and a THF-insoluble content (W2) of 5–50 wt. %, after 10 hours of Soxhlet extraction with THF, (c) having an ethyl acetate-soluble content (W3) of 40–98 wt. % and an ethyl acetate-insoluble content (W4) of 2–60 wt. %, after 10 hours of Soxhlet extraction with ethyl acetate, (d) having a chloroform-soluble content (W5) of 55–90 wt. % and a chloroform-insoluble content (W6) of 10–45 wt. %, after 10 hours of Soxhlet extraction with chloroform, (e) showing a ratio W4/S6 of 1.1–4.0, and (f) containing a THF-soluble content providing a GPC (gel permeation chromatography) chromatogram exhibiting a main peak in a molecular weight range of 4000–9000, including 35.0–65.0% (A1) of a component haing molecular weights in a range of 500 to below $1\times10^4$, 25.0–45.0% (A2) of a component having molecular weights in a range of $1\times10^4$ to below $1\times10^5$ and 10.0–30.0% (A3) of a component having molecular weights of at least $1\times10^5$ giving a ratio A1/A2 of 1.05–2.00.

75. The method according to claim 74, wherein the polyester resin and the polyester unit in the binder resin have a crosslinked structure formed with a polybasic carboxylic acid having three or more carboxyl group or its anhydride, or a polyhydric alcohol having three or more hydroxyl groups.

76. The method according to claim 74, wherein the vinyl resin and the vinyl polymer unit in the binder resin have a crosslinked structure formed with a crosslinking agent having two or more vinyl groups.

77. The method according to claim 74, wherein the binder resin has a THF-insoluble content (W2) of 20–45 wt. %.

78. The method according to claim 74, wherein the binder resin has a THF-insoluble content (W2) of 25–40 wt. %.

79. The method according to claim 74, wherein the binder resin has an ethyl acetate-insoluble content (W4) of 5–50 wt. %.

80. The method according to claim 74, wherein the binder resin has an ethyl acetate-insoluble content (W4) of 10–40 wt. %.

81. The method according to claim 74, wherein the binder resin has a chloroform-insoluble content (W6) of 15–40 wt. %.

82. The method according to claim 74, wherein the binder resin has a chloroform-insoluble content (W6) of 17–37 wt. %.

83. The method according to claim 74, wherein the binder resin has a ratio (W4/W6) of 1.2–3.5 between the ethyl acetate-insoluble content (W4) and the chloroform-insoluble content (W6).

84. The method according to claim 74, wherein the binder resin has a ratio (W4/W6) of 1.5–3.0 between the ethyl acetate-insoluble content (W4) and the chloroform-insoluble content (W6).

85. The method according to claim 74, wherein the THF-insoluble content (W2) contains a chloroform-insoluble content (W6A), and the ethyl acetate-insoluble content (W4) contains a chloroform-insoluble content (W6B), satisfying the following conditions:

$$3 \text{ wt. } \% \leqq W6A \leqq 25 \text{ wt. } \%,$$

$$7 \text{ wt. } \% \leqq W6B \leqq 30 \text{ wt. } \%,$$

$$10 \text{ wt. } \% \leqq W6A + W6B \leqq 45 \text{ wt. } \%,$$

and $$W6B/W6A = 1\text{–}3.$$

86. The method according to claim 74, wherein the THF-insoluble content (W2) contains a chloroform-insoluble content (W6A), and the ethyl acetate-insoluble content (W4) contains a chloroform-insoluble content (W6B), satisfying the following conditions:

$$5 \text{ wt. } \% \leqq W6A \leqq 20 \text{ wt. } \%,$$

$$10 \text{ wt. } \% \leqq W6B \leqq 25 \text{ wt. } \%,$$

$$15 \text{ wt. } \% \leqq W6A + W6B \leqq 40 \text{ wt. } \%,$$

and $$W6B/W6A = 1.5\text{–}2.5.$$

87. The method according to claim 74, wherein the THF-soluble content (W1) exhibits GPC molecular weight distribution showing a peak in a molecular weight range of 5000–8500.

88. The method according to claim 74, wherein the THF-soluble content (W1) exhibits GPC molecular weight distribution showing a peak in a molecular weight range of 5000–8000.

89. The method according to claim 74, wherein the THF-soluble content (W1) contains a component having molecular weights of 500 to below $10^4$ at a content (A1) of 37.0–60.0% based on GPC.

90. The method according to claim 74, wherein the THF-soluble content (W1) contains a component having molecular weights of 500 to below $10^4$ at a content (A1) of 40.0–50.0% based on GPC.

91. The method according to claim 74, wherein the THF-soluble content (W1) contains a component having molecular weights of $10^4$ to below $10^5$ at a content (A2) of 27.0–42.0% based on GPC.

92. The method according to claim 74, wherein the THF-soluble content (W1) contains a component having molecular weights of $10^4$ to below $10^5$ at a content (A2) of 30.0–40.0% based on GPC.

93. The method according to claim 74, wherein the THF-soluble content (W1) contains a component having molecular weights of at least $10^6$ at a content (A3) of 12.0–25.0% based on GPC.

94. The method according to claim 74, wherein the THF-soluble content (W1) contains a component having molecular weights of at least $10^6$ at a content (A3) of 15.0–20.0% based on GPC.

95. The method according to claim 74, wherein the THF-soluble content (W1) contains a component having molecular weights of 500 to below $10^4$ at a content A1 and a component having molecular weights of $10^4$ to below $10^5$ at a content A2 giving a ratio A1/A2 of 1.10–1.90.

96. The method according to claim 74, wherein the THF-soluble content (W1) contains a component having molecular weights of 500 to below $10^4$ at a content A1 and a component having molecular weights of $10^4$ to below $10^5$ at a content A2 giving a ratio A1/A2 of 1.15–1.80.

97. The method according to claim 74, wherein the hybrid resin component comprises the vinyl polymer unit and the polyester unit bonded to each other via a —CO.O— bond or a —CO.O.CO— bond.

98. The method according to claim 74, wherein the hybrid resin component is a copolymer formed through transesterification between a polyester resin and a vinyl polymer comprising polymerized units having a carboxylate ester group.

99. The method according to claim 74, wherein the hybrid resin component comprises a graft polymer comprising the vinyl polymer unit as a trunk polymer and the polyester unit as a graft polymer unit.

100. The method according to claim 99, wherein the hybrid resin component is contained in the binder resin in a proportion of providing a carboxylate exchange range of 10–60 mol. %.

101. The method according to claim 99, wherein the hybrid resin component is contained in the binder resin in a proportion of providing a carboxylate exchange rate of 15–55 mol. %.

102. The method according to claim 74, wherein the ethyl acetate-insoluble content (W4) of the binder resin contains a polyester resin at a concentration (Gp) of 40–98 wt. %, the ethyl acetate-soluble content (W3) of the binder resin contains a polyester resin at a concentration (Sp) of 20–90 wt. % giving a ratio Sp/Gp of 0.5–1.0, and the wax comprises a hydrocarbon wax.

103. The method according to claim 102, wherein the ethyl acetate-insoluble content (W4) of the binder resin contains a polyester resin at a concentration (Gp) of 55–95 wt. %.

104. The method according to claim 102, wherein the ethyl acetate-insoluble content (W4) of the binder resin contains a polyester resin at a concentration (Gp) of 60–90 wt. %.

105. The method according to claim 102, wherein the ethyl acetate-soluble content (W3) of the binder resin contains a polyester resin at a concentration (Sp) of 25–85 wt. %.

106. The method according to claim 102, wherein the ethyl acetate-soluble content (W3) of the binder resin contains a polyester resin at a concentration (Sp) of 30–80 wt. %.

107. The method according to claim 102, wherein the ratio Sp/Gp is 0.60–0.95.

108. The method according to claim 102, wherein the ratio Sp/Gp is 0.65–0.90.

109. The method according to claim 74, wherein the binder resin has an acid value (AV1) of 7–40 mgKOH/g.

110. The method according to claim 74, wherein the binder resin has an acid value (AV1) of 10–37 mgKOH/g.

111. The method according to claim 74, wherein the ethyl acetate-soluble content (W3) has an acid value (AV2) of 10–45 mgKOH/g.

112. The method according to claim 74, wherein the ethyl acetate-soluble content (W3) has an acid value (AV2) of 15–45 mgKOH/g.

113. The method according to claim 74, wherein the binder resin has an acid value (AV1) and the ethyl acetate-soluble content (W3) has an acid value (AV2) giving a ratio AV1/AV2 of 0.7–2.0.

114. The method according to claim 74, wherein the binder resin has an acid value (AV1) and the ethyl acetate-soluble content (W3) has an acid value (AV2) giving a ratio AV1/AV2 of 1.0–1.5.

115. The method according to claim 74, wherein the wax has a melting point of 70–140° C. in terms of a heat-absorption peak temperature on temperature increase by differential scanning calorimetry.

116. The method according to claim 115, wherein the wax has a melting point of 80–135° C.

117. The method according to claim 115, wherein the wax has a melting point of 90–130° C.

118. The method according to claim 74, wherein the binder resin has been produced in the presence of a wax.

119. The method according to claim 74, wherein the wax comprises at least one species of long-chain alkyl compound represented by the following formulae (A), (B) or (C):

$$CH_3\text{-}(CH_2)_x\text{-}CH_2OH, \quad (A)$$

wherein x denotes an average number of the range of 35–150;

$$CH_3\text{-}(CH_2)_x\text{-}O\text{-}(CH(R)CH_2\text{-}O)_y\text{-}H, \quad (B)$$

wherein x denotes an average number in the range of 35–150, y denotes an average number in the range of 1–5, and R denotes a hydrogen atom or an alkyl group having 1–10 carbon atoms; and $$CH_3\text{-}(CH_2)_x\text{-}CH_2COOH, \quad (C)$$

wherein x denotes an average number in the range of 35–150.

120. The method according to claim 119, wherein the toner further contains a hydrocarbon wax or a petroleum wax.

121. The method according to claim 119, wherein the long-chain alkyl compound has a molecular weight distribution according to GPC showing a number-average molecular weight (Mn) of 200–2500, a weight-average molecular weight (Mw) of 400–5000, and a ratio Mw/Mn of at most 3.

122. The method according to claim 119, wherein the long-chain alkyl compound is one represented by the formula (A) or (B) and has an OH value of 2–150 mgKOH/g.

123. The method according to claim 122, wherein the long-chain alkyl compound has an OH value of 10–120 mgKOH/g.

124. The method according to claim 119, wherein the long-chain alkyl compound is one represented by the formula (C) and has an acid value of 2–150 mgKOH/g.

125. The method according to claim 124, wherein the long-chain alkyl compound has an acid value of 5–120 mgKOH/g.

126. The method according to claim 119, wherein the long-chain alkyl compound has a melting point of 70–140° C. in terms of a heat-absorption peak temperature on temperature increase by differential scanning calorimetry.

127. The method according to claim 126, wherein the wax has a melting point of 80–135° C.

128. The method according to claim 126, wherein the wax has a melting point of 90–130° C.

129. The method according to claim 120, wherein the hydrocarbon wax or petroleum wax has a melting point of 70–140° C. in terms of a heat-absorption peak temperature on temperature increase by differential scanning calorimetry.

130. The method according to claim 129, wherein the hydrocarbon wax or petroleum has a melting point of 80–135° C.

131. The method according to claim 129, wherein the hydrocarbon wax or petroleum wax has a melting point of 90–130° C.

132. The method according to claim 120, wherein the hydrocarbon wax or petroleum wax has a GPC molecular weight distribution showing a ratio Mw/Mn of 1 to 3 between weight-average molecular weight (Mw) and number-average molecular weight (Mn).

133. The method according to claim 74, wherein the toner contains a charge control agent comprising an azo metal complex represented by the following formula (1):

(1)

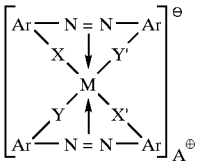

wherein M denotes a coordination center metal selected from the group consisting of Mn, Fe, Ti and Al; Ar denotes an aryl group capable of having a substituent, selected from nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $A^+$ denotes hydrogen, sodium, potassium, ammonium or aliphatic ammonium.

134. The method according to claim 133, wherein the toner contains a charge control agent comprising an azo iron complex represented by the following formula (2):

(2)

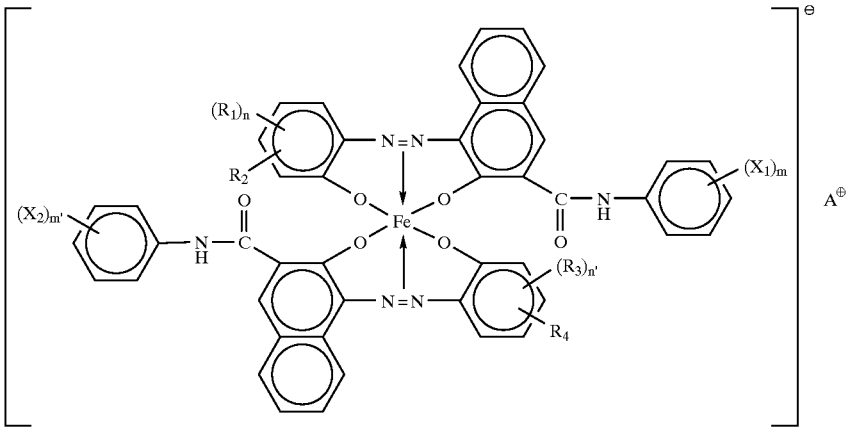

wherein $X_1$ and $X_2$ independently denote hydrogen atom, lower alkyl group, lower alkoxy group, nitro group or halogen atom; m and m' denote an integer of 1–3; $R_1$ and $R_3$ independently denote hydrogen atom, $C_{1-18}$ alkyl or alkenyl, sulfonamide, mesyl, sulfonic acid group, carboxy ester group, hydroxy, $C_{1-18}$ alkoxy, acetylamino, benzoylamino or halogen atom; n and n' denote an integer of 1–3; $R_2$ and $R_4$ denote hydrogen atom or nitro group; and $A^{\oplus}$ denotes hydrogen ion, sodium ion, potassium ion, ammonium ion or a mixture of these ions.

135. The method according to claim 134, wherein the cation $A^{\oplus}$ in the formula (2) comprises 75–98 mol. % of ammonium ion, and the remainder of hydrogen ion, sodium ion, potassium ion or a mixture of these ions.

136. The method according to claim 134, wherein the azo iron complex has a solubility in methanol of 0.1–8 g/100 ml.

137. The method according to claim 134, wherein the azo iron complex has a solubility in methanol of 0.3–4 g/100 ml.

138. The method according to claim 134, wherein the azo iron complex has a solubility in methanol of 0.4–2 g/100 ml.

139. The method according to claim 74, wherein the colorant comprises at least magnetic iron oxide particles.

140. The method according to claim 139, wherein the toner contains 10–200 wt. parts of the magnetic iron oxide particles per 100 wt. parts of the binder resin.

141. The method according to claim 139, wherein the magnetic iron oxide particles have a sphericity (ϕ) of at least 0.8.

142. The method according to claim 141, wherein the magnetic iron oxide particles contain silicon.

143. The method according to claim 142, wherein the magnetic iron oxide particles have such a silicon distribution as to provide a silicon content B contained up to an iron distribution of 20 wt. % with respect to the total silicon content A in the magnetic iron oxide giving a percentage (B/A)×100=44–84% and a silicon content C at the surface of the magnetic iron oxide particles giving a percentage (C/A)×100=10–55%.

144. The method according to claim 74, wherein the toner is in mixture with hydrophobized silica fine powder externally added thereto.

145. The method according to claim 144, wherein the silica fine powder has been hydrophobized by treatment with silicone oil.

146. The method according to claim 144, wherein the toner has a weight-average particle size of 3–9 μm.

147. The method according to claim 74, wherein in the developing step, the electrostatic latent image held on the image-bearing member is developed with a layer of the toner carried on a toner-carrying member disposed with a gap from the image-bearing member at a developing position, the toner layer having a thickness smaller than said gap at the developing position.

148. The method according to claim 147, wherein in the developing step, the electrostatic latent image on the image-bearing member is developed while applying a bias voltage to the toner-carrying member.

149. The method according to claim 148, wherein the bias voltage comprises a DC voltage and an AC voltage in superposition.

150. The method according to claim 74, wherein said image-bearing member comprises an electrophotographic photosensitive member.

151. The method according to claim 74, wherein in the transfer step, the toner image on the image-bearing member is directly transferred onto the recording material without via an intermediate transfer member.

152. The method according to claim 74, wherein in the transfer step, the toner image on the image-bearing member is first transferred onto an intermediate transfer member, and then from the intermediate transfer member to the recording material.

* * * * *

UNITED STATES PATENT AND TRADEMARK OFFICE

CERTIFICATE OF CORRECTION

PATENT NO. : 5,976,752
DATED : November 2, 1999
INVENTOR(S) : Satoshi Matsunaga et al.

It is certified that error appears in the above-identified patent and that said Letters Patent is hereby corrected as shown below:

Title Page, Item [56] U.S. PATENT DOCUMENTS
"1-56759" should read --62-156759--;
"62-195682" should read --1-195682--;
"62-195680" should read -- 62-195681--;
Insert: -- 0589706 3/1994 EPO
0745906 12/1996 EPO
0643336 3/1995 EPO--.
Title Page , Item [56] U.S. PATENT DOCUMENTS
Insert --5,518,850 5/1996 Bayley, et al. 430/109--.

Title Page, Item [56] AFTER FOREIGN PATENT DOCUMENTS
Insert --OTHER PUBLICATIONS
Patent Abstracts of Japan, Vol. 096, No. 005, May 1996 of JP-8-22145--.

Title Page Item [57] ABSTRACT
Line 6, "5-50" should read --15-50--;
Line 12 "W4/S6" should read W4?W6--;
Line 16, "haing" should read --having--.

Sheet 2,
Fig. 2, "COPOLYHER" should read --COPOLYMER--.

Column 3,
Line 38, "that" should read --in which--.

Column 4,
Line 40, "5-50" should read --15-50--;
Line 50, "W4/S6" should read --W4/W6--;
Line 55, "haing' should read --having--.

Column 5,
Line 18, "$^{13}$C-NMR" should read -- $^{1}$H-NMR--.

UNITED STATES PATENT AND TRADEMARK OFFICE

CERTIFICATE OF CORRECTION

PATENT NO. : 5,976,752
DATED : November 2, 1999
INVENTOR(S) : Satoshi Matsunaga et al.

It is certified that error appears in the above-identified patent and that said Letters Patent is hereby corrected as shown below:

Column 6,
Line 18, "for" should read --that--;
Line 33, "affect" should read --affects--;
Line 65, "result" should read --resulting--.

Column 8,
Line 30, "comprise" should read --comprises--;
Line 37, "group-containing" should read --group containing--;
Line 59, "an the" should read --and the--;
Line 66, "resins" should read --resin--.

Column 11,
Line 63, "rein" should read --resin--.

Column 12,
Line 12, "the L" should read --the--.

Column 13,
Line 53, "group" should read --groups--.

Column 14,
Line 41, "component." should read --components.--.

Column 15,
Line 53, "Also this" should read --Also in this--;
Line 54, "A was" should be deleted;
Line 55, "may preferably be added." (first occurrence) should be deleted.

UNITED STATES PATENT AND TRADEMARK OFFICE

CERTIFICATE OF CORRECTION

PATENT NO. : 5,976,752
DATED : November 2, 1999
INVENTOR(S) : Satoshi Matsunaga et al.

It is certified that error appears in the above-identified patent and that said Letters Patent is hereby corrected as shown below:

Column 16,
Line 9, "controllability o" should read --controllability of
Line 54, "ethylene-" (2nd occurrence) should read --methylene--;
Line 56, "bisoleylamide," should read --bisoleylamide, --.

Column 17,
Line 34, "are" should read --which are--;
Line 35, "formed" should read --found.

Column 18,
Line 55, "change" should read --charge--.

Column 20,
Line 14, "an the" should read --and the--;
Line 23, "be" should be deleted; and "pats" should read --parts--.

Column 22,
Line 2, "thin" should read --their--;
Line 28, "used" should read --to use--;
Formula (2), "$(R_1)_m$ " should read -- $(R_1)_n$ --; and " 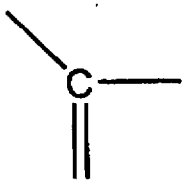 " should read -- 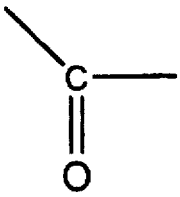 --.

UNITED STATES PATENT AND TRADEMARK OFFICE

CERTIFICATE OF CORRECTION

PATENT NO. : 5,976,752
DATED : November 2, 1999
INVENTOR(S) : Satoshi Matsunaga et al.

It is certified that error appears in the above-identified patent and that said Letters Patent is hereby corrected as shown below:

Column 23,
Line 10, "ions," should read --images--;
Line 14, "coonsisting" should read --consist--;
Line 16, "in case" should read --in a case--.

Column 25,
Compleex (3),

"—N—" should read ----$\underset{H}{N}$----.

Coumn 30,
Line 32, "aqueous" should read --aqueous solution--;
Line 38, "crystals" should read --aqueous solution--;
Line 64, "aqueous" should read --aqueous solution--.

Column 32,
Line 12, "spericity" should read --sphericity--;
Line 17, "particles." should read --particle.--;
Line 23, "addition a" should read --addition to a --;
Line 42, "Blue," should read --Blue,--.

Column 34,
Line 56, "Example" should read --Examples--;
Line 59, "chlorosi lane," should read --chlorosilane,--;
Line 61, "zyldimethylchlorosi lane" should read --zyldimethylchlorosilane--.

Column 36,
Line 32, "Soxhlet's" should read --Soxhlet's extractor--;
Line 38, "win" should read --with cooling water 56. The THF cooled in--;
Line 38, "led in the cooler 55 is" should be deleted.

Column 37,
Line 2, "0 available" should read --available--.

UNITED STATES PATENT AND TRADEMARK OFFICE

CERTIFICATE OF CORRECTION

PATENT NO. : 5,976,752
DATED : November 2, 1999
INVENTOR(S) : Satoshi Matsunaga et al.

It is certified that error appears in the above-identified patent and that said Letters Patent is hereby corrected as shown below:

Column 39,
Line 53, "(ca. 12H)" should read --(ca. 12M)--;
Line 59, "table" should read --tube--.

Column 40,
Line 34, "volume-bias" should read --volume-basis--;
Line 44, "In case" should read --In a case--;
Line 62, "concentration" (second occasion) should read --control agent--;
Line 66, "denote" should read --denotes--.

Column 42,
Line 19, "to which to" should read --to which the--;
Line 24, "contac" should read --contact--.

Column 43,
Line 24, replaced a" should read --replaced by a --.

Column 44,
Line 12, "stepment" should be deleted.

Column 47,
Line 26, "photosensitive rum" should read --photosensitive drum--;
Line 65, "may detachably" should read --may be detachably--.

Column 48,
Line 5, "also incorporate" should read --also used to incorporate--;
Line 53 and 54,"changing" should read --charging--;
Line 60, "descried" should read --described--;
Line 62, "mean" should read --means--;
Line 66, "In case" should read --In a case--.

Column 50,
Line 62, "pats" should read --parts--.

UNITED STATES PATENT AND TRADEMARK OFFICE

CERTIFICATE OF CORRECTION

PATENT NO. : 5,976,752
DATED : November 2, 1999
INVENTOR(S) : Satoshi Matsunaga et al.

It is certified that error appears in the above-identified patent and that said Letters Patent is hereby corrected as shown below:

Column 53,
Table 1 and 2, alcohls" should read --alcohols--.

Column 57,
Line 33, "contained the" should read --contained in the--;
Line 48, "(SBET" should read --($S_{BET}$--.

Column 59,
Table 6, "*EA" should read --* : EA-- and "MP" should read -- : MP.

Column 62,
Line 56, "drums" should read --drum--.

Column 63,
Line 32, "monomer" should read --monomers--.

Column 64,
Table 10, "Compositon" should read --Composition--; and alcohls" should read --alcohols--.

Column 65,
Table 10, "Compositon" should read --Composition--; and alcohls" should read --alcohols--.
Table 11,"Compositon" should read --Composition--; and alcohls" should read --alcohols--, and "(II-3) 3 5 4" should read --(II-3) 3 5 — --.

Column 67,
Table 13, "Compositon" should read --Composition--;
Line 63, "an dried" should read --and dried--.

Column 70,
Line 63, "Canon)" should read --Canon K.K.)--.

Column 71,
Line 12 "C: Soling" should read --C: Soiling--.

UNITED STATES PATENT AND TRADEMARK OFFICE

CERTIFICATE OF CORRECTION

PATENT NO. : 5,976,752
DATED : November 2, 1999
INVENTOR(S) : Satoshi Matsunaga et al.

It is certified that error appears in the above-identified patent and that said Letters Patent is hereby corrected as shown below:

Column 74,
Table 19, "sol-" should be deleted;

| | | |
|---|---|---|
| "1:2.8 2.6 1.2<br>1:1.7 1.3 1.1" | should read | --1:2.8 2.5 1.4--<br>1:1.7 1.3 1.1--; |
| "3800 42.3<br>18300 16.7" | should read | --3800 42.3<br>18300 18.7--; and |
| "6.9 2.1<br>9.6 38.5" | should read | --9.6 2.1<br>9.6 38.4--. |

Column 75,
Table 21, "Ex. II-19 1.50" should read --Ex. II-19 1.40--.

Column 78,
Line 30, " (SBET=100" should read --($S_{BET}$=100--.

Coumn 82,
Table 26, "slight ogglomerate" should read --slight agglomerate--;
Line 52, "5-50" should read --15-50--;
Line 62, "W4/S6" should read --W4/W6--;
Line 67, "haing" should read --having--.

Column 83,
Line 21, "5-50" should read --15-50--.

UNITED STATES PATENT AND TRADEMARK OFFICE

CERTIFICATE OF CORRECTION

PATENT NO. : 5,976,752
DATED : November 2, 1999
INVENTOR(S) : Satoshi Matsunaga et al.

It is certified that error appears in the above-identified patent and that said Letters Patent is hereby corrected as shown below:

Column 88,
Line 42, "5-50" should read --15-50--;
Line 52, "W4/S6" should read --W4/W6--;
Line 56, "haing" should read --having--.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*